US012264558B2

(12) United States Patent
Slettebo et al.

(10) Patent No.: US 12,264,558 B2
(45) Date of Patent: Apr. 1, 2025

(54) ROTARY MULTI TOOL

(71) Applicant: TRANSOCEAN SEDCO FOREX VENTURES LIMITED, Grand Cayman (KY)

(72) Inventors: Tor Sigurd Slettebo, Houston, TX (US); Gregory Emberley, Houston, TX (US); Michael Czarnota, Houston, TX (US); Anders Holgersen, Sandnes (NO)

(73) Assignee: TRANSOCEAN SEDCO FOREX VENTURES LIMITED, Hamilton (BM)

( * ) Notice: Subject to any disclaimer, the term of this patent is extended or adjusted under 35 U.S.C. 154(b) by 0 days.

(21) Appl. No.: 18/369,653

(22) Filed: Sep. 18, 2023

(65) Prior Publication Data

US 2024/0271506 A1 Aug. 15, 2024

Related U.S. Application Data

(63) Continuation of application No. PCT/EP2022/057248, filed on Mar. 18, 2022.
(Continued)

(51) Int. Cl.
*E21B 41/00* (2006.01)

(52) U.S. Cl.
CPC ..... *E21B 41/0021* (2013.01)

(58) Field of Classification Search
CPC ..... E21B 41/0021
See application file for complete search history.

(56) References Cited

U.S. PATENT DOCUMENTS 3,495,288 A 2/1970 Ford
3,733,641 A 5/1973 Brown
(Continued)

FOREIGN PATENT DOCUMENTS

CN 110685643 A 1/2020
WO 2015113150 A1 8/2015
WO 2020121181 A2 6/2020

OTHER PUBLICATIONS

International Search Report and Written Opinion issued Sep. 26, 2022 in International Application No. PCT/EP2022/057248.
(Continued)

*Primary Examiner* — James G Sayre
(74) *Attorney, Agent, or Firm* — Panitch Schwarze Belisario & Nadel LLP

(57) ABSTRACT

The device for covering an opening of a wellbore includes a housing having a central opening. The housing is configured to be secured within a well center opening. Covers are arranged around the central opening and are configured to move to an open-cover position, a partially-closed-cover position, or a closed-cover position. The covers cover at least a portion of the central opening n the partially-closed cover position or the closed-cover position. An actuator extends and retract the covers. A controller sends signals to the actuator to extend and retract the covers. The controller uses motion data and diameter data of a tubular to determine the partially-closed-cover position for a cover opening time and sends signals to extend and retract the plurality of covers to the partially-closed-cover position for a cover opening time.

23 Claims, 42 Drawing Sheets

Related U.S. Application Data

(60) Provisional application No. 63/163,189, filed on Mar. 19, 2021.

(56) References Cited

U.S. PATENT DOCUMENTS

| | | | | |
|---|---|---|---|---|
| 4,494,607 | A | 1/1985 | Ford et al. | |
| 4,690,213 | A * | 9/1987 | Stannard | E21B 33/062 166/82.1 |
| 4,895,205 | A | 1/1990 | Thompson et al. | |
| 5,203,408 | A | 4/1993 | Boscher | |
| 5,842,252 | A | 12/1998 | Cameron et al. | |
| 6,059,052 | A | 5/2000 | Haggard | |
| 9,109,426 | B2 | 8/2015 | Khulusi | |
| 9,109,427 | B2 | 8/2015 | Khulusi | |
| 9,488,036 | B2 | 11/2016 | Ross et al. | |
| 2013/0153302 | A1 | 6/2013 | Angelle et al. | |
| 2013/0153303 | A1 | 6/2013 | Angelle et al. | |
| 2013/0333897 | A1 * | 12/2013 | Wells | E21B 41/0021 166/93.1 |
| 2014/0014361 | A1 | 1/2014 | Nelson | |
| 2015/0240603 | A1 | 8/2015 | Ross et al. | |
| 2019/0383113 | A1 | 12/2019 | McDaniel et al. | |

OTHER PUBLICATIONS

Provisional Opinion Accompanying the Partial Search Result issued Jun. 17, 2022 in International Application No. PCT/EP2022/057248.

Webpage for Typhoon Wiper, Jan. 19, 2021, retrieved online from The Wayback Machine <https://web.archive.org/web/20210119174630/https://www.rigtools.net/rigtools-originals/typhoon-wiper/>, 11 pages.

Webpage for BHA Wash Tool, Jan. 19, 2021, retrieved online from The Wayback Machine https://web.archive.org/web/20210119191748/https://www.rigtools.net/rigtools-originals/bha-wash-tool/, 7 pages.

* cited by examiner

300

700

800

800

ROTARY MULTI TOOL

CROSS-REFERENCE TO RELATED APPLICATIONS

This application is a continuation of pending International Patent Application No. PCT/EP2022/057248 filed Mar. 18, 2022, which was published Sep. 22, 2022 under International Publication No. WO2022/195116 and which claims priority to and the benefit of U.S. Provisional Patent Application No. 63/163,189 filed on Mar. 19, 2021. The entire disclosure of each application identified in this paragraph is incorporated by reference in the present application.

TECHNICAL FIELD

The present disclosure generally relates to wellbores (e.g., oil wells or any drilled holes or boreholes that are drilled to aid in the exploration and recovery of natural resources, including oil, gas, or water) and, in particular, to a system for preventing objects form falling into a wellbore and for cleaning tubulars used during drilling operations.

BACKGROUND

During a drilling operation, objects can sometimes accidentally fall into a wellbore from the rig floor. These objects can prevent downhole equipment from functioning properly and can often impede the drilling and completion process. Some large objects can be retrieved from a wellbore using specially designed tools. By contrast, relatively small objects, such as small metal objects, dropped in a wellbore can often cause significant disruption to downhole equipment and related operations. For example, during completion operations, small pieces of metal present in a wellbore can prevent packers and other completion tools from sealing against a casing wall. During open hole drilling operations, such small metal objects can destroy very expensive downhole equipment such as Polycrystalline Diamond Compact (PDC) bits.

Such small objects can also be very difficult to retrieve from a wellbore, as they are often too small to be grasped using conventional tools. This is especially true for small metal objects, and particularly small metal objects that have an irregular shape or small pieces that can be broken up during the retrieval process. Unfortunately, many drilling rigs typically have many small metal objects (such as, for example, wrenches, chain, bolts, tong dies and nuts) at or near the rig floor. Such objects, which are in relatively close proximity to the upper opening of a well, are at risk of falling into a wellbore.

Further, retrieving small metal objects can be very time consuming and, as a result, very costly. Accordingly, the best way to prevent such disruptions and to avoid long and expensive retrieval of the objects is to keep such objects from entering a wellbore in the first place.

Current approaches of preventing the contamination of a well include manually covering the well with a cover when there is no tubular in a wellbore. However, when there is a tubular in the well, there can be a gap between the tubular or a drill string and the well. The existing method for covering the gap is to manually close the gap with a C-plate. Such manual work delays operations and poses danger to the personnel who engage in the manual work. Therefore, there is a need for a system and method for protecting the well from objects falling into the well.

SUMMARY

The present disclosure relates to a system for preventing objects from falling into a well and for cleaning tubulars used during drilling operations. The wells and associated wellbores may include holes or boreholes that are drilled to aid in the exploration and recovery of natural resources, including oil, gas, or water. Further, the wells can also be used for mineral extraction, environmental assessment, and temperature measurements. Consistent with a disclosed embodiment, a device for covering an opening of a wellbore is provided. The device includes a housing having a central opening, the housing configured to be secured within a well center opening, and a plurality of covers arranged around the central opening. The plurality of covers is configured to: (a) move into an open-cover position, a partially-closed-cover position, or a closed-cover position, and (b) cover at least a portion of the central opening when the plurality of covers is in the partially-closed-cover position or the closed-cover position.

Consistent with another disclosed embodiment, a device for removing mud, fluid, and/or debris from a tubular tripping out of a wellbore is provided. The device includes a housing having a central opening, the housing configured to be secured within a well center opening, and a plurality of flexible wipers arranged around the central opening. The plurality of flexible wipers is configured to: (a) move to an open-wiper position, a partially-closed-wiper position, or a closed-wiper position; and (b) cover the central opening when the plurality of wipers is in the partially-closed-wiper position or the closed-wiper position.

Consistent with another disclosed embodiment, a multifunctional device for covering an opening of a wellbore and removing mud, fluid, and/or debris from a tubular tripping out of the wellbore is provided. The multifunctional device includes a housing and a central opening, the housing configured to be secured within the opening of the well. Further, the multifunctional device includes a plurality of covers disposed at a first cross-sectional level and arranged around the central opening. The plurality of covers is configured to: (a) move to an open-cover position, a partially-closed-cover position, or a closed-cover position; and (b) cover at least a portion of the central opening when the plurality of covers is in the partially-closed-cover position or the closed-cover position. Further, the multifunctional device includes a plurality of flexible wipers disposed at a second cross-sectional level located below the first cross-sectional level and arranged around the central opening. The plurality of flexible wipers is configured to: (a) move to an open-wiper position, a partially-closed-wiper position, or a closed-wiper position; and (b) cover the central opening when the plurality of wipers is in the partially-closed-wiper position or the closed-wiper position.

The present disclosure also provides a method of covering an opening of a wellbore and removing mud, fluid, and/or debris from a tubular tripping out of the wellbore, the method comprising: (a) moving a plurality of covers disposed around the tubular to a partially-closed-cover position or a closed-cover position, thereby covering at least a portion of the opening; and (b) moving a plurality of flexible wipers disposed around the tubular to be in contact with the tubular, thereby removing the mud, fluid, and/or debris from the tubular when the tubular is tripping out. Optionally, the method further comprises ejecting, onto the tubular, fluid jets from a plurality of nozzles disposed around the tubular, thereby cleaning the tubular.

The foregoing general description and the following detailed description are exemplary and explanatory only and are not restrictive of the claims.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

The present disclosure relates to a rotary multi-tool having two or more functions. The rotary multi-tool is configured to prevent objects from falling into a wellbore and remove mud, debris, fluid, and/or metal shavings from a tubular that is tripping out of the wellbore. In some implementations, the rotary multi-tool comprises two systems connected to each other, with one system for preventing objects from falling into the wellbore, and the other system for removing mud, debris, fluid, and/or metal shavings from the tubular. Each of the two systems can also be used as a standalone system for its respective functions. These systems are described in detail below.

Figure 1:
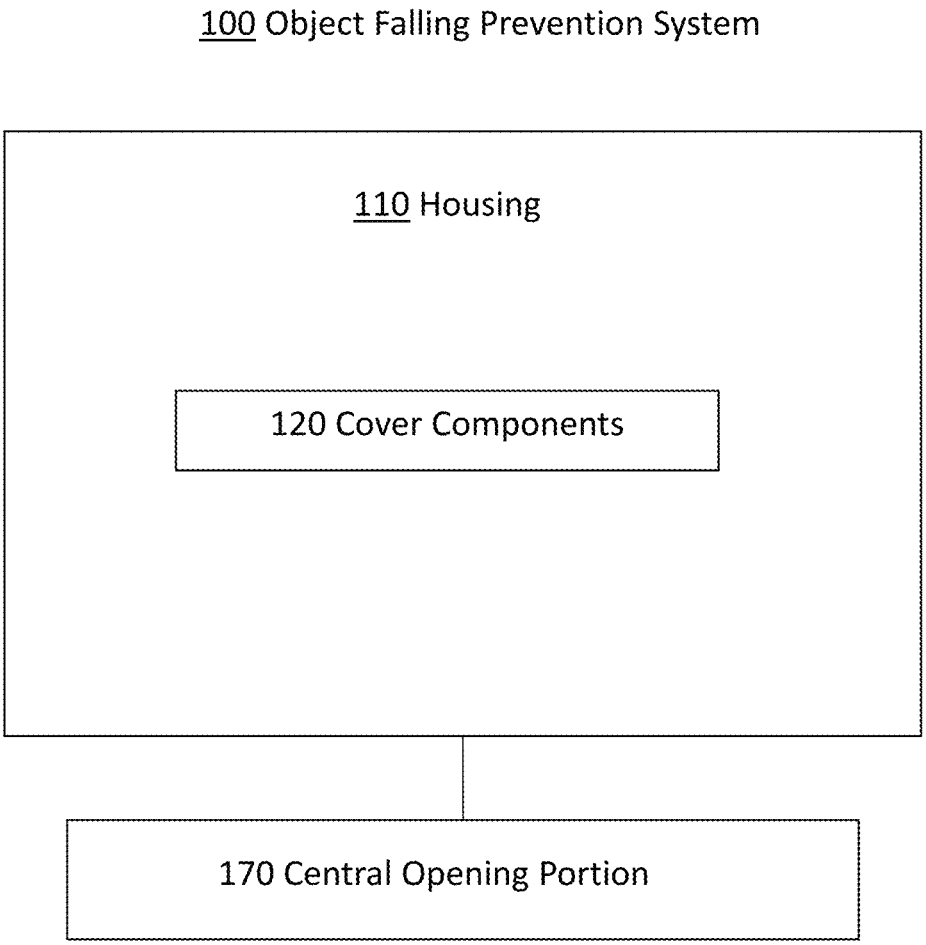
FIG. 1 is an example of a diagram of an object falling prevention system according to an embodiment.

Aspects of the present disclosure relate to a system and method for preventing objects from falling into a wellbore during a drilling operation. The system for preventing the objects from falling into the wellbore may be installed on any suitable drilling rig, such as onshore or offshore drilling rigs (e.g., drill ships). The system may be part of a drill floor and may be situated in a well center opening. The well center opening is an opening in a drill floor in which various tools (e.g., tubulars) are inserted so that they can be placed into a well. FIG. 1 shows an example object falling prevention system 100 for preventing objects from falling into the wellbore. The object falling prevention system 100 may be used for covering the well center opening when objects other than tubulars are placed within the well. For example, such objects may include wirelines, cables, control lines, or any other objects. The object falling prevention system 100 may be retrofittable and may be configured to be removable and replaceable.

The object falling prevention system 100 includes a housing 110 configured to be placed within a well center opening (e.g., the opening of a well center at a drill floor level). The housing 110 may be cylindrical to fit the well center opening when the well center opening is cylindrical. It should be noted, that in some implementations, the housing 110 may not be cylindrical but may be conical, partially cylindrical and partially conical, or may have another axisymmetric shape. In some cases, the housing 110 may not be axisymmetric when the well center opening is not axisymmetric (e.g., when the well center opening has a rectangular cross-section).

The housing 110 is configured to fit within a well center opening. The housing 110 is configured to be installed within the inner walls of a channel formed by the well center opening. For example, the housing 110 may have a cylindrical shape with an outer diameter that is less than the diameter of the cylindrical well center opening, such that the cylindrical housing 110 is installed within the well center opening and secured to the inner walls of the well center opening using any suitable securing mechanisms, such as bolts, clamps, springs, and the like. The housing 110 includes a central opening 170 configured to allow tubulars or other objects to be placed in and/or taken out of the well. In one implementation, the central opening 170 is configured to receive tubulars that have a diameter between a fraction of an inch and up to 20 inches. The central opening 170 may have a diameter of 25 inches, 24 inches, 23 inches, 22 inches, 21 inches, 20 inches, 19 inches, 18, inches, 17, inches, and the like. In some cases, the central opening 170 may have a diameter that is at least 19 inches.

Figure 2:
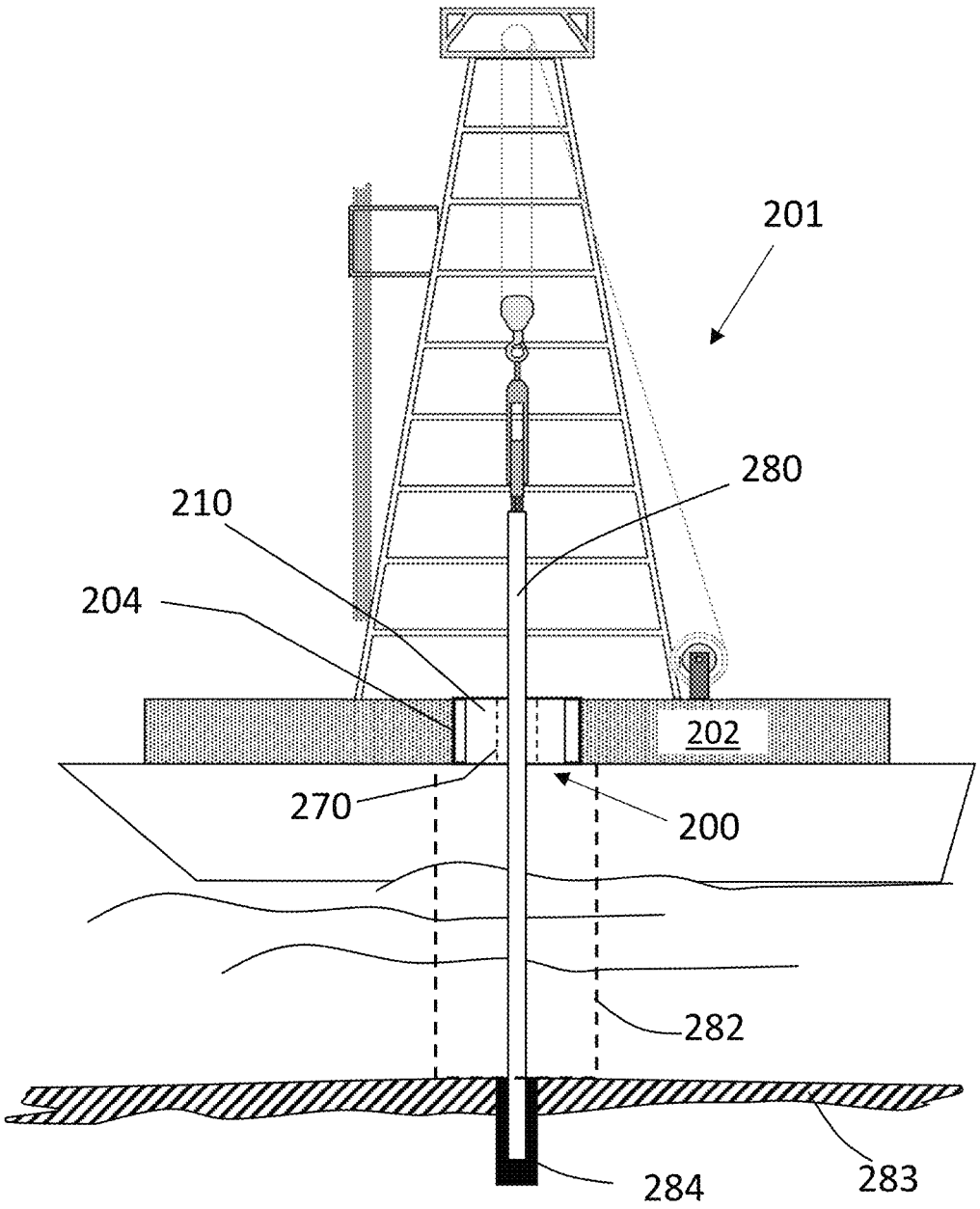
FIG. 2 is an example of a drilling rig including an object falling prevention system according to an embodiment.

FIG. 2 shows an example location of an object falling prevention system 200 on an offshore drill rig 201. It should be noted that the object falling prevention system 200 may also be installed in an onshore drill rig. The object falling prevention system 200 may be similar in form or in function to object falling prevention system 100. The object falling prevention system 200 includes a housing 210 placed within a well center opening 204 located at a drill floor 202. As shown in FIG. 2, the well center opening 204 is connected to a wellbore 284 in an ocean floor 283 via a riser 282. The housing 210 includes a central opening 270 such that a tubular 280 (or any other object placed in the well) is configured to pass through the central opening 270 when tripping into the well or tripping out of the well.

Figure 3:
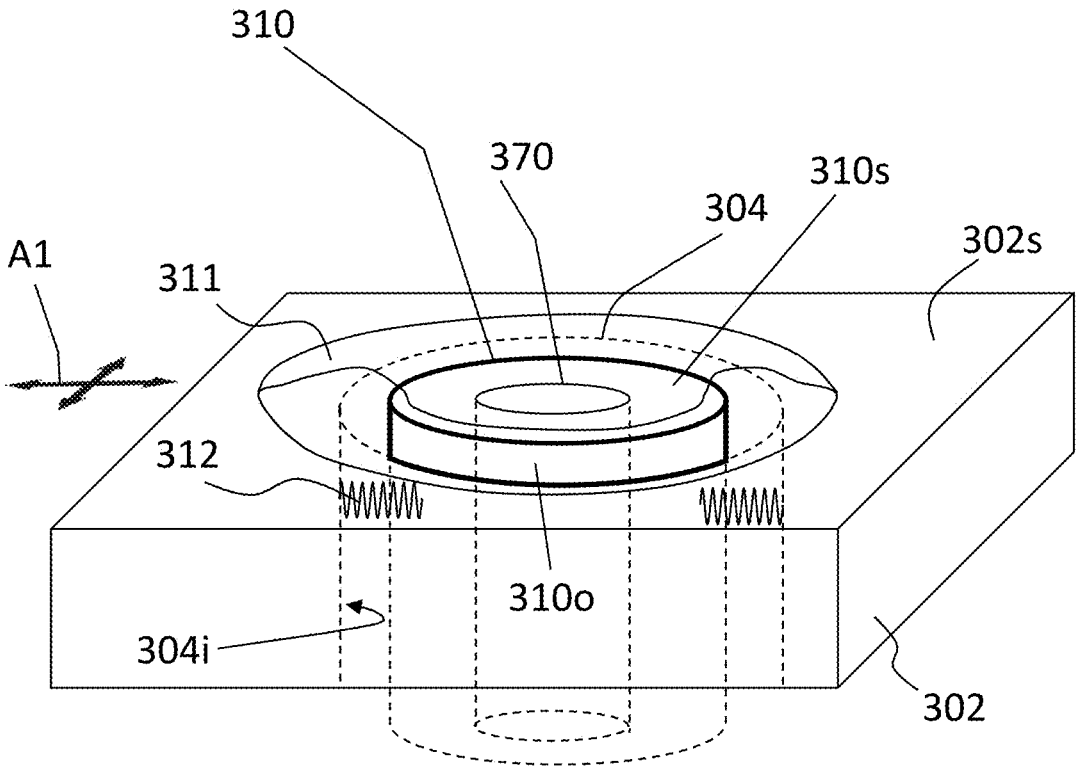
FIG. 3 is an example of an object falling prevention system placed within a well center opening according to an embodiment.

Further, an example embodiment of an object falling prevention system 300 placed within a well center opening 304 of a drill floor 302 is illustrated in FIG. 3. The object falling prevention system 300 may be similar to or the same as, in form or in function, object falling prevention system 100 or object falling prevention system 200, as described herein. The object falling prevention system 300 includes a housing 310 (e.g., the housing 310 may be similar, in form or in function to housing 110) placed within the well center opening 304. The housing 310 is secured to an inner wall 304*i* of the well center opening 304 sufficiently tightly, such that there are no passages between an outer wall 310*o* of the housing 310 and the inner wall 304*i* of the well center opening 304 for the objects (e.g., metal shavings, tools, bolts, debris, gravel, mud, and the like) to pass through. In some cases, the housing 310 may be secured to the well center opening tightly. In one implementation, as shown in FIG. 3, the housing 310 may be secured to the 304 via a set of springs 312 (or other suitable flexible elements, such as rubber inserts, rubber cords, and the like) and a cover 311 (e.g., cover 311 may be a rubber cover having at least some flexibility) may be used to connect a top surface 310*s* of the housing 310 with a top surface 302*s* of the drill floor 302, thereby allowing for the housing 310 to undergo at least some lateral movements (as indicated by arrows A1, as shown in FIG. 3) relative to the well center opening, while keeping objects from falling into the well. In some cases, the cover 311 is configured to move and/or flex during the lateral movements of the housing 310. Similar to the embodiments described above in relation to FIGS. 1 and 2, housing 310 includes a central opening 370 to allow objects (e.g., tubulars) in and out of the well. The housing 310 of the object failing prevention system 300 may be configured to fit vertically between a diverter and a rotary table.

Figure 4:
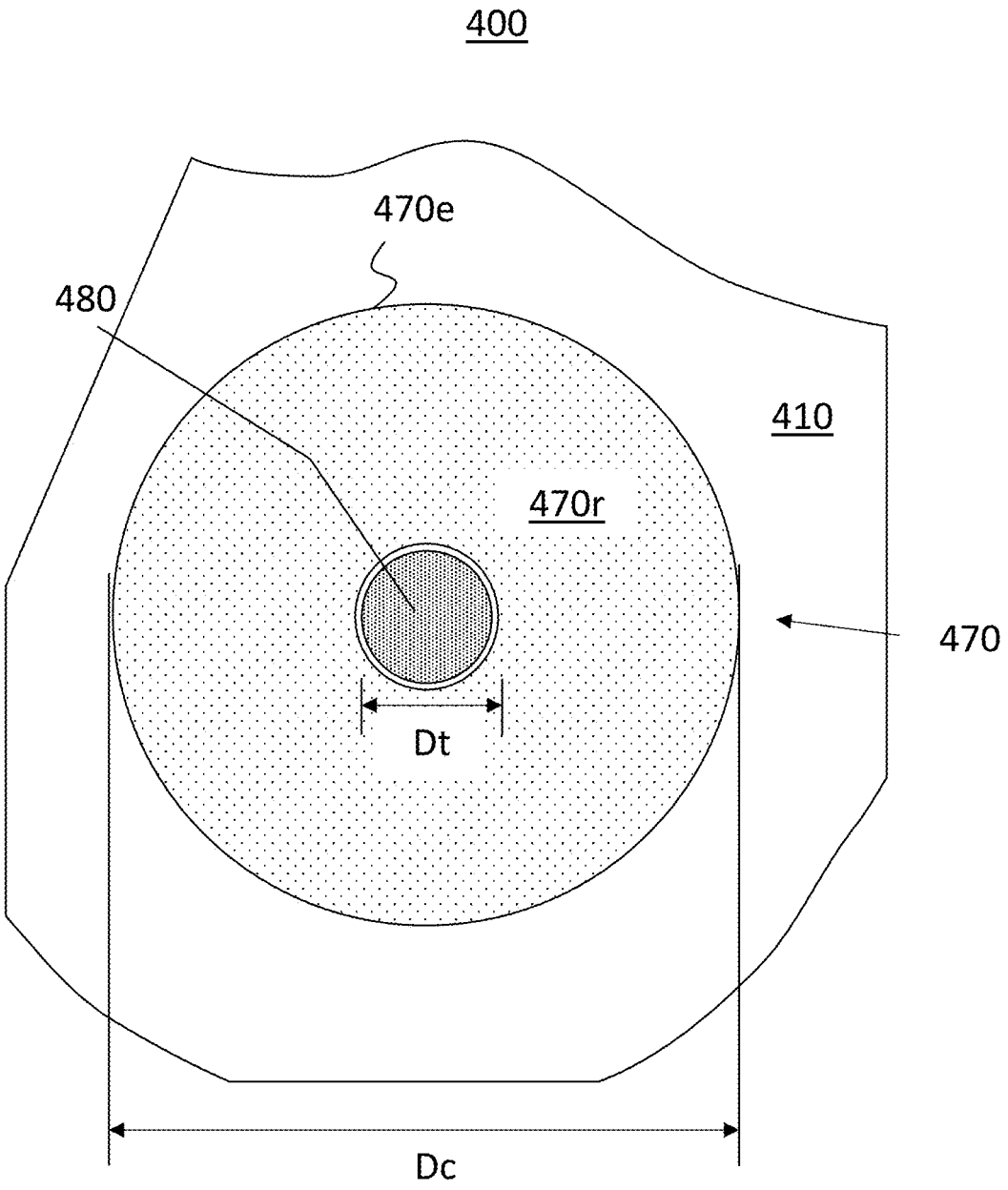
FIG. 4 is a top view of a center opening of the object falling prevention system according to an embodiment.

In one implementation, a central opening of an object falling prevention system has a cylindrical shape (herein the cylindrical shape implies a circular cross-section), thereby allowing for cylindrical objects (e.g., cables, tubulars, and the like) to be placed within the well. An example top view of an object falling prevention system 400 having a central opening 470 located within a hosing 410 is shown in FIG. 4. The object falling prevention system 400 may be similar to the object falling prevention systems 100-300 discussed herein. For example, the central opening 470 and the housing 410 may be similar to or the same as, in form or in function, respective other central openings and housing disclosed herein (e.g., the central opening 470 may be an example implementation of the central opening 170, and the housing 410 may be an example implementation of the housing 110). As shown in FIG. 4, the central opening 470 has a diameter Dc, and a tubular 480 placed within the central opening 470 has a diameter Dt that is smaller than the diameter Dc. In various embodiments, the housing 410 and the central opening 470 are designed such that the diameter Dc is larger than a diameter of the largest tubular used for drilling operations.

It should be noted, that in some cases, more than one system similar to the object falling prevention system 400 (or the object falling prevention systems 100-300) may be used for drilling operations. For instance, a first object falling prevention system having first characteristics may be used for making or breaking a riser, and a second object falling prevention system having second characteristics may be used for drilling operations (e.g., for trilling in or tripping out a drill pipe). For instance, the first object falling prevention system may include a large diameter central opening (e.g., the diameter of the central opening for the first object falling prevention system may be larger than the diameter of a riser) and a second object falling prevention system may include a smaller diameter central opening (e.g., the diameter of the central opening for the second object falling prevention system may be larger than the diameter of a drill pipe but may be smaller than the diameter of a riser).

Figure 5A:
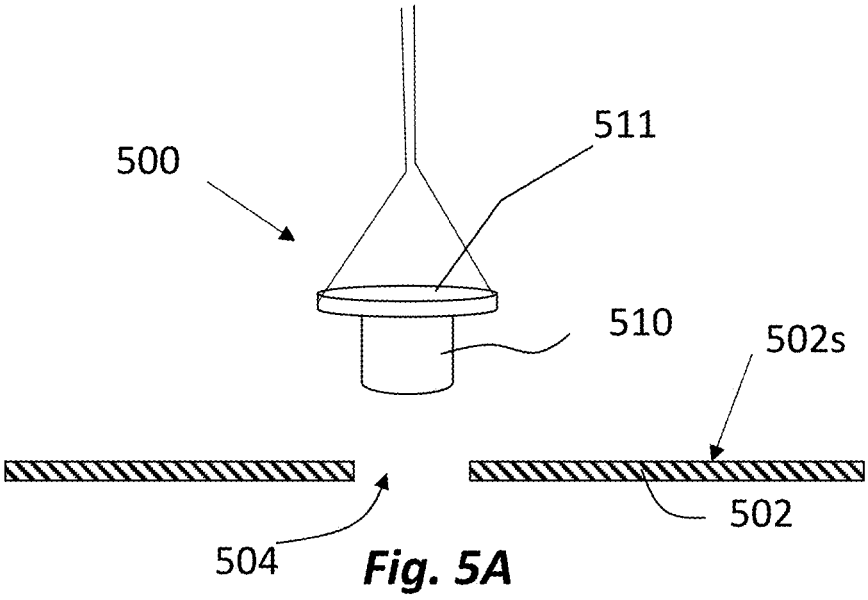
FIGS. 5A-5C are views of illustrative steps of placing an object falling prevention system into a well center opening according to an embodiment.
Figure 5B:
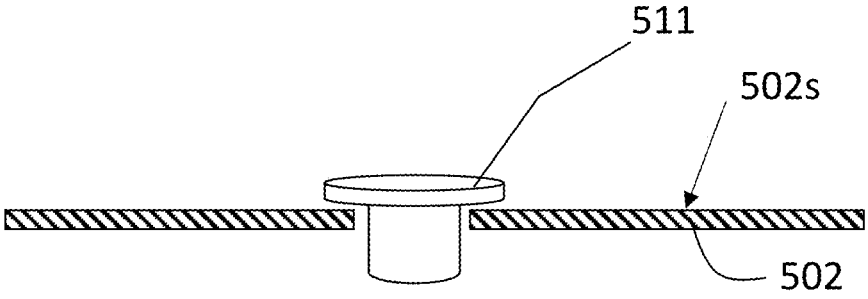
Figure 5C:
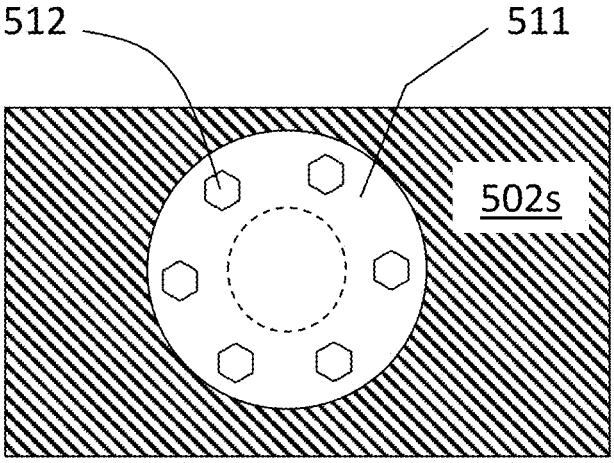

It should be also noted that, in various embodiments, the object falling prevention system 100 or other similar systems described herein is configured to be easily installable or removable for maintenance and/or repair. In one implementation, the object falling prevention system 100 may be lowered into a well center opening located at a drill floor (e.g., the object falling prevention system 100 may be suspended from a traveling block coupled to a drilling line). After lowering the object falling prevention system 100, it may be secured (via bolts, clamps, hooks, springs having hooks, and the like) to the side walls of the well center opening. Additionally, or alternatively, the object falling prevention system 100 may be secured to a top surface of the drill floor adjacent to the well center opening. For instance, FIGS. 5A-5C illustrate one possible implementation of securing an object falling prevention system 500 to the well center opening (the object falling prevention system 500 is similar to the other object falling prevention systems 100-400, as described herein). For example, FIG. 5A shows a process of the housing 510 of the object falling prevention system 500 being lowered towards a well center opening 504 of a drill floor 502. FIG. 5B shows that a cover 511 is selected to have a cross-sectional area larger than the cross-sectional area of the well center opening 504, such that cover 511 is configured to rest against a surface 502*s* of the drill floor 502 and secure the housing 510 within the well center opening 504. Further, FIG. 5C shows a top view of cover 511 and the drill floor surface 502*s*. The drill floor 502 and the cover 511 may be configured such that the cover 511 is further secured to the drill floor 502 via suitable mechanisms (e.g., bolts 512).

Figure 6A:
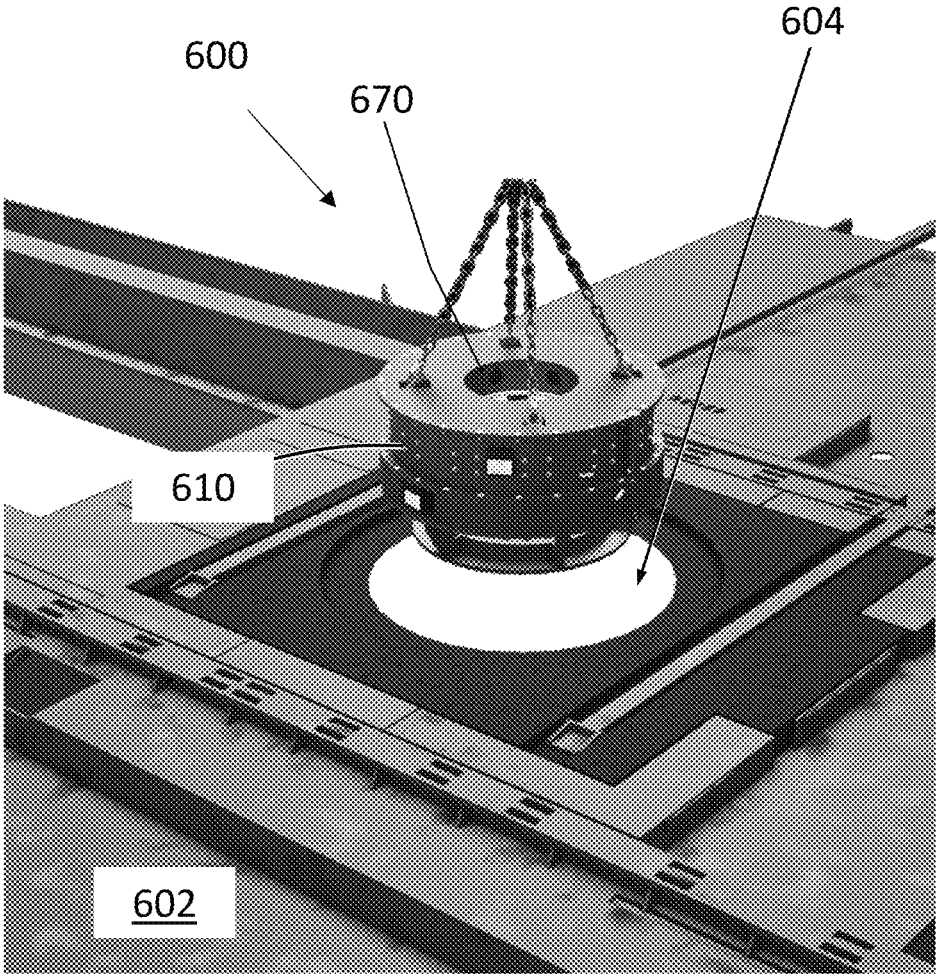
FIGS. 6A and 6B are other views of illustrative steps of placing an object falling prevention system into a well center opening according to an embodiment.
Figure 6B:
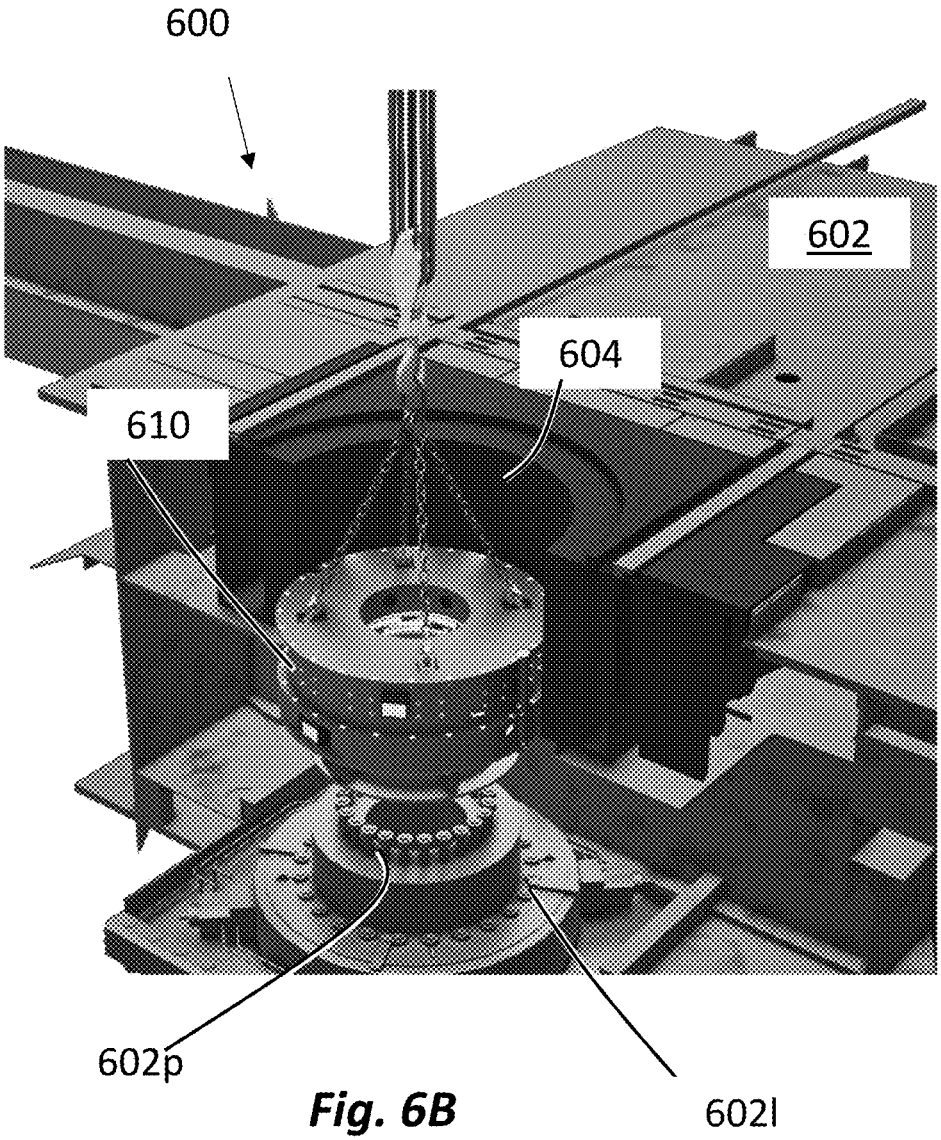

FIGS. 6A and 6B show another embodiment of a process of installing an object falling prevention system 600 (the object falling prevention system 600 is similar to the other similar systems, such as the object falling prevention systems 100-500 described herein). FIG. 6A shows a process of lowering a housing 610 into a well center opening 604 of a drill floor 602. The housing 610 includes a center opening 670. FIG. 6B shows that the drill floor 602 may have multiple levels. For example, the drill floor 602 may have a level 6021 onto which the housing 610 is installed (e.g., the housing 610 is coupled to the level 6021 via suitable coupling mechanisms such as bolts, pins, springs, and the like). For example, the housing 610 may include a set of openings into which the bolts (or pins) 602*p* may be placed, thereby securing the housing 610 in place relative to level 6021.

Returning to FIG. 4, since the central opening 470 has a diameter Dc, and the tubular 480 placed within the central opening 470 has a diameter Dt, a ring area 470*r* of the central opening 470 located between the tubular 480 and the outer edge of the central opening 470 requires to be covered in order to prevent objects from falling into the well. It should be noted that depending on the diameter Dt of the tubular 480 used (or the diameter Dt of the particular portion of the tubular 480 that is located within the central opening 470), the ring area 470*r* may change. Accordingly, the object falling prevention system 400 is configured to cover ring areas 470*r* of various sizes.

In some cases, a tubular may have a variable diameter along a length of the tubular. For example, if the tubular is a drill pipe, the tubular may have sections (e.g., drill pipe joints) that have a larger diameter. When the drill pipe is tripping in (or tripping out), these larger diameter sections periodically pass through a central opening (e.g., through the central opening 470), and the covering of the central opening needs to be adjusted for such larger diameter sections (e.g., a smaller size ring area 470*r* needs to be covered when the larger diameter sections pass through the central opening 470 during the tripping in or tripping out operation). After passing of the larger diameter sections, the covering of the central opening needs to be readjusted (e.g., a larger ring area 470*r* needs to be covered when the smaller diameter sections pass through the central opening 470 during the tripping in or tripping out operation) in order to eliminate any uncovered portions of the central opening 470. Further, in some cases, when there are no tubulars within the well center opening, the entirety of central opening 470 or at least 90% of its area may be covered to prevent objects from falling into the well.

Returning to FIG. 1, the central opening 170 is adjacent to the housing 110 (as indicated by a line connecting the central opening 170 to the housing 110). Further the housing 110 includes cover components 120. The cover components 120 include covers located proximal to the central opening 170 and arranged around the central opening. Further, the cover components 120 include any other suitable components for facilitating movement and use of the covers. For instance, such cover components 120 may include cover actuators for moving covers, controllers for controlling operations of the cover actuators, and any other components associated with the covers. The covers are configured to: (a)

move in an open-cover position, a partially-closed-cover position or a closed-cover position, and (b) at least partially cover the central opening 170 when the plurality of covers is in the partially-closed-cover position or in the closed-cover position. In the partially-closed-cover position, the covers are configured to cover a portion of the central opening between a tubular located within the central opening and an edge of the central opening (e.g., a ring area similar to the ring area 470*r*, as shown in FIG. 4). In the open-cover position, the plurality of covers is retracted, thereby unblocking the central opening. In the partially-closed-cover position the plurality of covers is partially extended, thereby partially covering the central opening, and in the closed-cover position, the plurality of covers is extended, thereby covering the central opening.

Figure 7A:
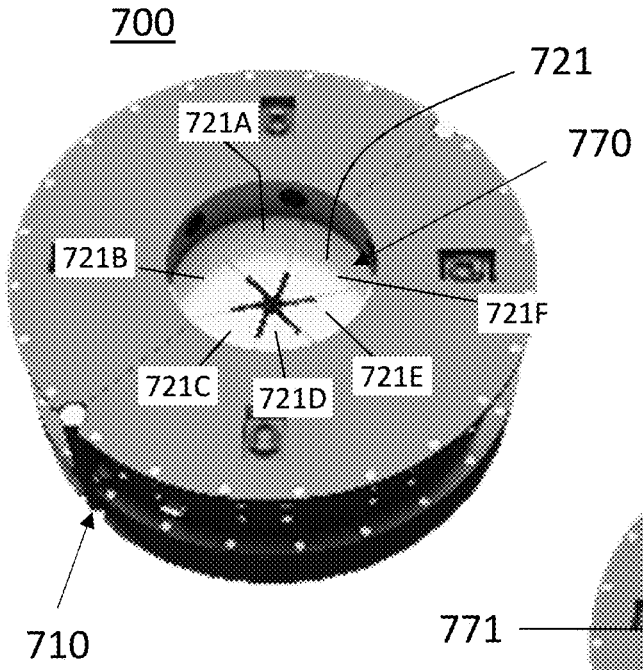
FIG. 7A is a view of an object falling prevention system with covers in a closed position according to an embodiment.
Figure 7B:
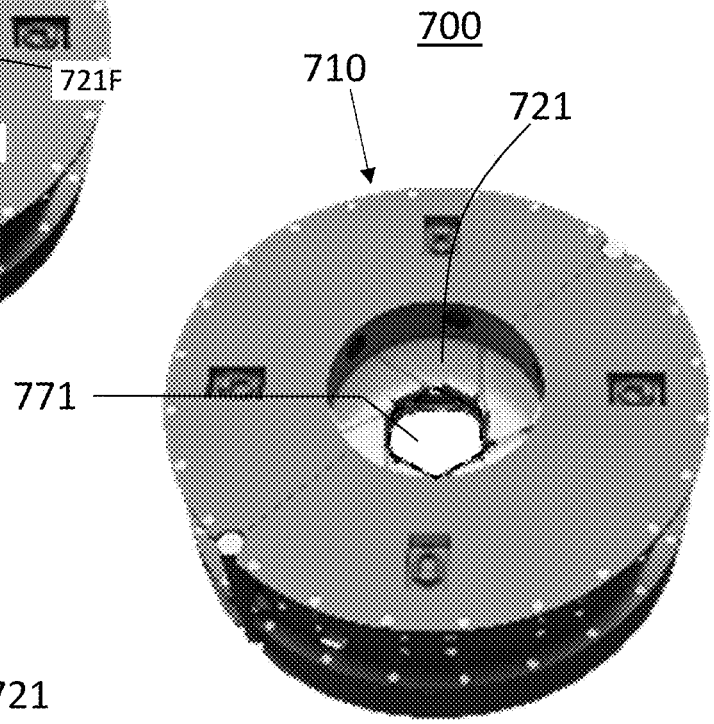
FIG. 7B is a view of an object falling prevention system with covers in a partially closed position (also referred to as a partially open position) according to an embodiment.

FIGS. 7A-7D show an object falling prevention system 700 that includes a housing 710 and covers 721 configured to cover at least a portion of a central opening 770 located within the housing 710. The uncovered opening (e.g., an uncovered opening 771, as shown in FIG. 7B) is the portion through which a tubular or a tool may pass as it is tripping into the well or tripping out of the well. The object falling prevention system 700 may be similar to the other object falling prevention systems 100-600 described herein. As shown in FIG. 7A, the plurality of cover components 721 may include multiple covers (e.g., six covers 721A-721F are shown in FIG. 7A), each one of the plurality of covers 721 configured to move (e.g., extend) in synchronization with any other one of the plurality of covers 721 to cover a portion of the central opening 770. The covers 721 may all extend in substantially the same plane (herein, such plane is referred to as a cross-sectional level associated with the housing 710) and may be a set of aperture blades (or diaphragm blades), as known in the art of optical diaphragms. Note that the covers 721 may not move exactly on the same plane, and their planes of motions are slightly staggered to allow the covers 721 to partially overlap (e.g., when the covers 721 are in the open-cover position).

The object falling prevention system 700 may have two to twenty covers 721. In some cases, the object falling prevention system 700 may have four to thirty covers 721. The covers 721 may have straight edges, resulting in a polygon shape of the uncovered opening 771, while curved covers 721 improve the roundness of the uncovered opening 771. The covers 721 may be made from any suitable durable material (e.g., plastic, metal, metal alloy, a composite material including plastic and metal, or any other suitable durable material, such as ceramics, rubber, and the like).

Figure 7C:
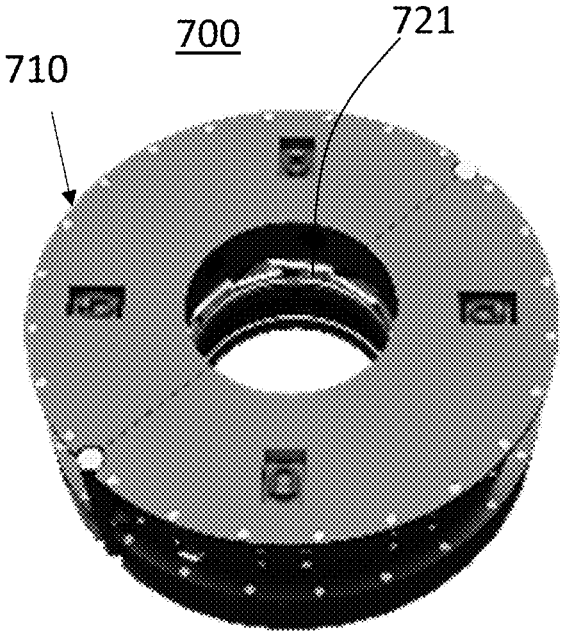
FIG. 7C is a view of an object falling prevention system with covers in an open position according to an embodiment.

As shown in FIG. 7A, the covers 721 are extended such that the entire cross section of the central opening 770 is covered (e.g., the covers 721 are moved into a closed-cover position). Thus, in the closed-cover position, the plurality of covers 721 is extended, thereby covering the central cylindrical opening at a particular cross-sectional level of the housing 710. FIG. 7C shows that the covers 721 are retracted such that the entire cross section of the central opening 770 is uncovered (e.g., the covers 721 are moved into an open-cover position). Thus, in the open-cover position, the plurality of covers 721 is retracted, thereby unblocking the central cylindrical opening. In some cases, in the closed-cover position, covers 721 cover at least 10%, at least 20%, at least 30%, at least 40%, or at least 50% more of the central cylindrical opening than when they are in the open-cover position.

Further, FIG. 7B shows that the covers 721 are moved such that a portion of the cross section of the central opening 770 is covered (e.g., the covers 721 are moved into a partially-closed-cover position). In the partially-closed-cover position, the area of the central cylindrical opening not covered by the plurality of covers 721 (i.e., the uncovered opening 771) may be about 1% to about 20% (e.g., about 1% to about 15%, or about 1% to about 10%) larger than a cross-sectional area of the tubular 780. For instance, the area may be 1%, 2%, 3%, 4%, 5%, 6%, 7%, 8%, 9%, 10%, and the like larger than the cross-sectional area of the tubular 780. In some cases, the area of the uncovered opening 771 may be no more than 9%, 8%, 7%, 6%, 5%, 4%, and the like, larger than the area uncovered opening 771. Additionally, or alternatively, a characteristic size of the uncovered opening 771 may be 1% to 10% larger than the diameter of a section of the tubular 780 located within the central opening 770. The characteristic size of the uncovered opening 771 is a diameter of a largest circle that can be inscribed into a shape formed by covers 721 (e.g., a hexagon, when six straight covers 721A-721F are used, as shown by a hexagonal uncovered opening 771 in FIG. 7B). Please note that depending on the number of covers 721, other shapes of uncovered openings 771 may be formed (e.g., octagonal uncovered openings, and the like). Further, covers with curved edges may have uncovered openings 771 which may closely resemble circular openings.

Figure 7D:
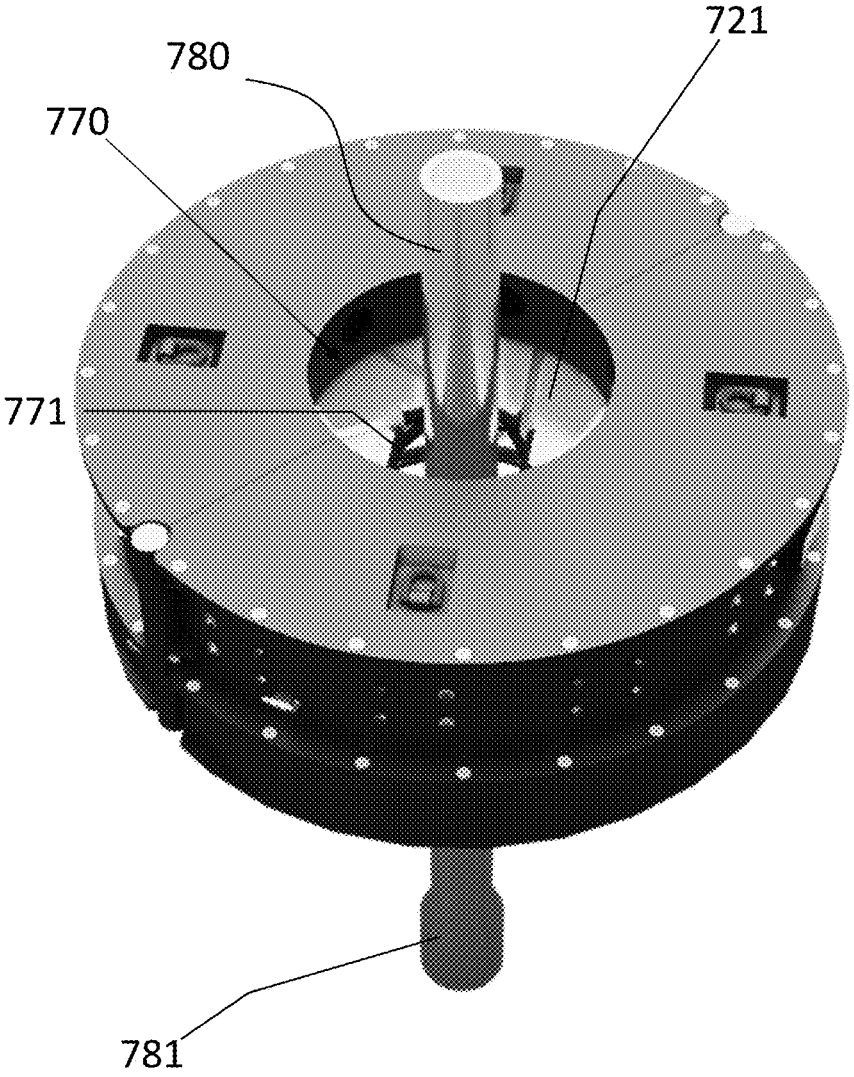
FIG. 7D is a view of an object falling prevention system with a tubular located in an uncovered opening of a central opening according to an embodiment.

FIG. 7D shows a tubular 780 being placed in an uncovered opening 771, while covers 721 are covering the central opening around the tubular 780. The tubular 780 may include joint(s) 781 which have a larger diameter than the other parts of the tubular 780. When the joint(s) 781 pass through the central opening, the covers 721 are configured to move to create a larger uncovered opening 771 in order for the joint(s) 781 to pass through the uncovered opening 771.

Figure 8A:
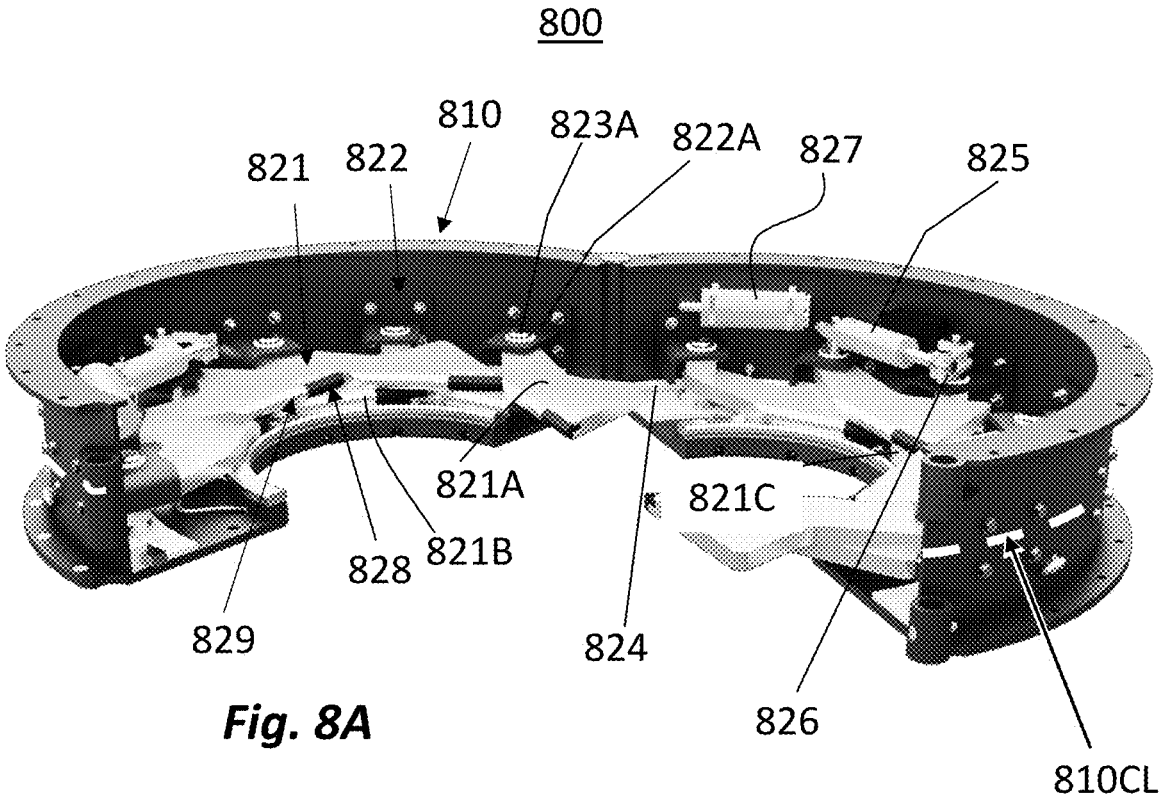
FIG. 8A shows covers and cover components located within a housing of an object falling prevention system according to an embodiment.

FIGS. 8A-8H show various views of an object falling prevention system 800. The object falling prevention system 800 includes a housing 810 that contains a plurality of covers 821. The housing 810 may be the same as or similar to, in form or in function, other housings discussed herein (e.g., housings 110-710). FIG. 8A shows that the plurality of covers 821 may be arranged on a first layer and a second layer. For example, a cover 821A is located above a cover 821B. Thus, the cover 821A is located on the first layer, while the cover 821B is located on the second layer. The first and the second layers are part of a single cross-sectional level indicated by a dashed line 810CL associated with the housing 810 of system 800. It should be noted that such multi-layer arrangement is only one possible example of the arrangement of covers 821. In other implementations, covers 821 may be arranged on the same layer, or may be arranged on more than two layers. In various cases, however, the plurality of layers may be within a single cross-sectional level, such as cross-sectional level 810CL. The covers 821 are connected to the housing 810 via supporting members 822. For example, the cover 821A is connected to the housing 810 via a supporting member 822A. The supporting member 822A is configured to be attached to a wall of the housing 810, and the cover 821A is further coupled to a cylindrical member 823A configured to rotate around its central axis. A rotation of the cylindrical member 823A facilitates movements (e.g., extension or retraction) of the cover 821A.

Further, the housing 810 houses an accumulator 827 and a hydraulic or pneumatic (hydraulic/pneumatic) cylinder 825 configured to actuate the rotation of a drive shaft 826 coupled to a drive plate 824. The drive plate 824 is configured to be coupled to various cylindrical members coupled to covers 821, and movement of the drive plate 824 actuates the movements of these cylindrical members (e.g., a cylindrical member 823A) coupled to covers 821. Using the drive shaft 826 and the drive plate 824 is one possible implementation of an actuator for the covers 821. Alternatively, in some implementations, each one of the covers 821 may be separately actuated (e.g., extended or retracted) via an actuator associated with each one of the covers 821. For example, when a plurality of actuators are used for moving (e.g., extending or retracting) covers 821, each one of the plurality of actuators is configured to extend or retract a corresponding cover of the covers 821.

Figure 8B:
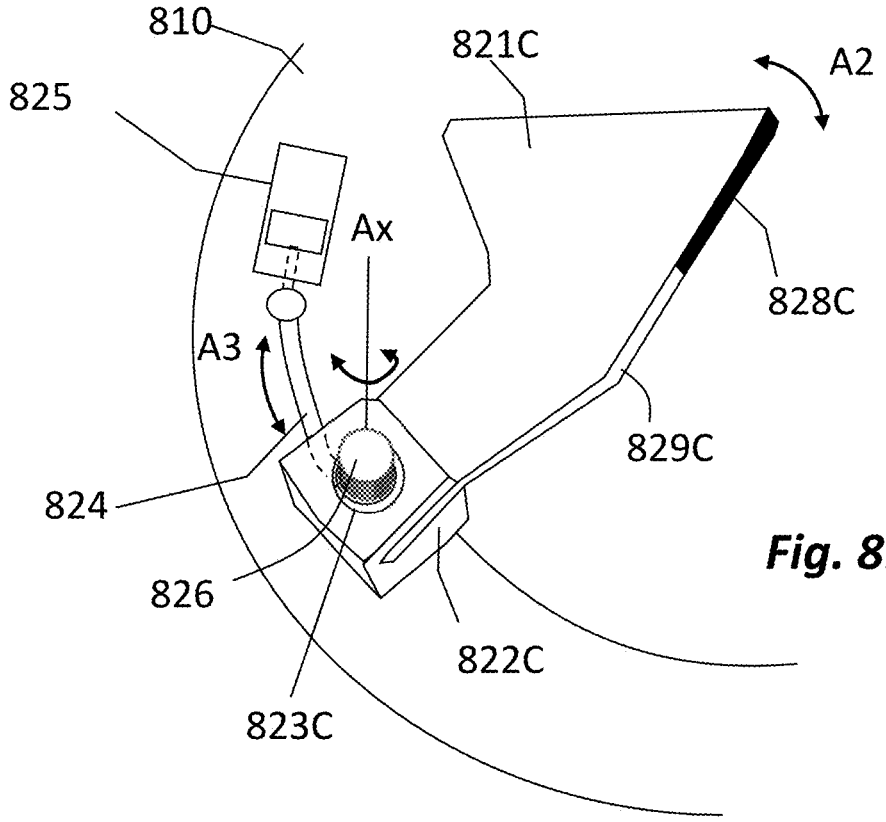
FIG. 8B is a view of a cover and associated cover components of an object falling prevention system according to an embodiment.

FIG. 8B is an example of a cover 821C from the plurality of covers 821. The cover 821 is coupled to a supporting member 822C via a cylindrical member 823C. The rotation of the cylindrical member 823C about an axis Ax results in rotation of the cover 821C, as shown by arrow A2. The rotation of the cylindrical member 823C can be facilitated via any suitable actuators (e.g., electrical motors, hydraulic cylinders or pneumatic cylinders coupled to the cylindrical member 823C via any suitable means, such as gears, crankshafts, and the like). For example, as shown in FIG. 8B, the hydraulic/pneumatic cylinder 825 may be used to rotate the cylindrical member 823C, via the driver shaft 826 coupled to the hydraulic/pneumatic cylinder 825 via the drive plate 824. The hydraulic/pneumatic cylinder 825 is configured to deliver a torque for moving the cylindrical member 823C. The hydraulic/pneumatic cylinder 825 is configured to be actuated hydraulically or pneumatically, and in case of a failure in hydraulic or pneumatic supply, the hydraulic/pneumatic cylinder 825 is configured to move the covers 821 into an open-cover position.

In various embodiments, one or more actuators are controlled by one or more controllers configured to send signals to the actuators to extend or retract the plurality of covers. Further details of operation of the one or more controllers are described below.

The cover 821C includes a contact edge 828C that is configured to be adjacent to the tubular 780 at the closed-cover position. Further, cover 821C includes a continuation edge 829C following the contact edge 828C. The contact edge 828C may be made from a sufficiently soft and flexible material (e.g., a rubber, a polymer, and the like), such that there is no scratching or any other damage when the contact edge 828C contacts a surface of a tubular. It should be noted that other covers 821 include associated contact edges 828 and continuation edges 829, as indicated in FIG. 8A.

The contact edge 828C may be in a close proximity to a surface of a tubular and in some cases, when the tubular moves laterally, the contact edge 828C may contact the surface of the tubular. A portion of the contact edge 828C forms one of the sides of an uncovered opening (e.g., the portion of the edge 828C may be a side of a polygonal uncovered opening, when straight covers 821 are used). The plurality of portions of such contact edges of the plurality of covers 821 form a perimeter of the uncovered opening. In one embodiment, when a central opening is closed (i.e., the covers 821 are in a closed-cover position), the contact edges 828 are configured to be adjacent to other edges of covers 821. When the central opening is fully open (i.e., the covers 821 are in an open-cover position), the contact edges 828 (and in some cases together with the continuation edges 829) may form the perimeter of the uncovered opening. When the central opening is partially open, portions of the contact edges 828 may form the perimeter of the uncovered opening.

Figure 8C:
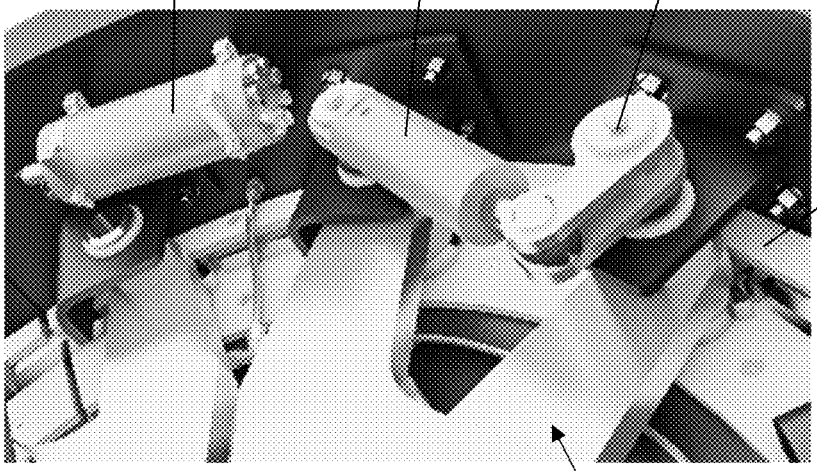
FIG. 8C is another view of cover components of an object falling prevention system according to an embodiment.

Further views of covers 821 and associated components of the object falling prevention system 800 are shown in FIGS. 8C-8H. For example, FIG. 8C shows a further detailed view of the accumulator 827, the hydraulic/pneumatic cylinder 825, the driver shaft 826, and the driver plate 824.

Figure 8D:
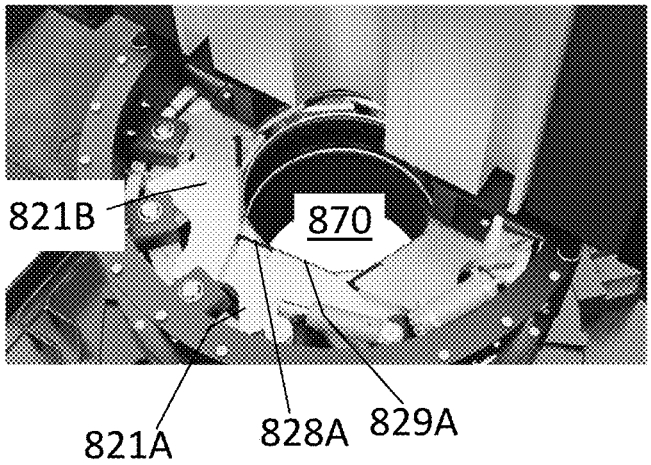
FIG. 8D is a view of an object falling prevention system with covers in an open position according to an embodiment.
Figure 8E:
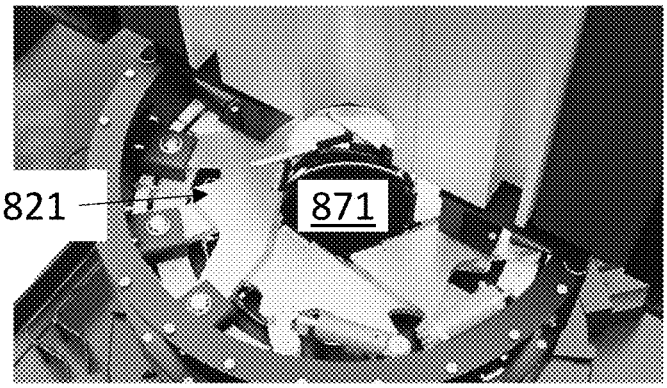
FIG. 8E is a view of an object falling prevention system with covers in a partially open position according to an embodiment.
Figure 8F:
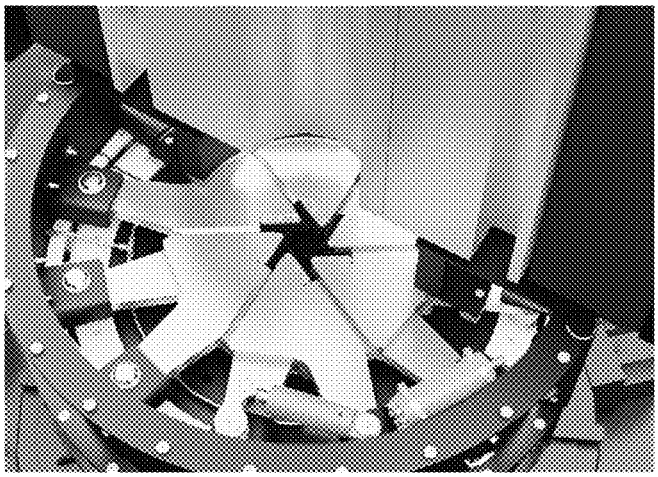
FIG. 8F is a view of an object falling prevention system with covers in a closed position according to an embodiment.
Figure 8G:
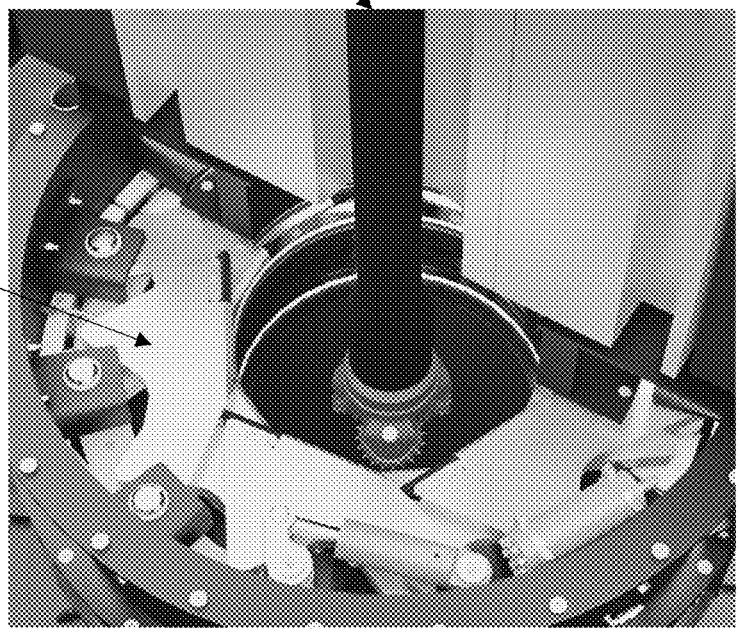
FIG. 8G is a view of an object falling prevention system with covers in an open position and a tubular being inserted into a central opening according to an embodiment.
Figure 8H:
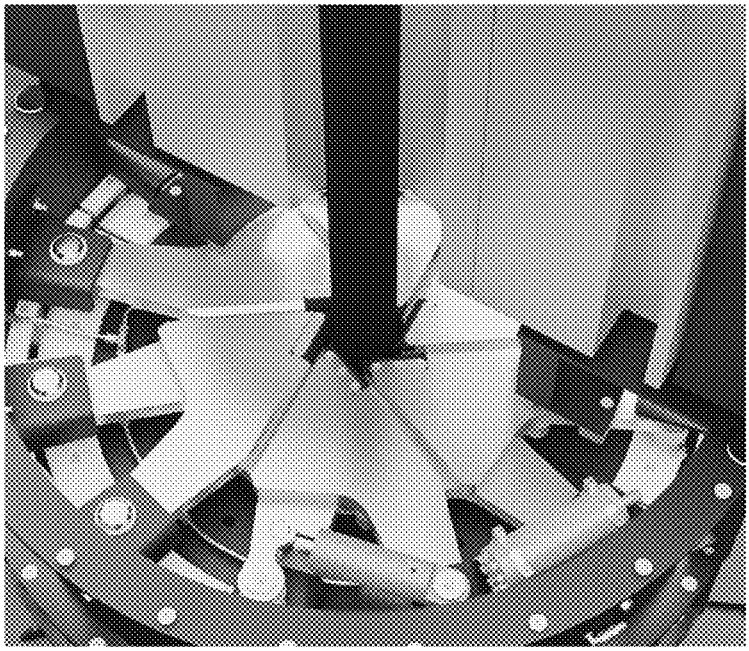
FIG. 8H is a view of an object falling prevention system with covers in a closed position around a tubular according to an embodiment.

FIG. 8D shows a central opening 870 fully opened. Covers 821A and 821B are in an open-cover position. As described above, in the open-cover position, a cover edge 828A and a continuation edge 829A may form a part of the perimeter of the uncovered opening 871, as shown in FIG. 8E. FIG. 8E shows the covers 821 in a partially-closed-cover position, and FIG. 8F shows the covers 821 in an almost closed-cover position (there is a small, uncovered opening seen in FIG. 8F). FIG. 8G shows a tubular 880 inserted into the uncovered opening 871, and FIG. 8H shows covers 821 closing around the tubular 880, thereby preventing objects from falling into a well.

Figure 8I:
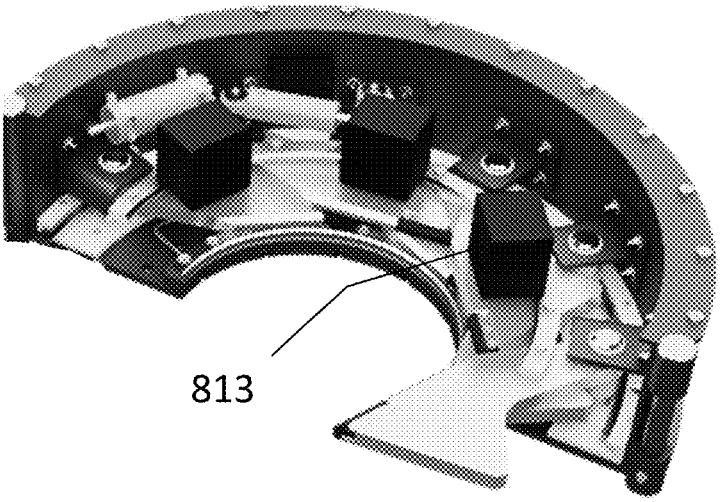
FIG. 8I is a view of radio frequency identifiers (RFIDs) located within a housing of an object falling prevention system according to an embodiment.

FIG. 8I shows that the housing 810 may further include radio frequency identifier (RFID) readers 813 configured to detect RFID tags placed at different locations within the tubular 880. The RFID tags may indicate various characteristics about the tubular 880 (e.g., a diameter of the tubular 880 for a section of the tubular 880 containing the RFID tag, a type of the tubular 880, or any other information about the tubular 880 that may be used by a controller associated with the object falling prevention system 800 to control the movement of the covers 821). In some cases, when multiple RFID tags may be used for the tubular, The RFID readers 813 may be configured to determine the speed at which the tubular 880 is tripping in or tripping out. For instance, if the distance between the RFID tags is known along a length of the tubular 880, the speed may be established by determining how quickly one RFID tag follows another RFID tag as the tubular 880 moves through the uncovered opening 871.

Figure 8J:
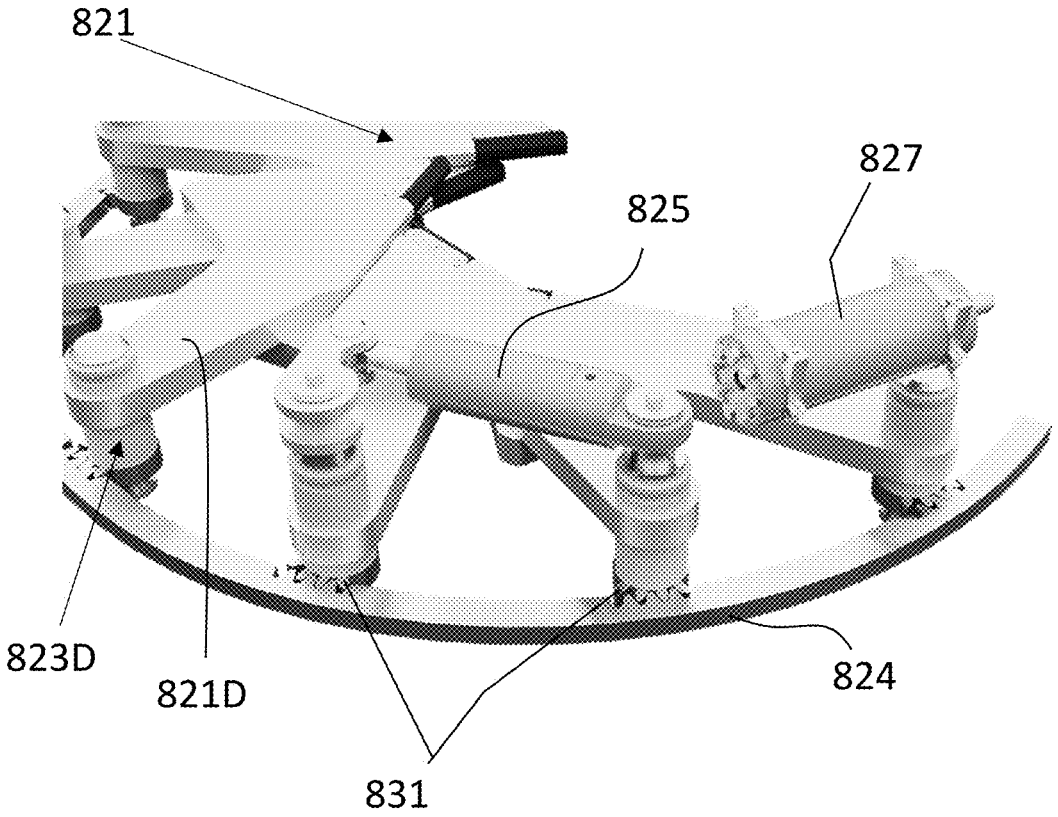
FIG. 8J is a view of a drive plate coupled to covers of the object falling prevention system as shown in FIG. 8A.

FIG. 8J shows further details of the covers 821 coupled to a drive plate 824 via gear elements 831. The motion of the drive plate 824 causes the rotational motion of the covers 821 (e.g., a cover 821D is configured to rotate about a center of a cylindrical element 823D). The motion of the drive plate 824 is actuated by the hydraulic cylinder 825. The accumulator 827 is configured to store hydraulic fluid (or gas under pressure) and facilitate the movement of the covers 821 into an open position during a loss of a hydraulic power and/or an electrical power to the object falling prevention system 800. For example, the accumulator 827 is configured to engage and facilitate the movement of the covers 821 into an open position during a loss of power to the hydraulic cylinder 825. Additionally, the accumulator 827 may be configured to facilitate the movement of the covers 821 (via any suitable mechanism that couples the accumulator 827 with the drive plate 824) into an open position when the hydraulic cylinder 825 fails.

Figure 9:
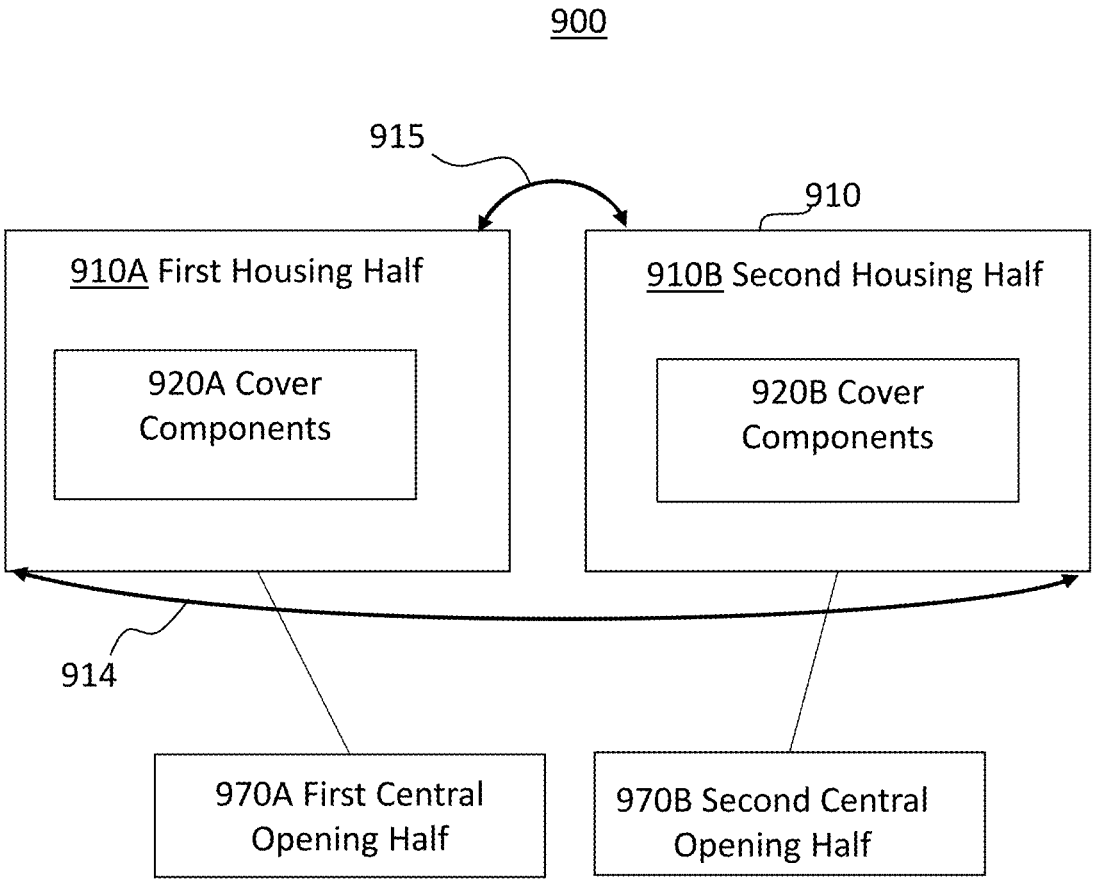
FIG. 9 is an example diagram of an object falling prevention system with a housing having a first housing half and a second housing half according to an embodiment.

In various implementations, a housing of an object falling prevention system may be made from interconnected parts that can be easily be put together or separated. Such design of the housing may facilitate access to the components within the housing for repair, maintenance, or replacement. FIG. 9 is a diagram of an object falling prevention system 900. The object falling prevention system 900 may be similar to other systems discussed herein. The object falling prevention system 900 includes a housing 910 having a first housing half 910A and a second housing half 910B. In some implementations, the first housing half 910A may have a shape of a half of a cylinder and may have an adjacent to a first central opening half 970A. Further, in some cases, the second housing half 910B may also be shaped as a half of a cylinder and may have an adjacent second central opening half 970B. The first housing half 910A may house a cover components 920A and the second housing half 910B may house a cover components 920B.

The first housing half 910A may have a first side S1A facing a corresponding first side S1B of the second housing half 910B. Further the first housing half 910A may have a second side S2A facing a corresponding second side S2B of the second housing half 910B. In one implementation, the first and the second housing halves 910A and 910B may be physically separate housing units but may be configured to be connected by coupling the first side S1A with the corresponding first side S1B using a connection 915, and by coupling the second side S2A with the corresponding second side S2B using a connection 914. Connections 915 and 914 may be any suitable connections for connecting adjacent walls of the first housing half 910A the second housing half 910B (e.g., bolts, clamps, hinges, and the like). In some cases, a pair of sides may be connected via a hinge, such that the first housing half 910A may move relative to the second housing half 910B (e.g., the first housing half 910A and/or the second housing half 910B may be configured to rotate around the axis of the hinge connecting these housing halves).

Figure 10A:
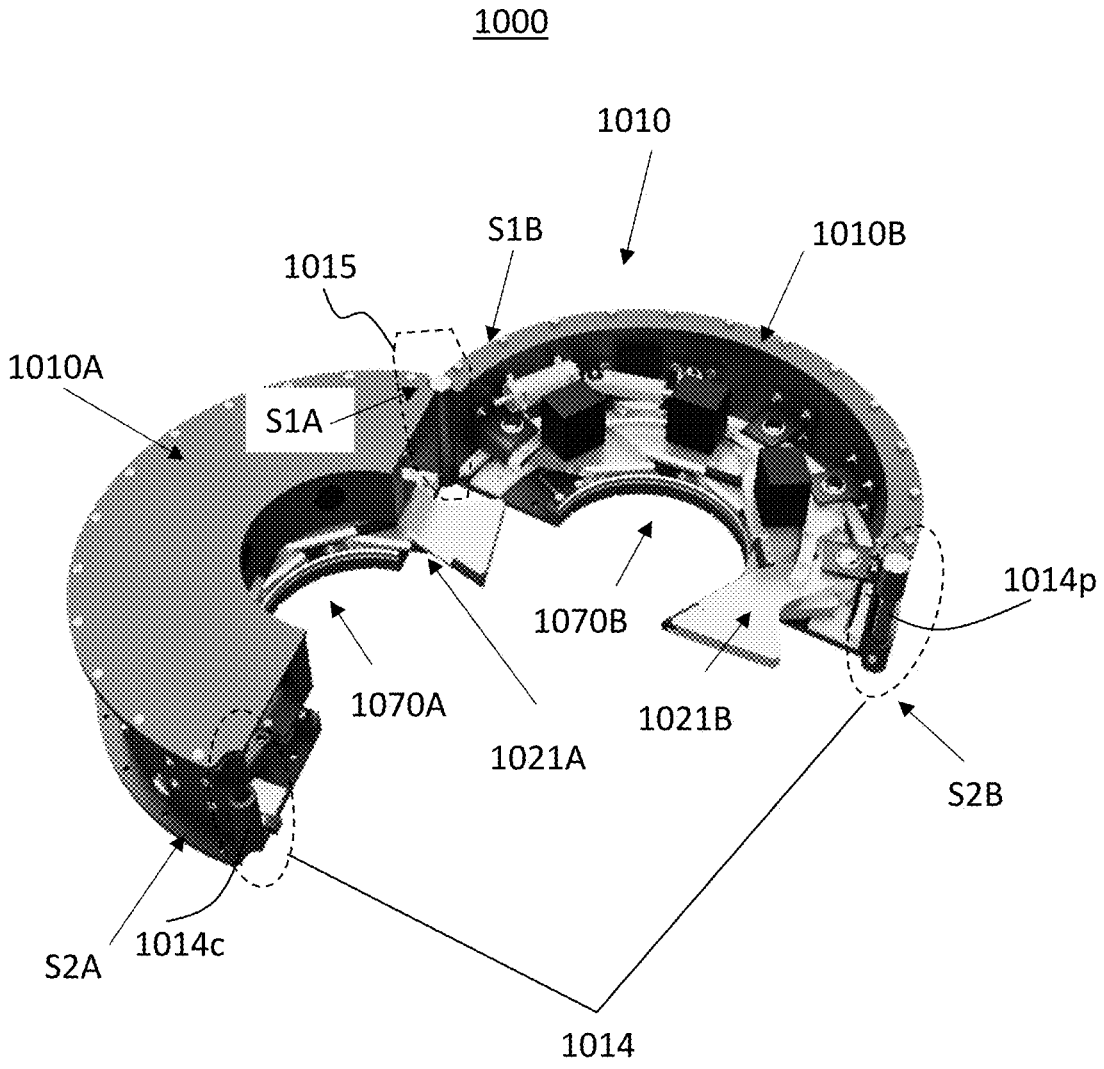
FIGS. 10A and 10B are views of an object falling prevention system with a housing having a first housing half and a second housing half according to an embodiment.
Figure 10B:
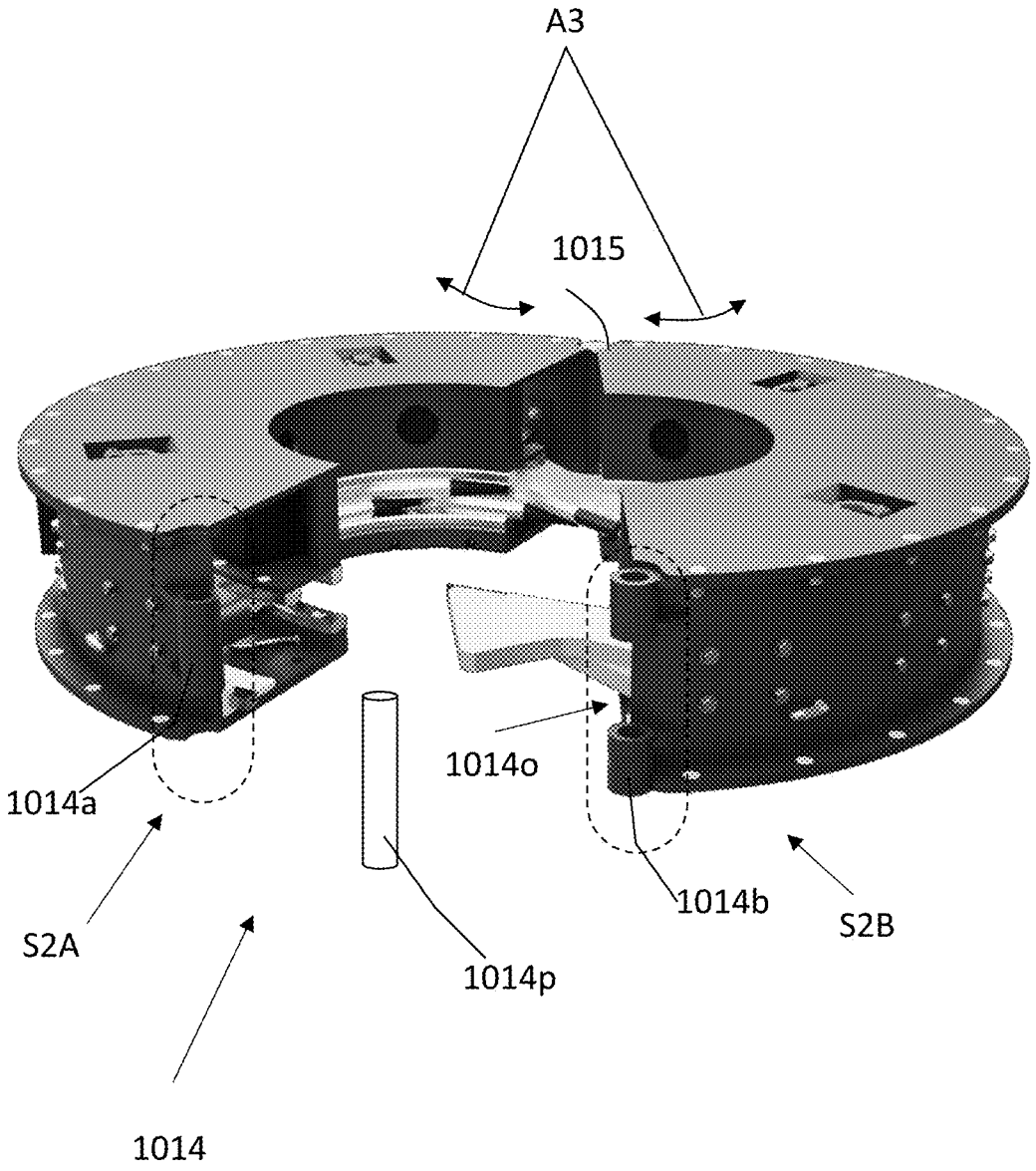

FIGS. 10A and 10B show an example implementation of a housing 1010 of an object falling prevention system 1000 having interconnected parts. The housing 1010 and the object falling prevention system 1000 may be similar respectively to at least some other housings and object falling prevention systems discussed herein. FIG. 10A shows that the housing 1010 includes a first housing half 1010A and a second housing half 101B. The first housing half 1010A includes a first plurality of covers 1021A, and the second housing half 1010B includes a second plurality of covers 1021B. A first side S1A of the first housing half 1010A is configured to connect with a first side S1B of the second housing half 1010B via a hinge element 1015. In one implementation, the first and the second housing halves 1010A and 1010B may be inseparable at a location of the hinge element 1015. Alternatively, the hinge element 1015 may be disassembled (e.g., a pin of the hinge element 1015 may be removed, thereby separating the first and the second housing halves 1010A and 1010B at a location of the hinge element 1015. Further, the second side S2A of the first housing half 1010A is configured to couple with the first side S2B of the second housing half 1010B via a suitable connection element 1014. The connection element 1014 may be any suitable connection for connecting sides S2A and S2B. The connection element 1014 may include one or more bolts, pins, and the like.

When the housing 1010 has a cylindrical shape, it is referred to as a cylindrical housing 1010. Further, the first housing half 1010A of the cylindrical housing 1010 may be referred to as a first cylindrical housing half 1010A, and the second housing half 1010B may be referred to as a second cylindrical housing half 1010B. The first and second cylindrical housing halves 1010A and 1010B are connected by a first connection element (e.g., connection element 1015) at their respective first ends (e.g., sides S1A and S1B). Further, when the first and second cylindrical housing halves 1010A and 1010B are connected by a second connection element (e.g., connection element 1014) at their respective second ends (e.g., sides S2A and S2B), the cylindrical housing 1010 is in a closed configuration. When the first and second cylindrical housing halves 1010A and 1010B are disconnected at their respective second ends, the cylindrical housing 1010 is in an open configuration. As shown in FIG. 10A, the cylindrical housing 1010 is configured to split into the first and the second cylindrical housing halves 1010A and 1010B at least at one of the first or the second end. In various embodiments, at least one of the first connection element 1015 or the second connection element 1014 is a hinge. In some cases, the second connection element 1015 is a hinge having a pin, such that the hinge can be disconnected into a first hinge part associated with the first cylindrical housing half 1010A and a second hinge part 1010B associated with the second cylindrical housing half, when the pin is removed from the hinge.

FIG. 10B shows another view of the housing 1010 having the first housing half 1010A and the second housing half 1010B, where these halves are connected by a hinge element 1015. Further, the connection element 1014 is shown to include a first channel member 1014*a* located on the side S2A, a second channel member 1014*b* located on the side S2B, such that a pin member 1014*p* can be configured to be inserted into a combined channel formed by inserting the channel member 1014*a* within an opening 1014*o* in the channel member 1014*b*. As shown in FIG. 10B, the first and the second housing halves 1010A and 1010B may move relative to each other as shown by arrows A3.

Figure 11:
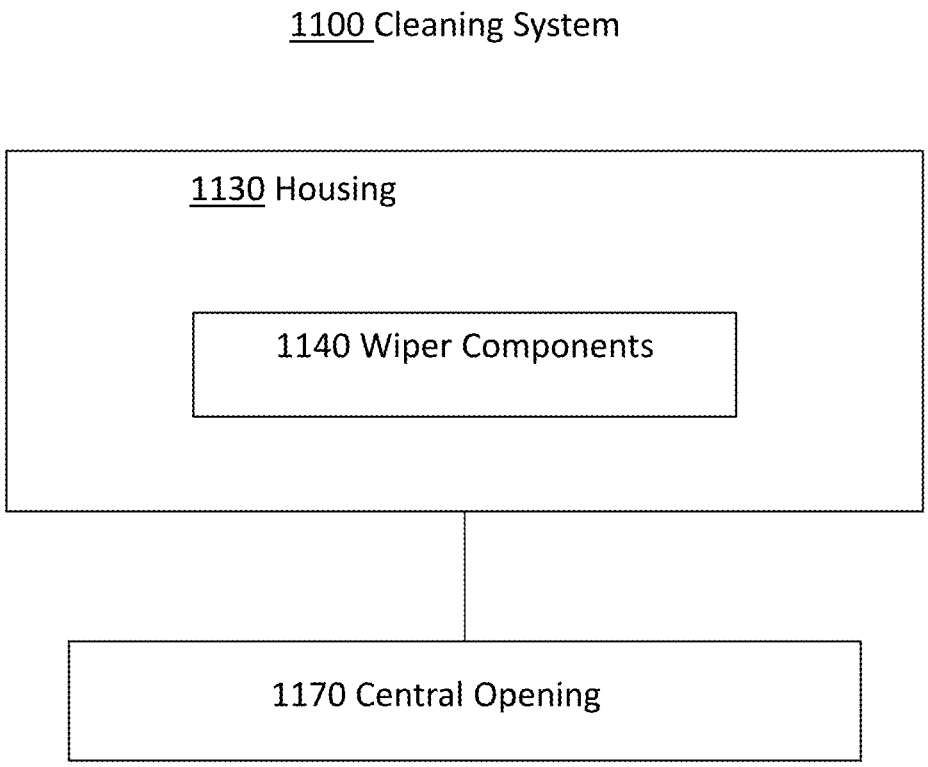
FIG. 11 is an example diagram of a cleaning system according to an embodiment.

Aspects of the present disclosure relate to systems and methods for cleaning the tubular from mud, debris, fluid, metal shavings, and the like when it is tripped out. In one embodiment, as shown in FIG. 11, a cleaning system 1100 includes a housing 1130 containing wiper components 1140. The wiper components 1140 include flexible wipers that are configured to cover at least a portion of a central opening 1170 and move adjacent to a tubular, when it is present within the central opening 1170. Further, the wiper components 1140 include various other components associated with the flexible wipers such as wiper actuators, wiper support members, and the like.

Figure 12A:
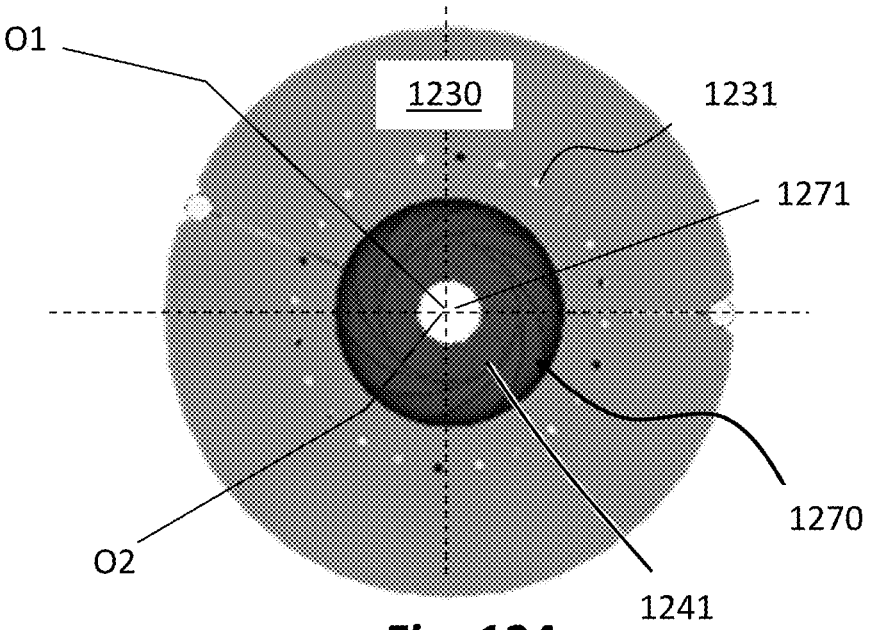
FIGS. 12A and 12B are top views of a cleaning system with flexible wipers in a closed position according to an embodiment.
Figure 12B:
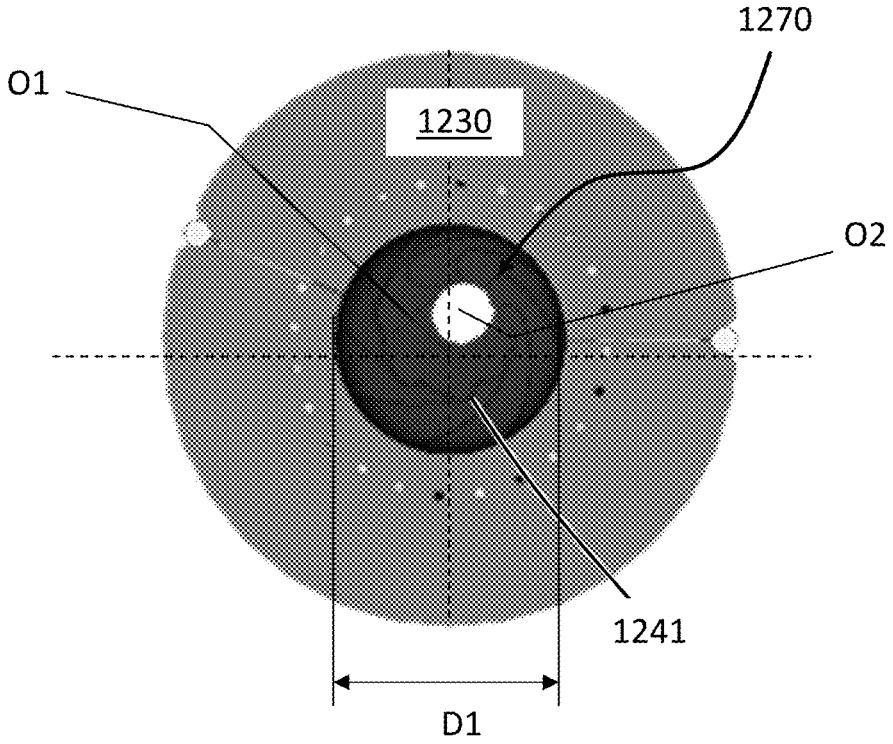
Figure 12C:
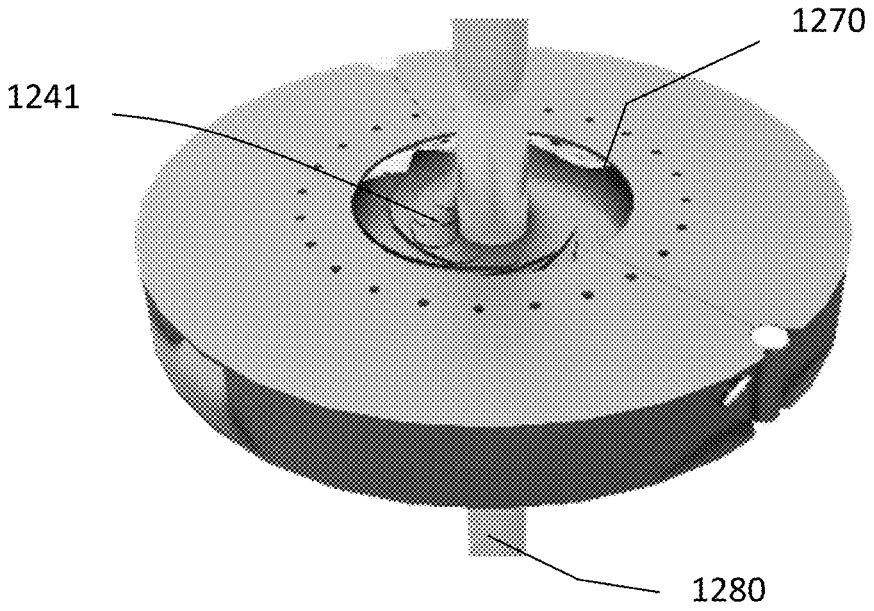
FIG. 12C is an isometric view of a cleaning system with the flexible wipers closed around a tubular according to an embodiment.

FIGS. 12A-12C show a cleaning system 1200 that includes a housing 1230 and the plurality of flexible wipers 1241. In the example embodiment, the housing 1230 may be similar to or the same as, in form or in function, the housing 1130. FIGS. 12A and 12B show a top view of the housing 1230 with flexible wipers 1241 partially covering a central opening 1270. The flexible wipers 1241 are configured to move between an open-wiper position and a closed-wiper position. In the open-wiper position, the entirety or a majority of the central opening 1270 is not covered, and in the closed-wiper position the entirety or a majority of the central opening 1270 is covered. In the open-wiper position, the plurality of flexible wipers 1241 are retracted, thereby unblocking the central opening 1270, and in the closed-wiper position, the plurality of flexible wipers 1241 is extended to close around a tubular (or any other suitable tool located within the central opening 1270).

In some cases, the flexible wipers 1241 are configured to partially cover the central opening 1270, as shown in FIG. 12A-12B. FIG. 12A shows an uncovered region 1271 that is located in a center of the central opening 1270 (e.g., the center of the uncovered region O2 coincides with the center of the central opening O1). FIG. 12B shows that the uncovered region 1271 may also be located off center of the central opening 1270 (e.g., the center of the uncovered region O2 does not coincide with the center of the central opening O1). In one implementation, the center O2 may be located at a distance from O1 that can be as much as a quarter of a diameter D1 of the central opening 1270. FIG. 12A further shows connection elements 1231. Such connection elements (e.g., bolts, treaded channels, and the like) may be used for attaching housing 1230 to another housing. For instance, connection elements 1213 may be used to attach housing 1230 to any of the housings 110-1010 described herein.

FIG. 12C shows the plurality of flexible wipers 1241 contacting a tubular 1280 (or any other tool, cable, wire, and the like) located within the central opening 1270. In the example embodiment, the flexible wipers 1241 are configured to wipe mud (or debris, fluid, and the like) off the tubular 1280 when the plurality of flexible wipers are at the closed-wiper position (as shown in FIG. 12C). The plurality of flexible wipers 1241 may include any suitable number of wipers. For instance, the plurality of flexible wipers 1241 includes between 6 and 18 flexible wipers. The flexible wipers 1241 are designed to be flexible (e.g., the flexible wipers 1241 may bend), and may be made from any suitable durable flexible material such as polymer (e.g., rubber, or an elastomer), composite materials containing rubber and polymer, metal sheets coated with rubber or polymer, rubber material or polymer material enforced with elements of a metallic flexible mesh (e.g., the mesh elements may be made from steel, stainless steel, duralumin, titanium, copper, aluminum, shape memory alloy, and the like). Additionally, or alternatively, the rubber material or the polymer material may include metallic clusters, metallic fibers, glass fibers, carbon fibers, ceramic particles, or any other elements that increase the strength (and/or durability) of the flexible wipers 1241. In some cases, the flexible wipers 1241 are configured to encircle a tubular (e.g., the tubular 1280, as shown in FIG. 12C) and allow at least some lateral movement of the tubular 1280, and/or bend when the tubular moves through the central opening. Further, when in the closed-wiper position, the flexible wipers 1241 are configured to close around the tubular. When the tubular is tripping out, the flexible wipers 1241 wipe mud (or debris, fluid, and the like) off the tubular.

Figure 13:
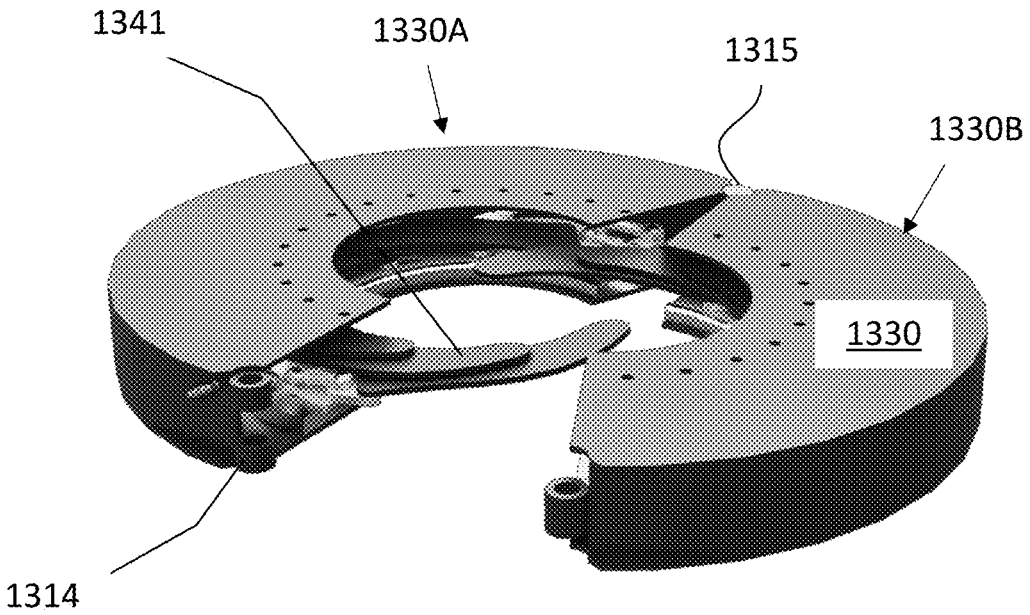
FIG. 13 is a view of a cleaning system with a housing having a first housing half and a second housing half according to an embodiment.

FIG. 13 shows an embodiment of the housing 1330 including flexible wipers 1341. The housing 1330 may be similar to housings 1130-1230 described herein. The housing 1330 may include a first housing half 1330A and a second housing half 1330B connected by elements 1315 and 1314. In one implementation, the element 1315 may be a hinge, and the element 1314 may be any suitable connection element (e.g., bolts, clamps, pins, and the like). In one implementation, the connections 1315 and 1314 may be in form or in function similar to or the same as respective connections 1015 and 1014.

Figure 14A:
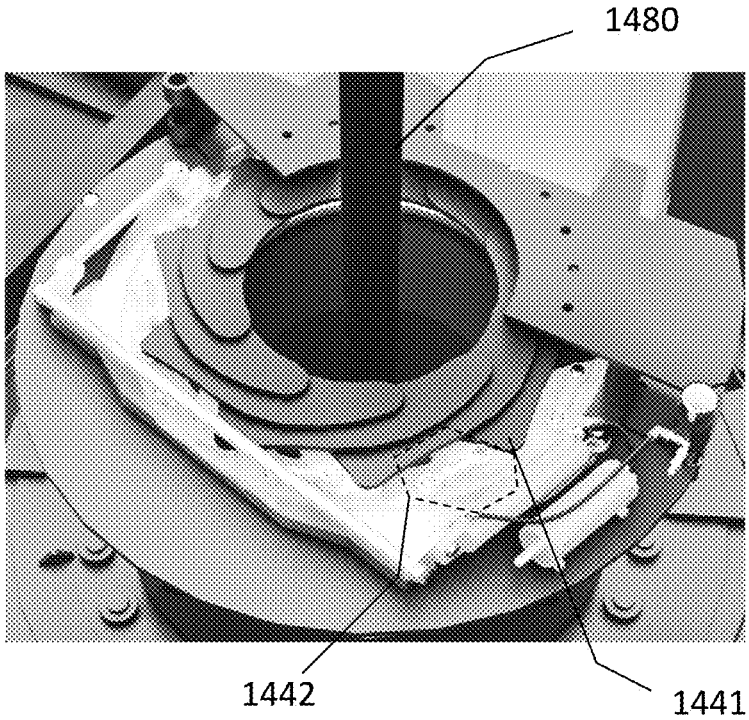
FIG. 14A is a view of a cleaning system with flexible wipers in an open position according to an embodiment.
Figure 14B:
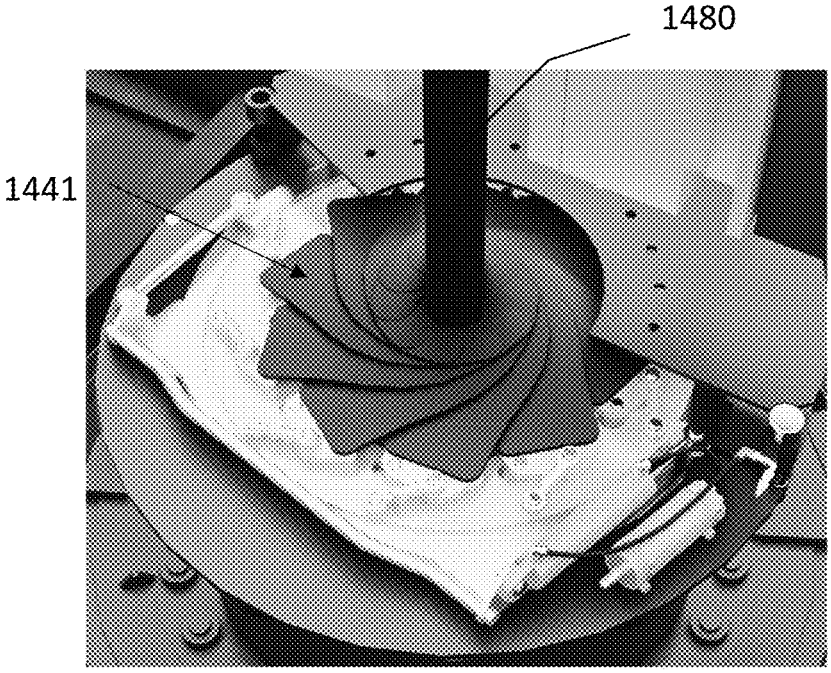
FIG. 14B is a view of a cleaning system with flexible wipers in a closed position around a tubular according to an embodiment.

FIGS. 14A-14E show a cleaning system 1400 containing a housing 1430 and flexible wipers 1441. System 1400 may be similar to systems 1100-1300 as described herein. FIG. 14A shows internal components of the housing 1430. The housing 1430 includes the flexible wipers 1441 coupled to supporting member 1442. The supporting members 1442 include components (further discussed below) that allow movement of the flexible wipers 1441. FIG. 14A shows the flexible wipers 1441 in an open-wiper position around a tubular 1480, while FIG. 14B shows the flexible wipers 1441 in a closed-wiper position.

Figure 14C:
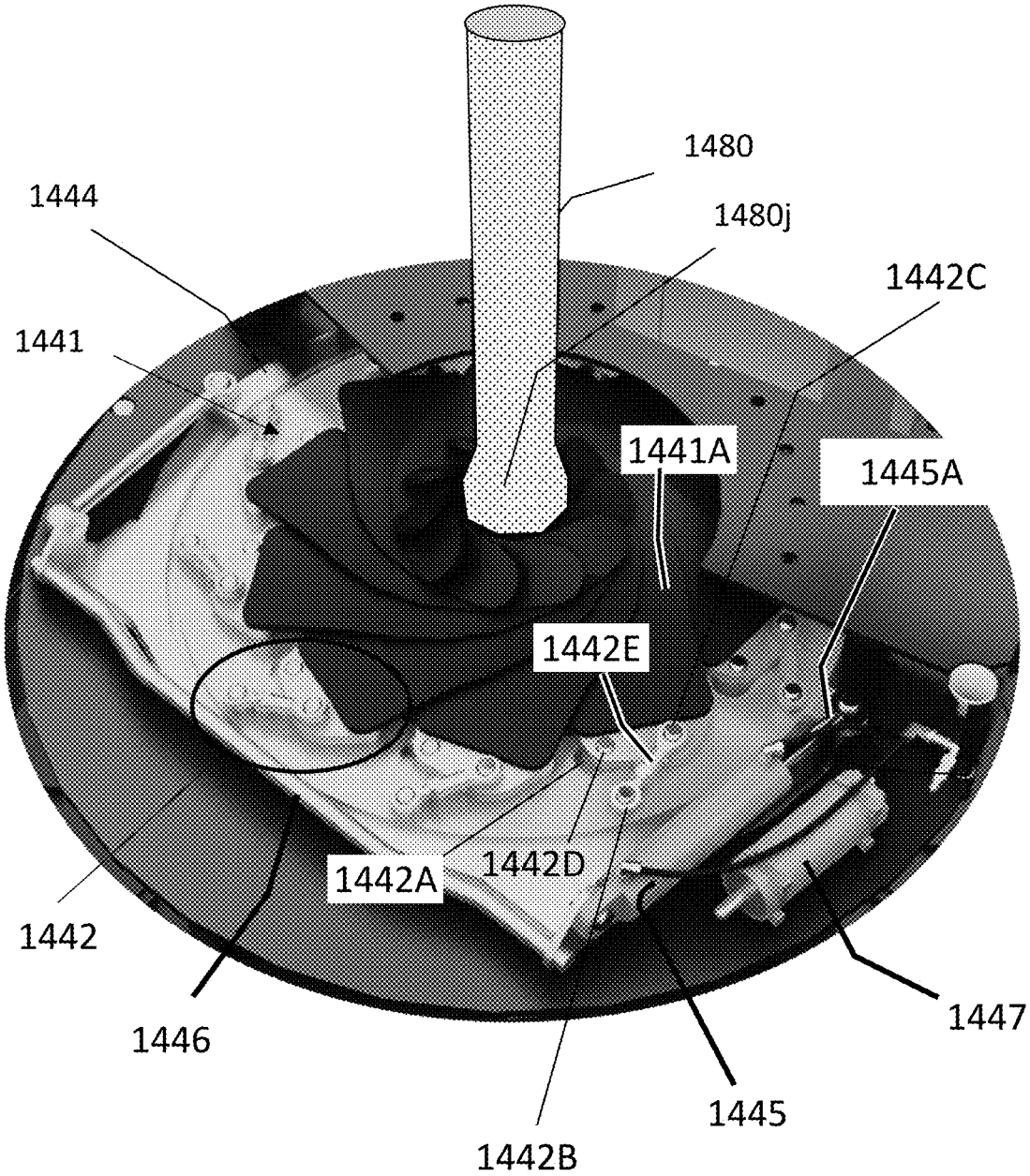
FIG. 14C is a view of a cleaning system with flexible wipers in a closed position around a tubular according to an embodiment.

FIG. 14C shows the flexible wipers 1441 in the closed-wiper position such that the flexible wipers 1441 are in contact with the tubular 1480. The flexible wipers 1441 are bended upwards in a region proximal to the tubular 1480. As shown in FIG. 14C, the tubular 1480 includes a joint 1480*j* proximal to the flexible wipers 1441 with a diameter of the joint 1480*j* larger than a diameter of the tubular 1480 away from the joint 1480*j*. Such increase in the diameter, as the tubular 1480 is tripping out, results in the upward bending of the flexible wipers 1441. When the flexible wipers 1441 are in the closed-wiper position, the flexible wipers 1441 are configured to follow a lateral movement of a tubular; and/or bend when the tubular moves through the central cylindrical opening. In some cases, in the closed-wiper position, the flexible wipers 1441 are configured to close around a tubular.

In various embodiments, the motion of the flexible wipers 1441 is actuated by a wiper actuator configured to extend and retract the plurality of flexible wipers 1441. An example wiper actuator is shown in FIG. 14C and includes a hydraulic or pneumatic (hydraulic/pneumatic) cylinder 1445 coupled to an accumulator 1447. Further, the hydraulic/pneumatic cylinder 1445 is coupled to a drive shaft 1446, which in turn is coupled to the drive plate 1444. The drive plate 1444 is further coupled to each one of the flexible wipers 1441 via supporting members 1442 associated with flexible wipers 1441. An example supporting member 1442 includes components 1442A, 1442B, 1442C, 1442D, and 1442E. The component 1442A is a grove in which an extension element 1442D is configured to travel, the component 1442B is a coupling of a shaft 1442E to the drive plate 1444, and the component 1442C is a coupling of the shaft 1442E to the portion of the flexible wiper 1441A. The shaft 1442E is configured to execute rotational motions about central axes of the components 1442B and 1442C. The drive shaft 1446 is configured to move the drive plate 1444, which in turn actuate the motion of the shaft 1442E. The motion of the shaft 1442E further activates the motion of the flexible wiper 1441A. In addition to using the drive shaft 1446 attached to the drive plate 1444, the hydraulic/pneumatic cylinder 1445 also include a piston 1445A configured to also move the drive plate 1444. The hydraulic/pneumatic cylinder 1445 is configured to be actuated hydraulically or pneumatically, and in case of a failure in hydraulic or pneumatic supply, the hydraulic/pneumatic cylinder 1445 is configured to move the flexible wipers 1441 into an open-wiper position.

Figure 14D:
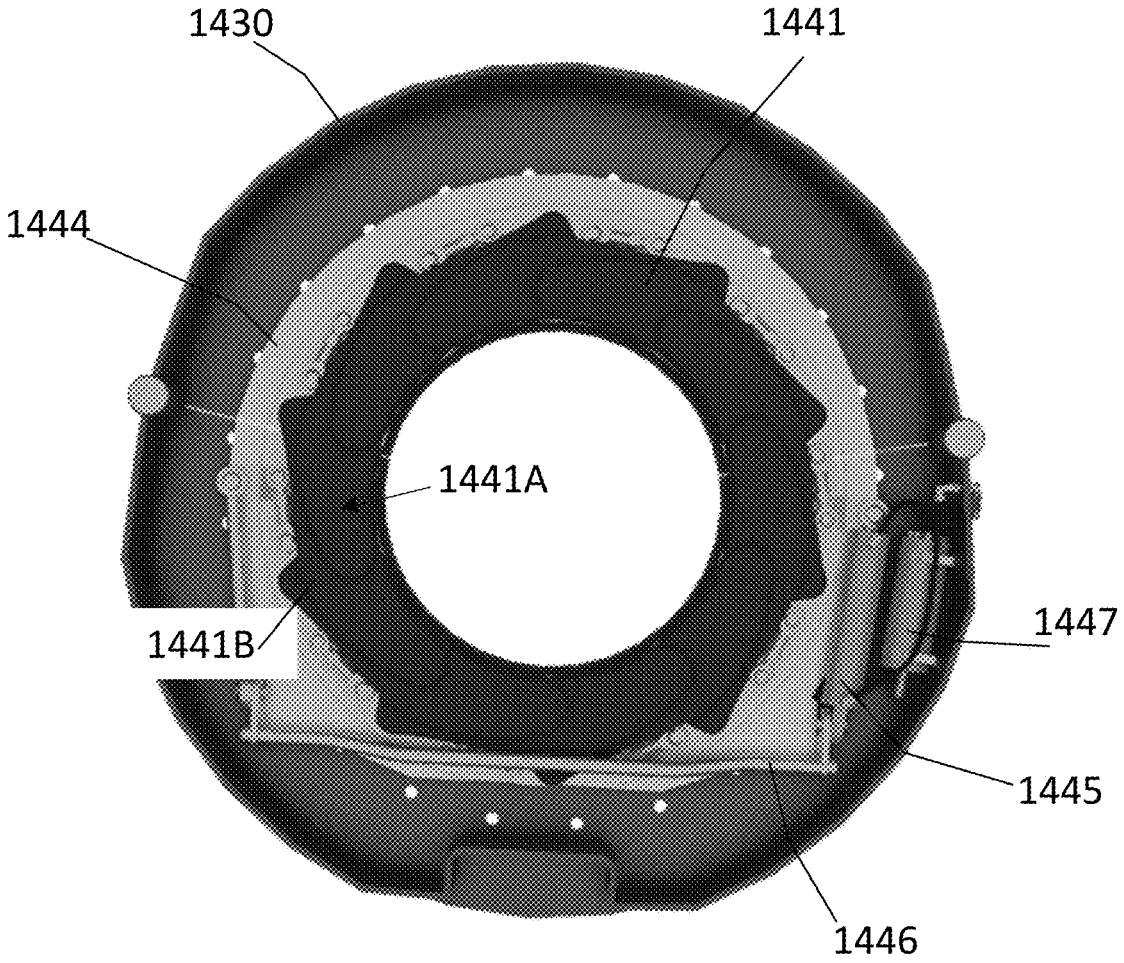
FIG. 14D is a top view of the cleaning system shown in FIG. 14C (with a portion of a housing removed) with flexible wipers in an open position.

FIG. 14D shows the layout of the flexible wipers 1441 from a top view. Only a bottom portion of the housing 1430 is shown. In the example embodiment, there are ten flexible wipers, but, as described above, the number of the flexible wipers may be smaller or larger than ten. The flexible wipers 1441 are configured to at least partially overlap. For example, the flexible wiper 1441A overlaps with the flexible wiper 1441B. Further, FIG. 14D shows an accumulator 1447, a hydraulic/pneumatic cylinder 1445, a drive shaft 1446, and a drive plate 1444.

Figure 14E:
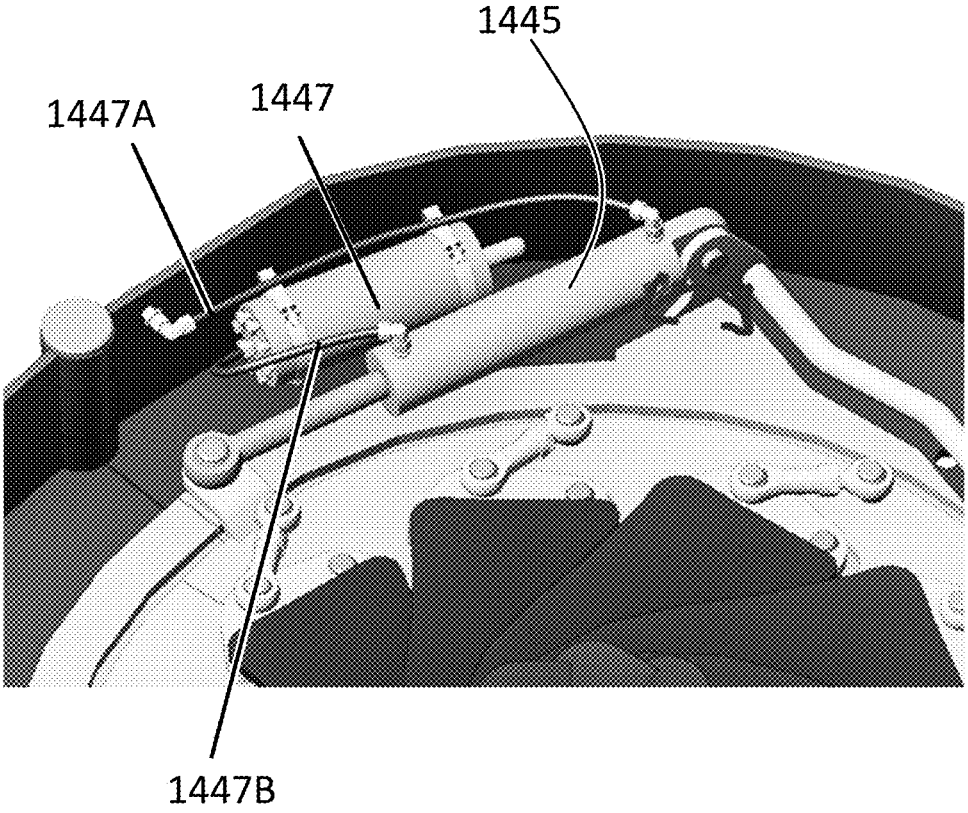
FIG. 14E is a view of the hydraulic cylinder of the cleaning system as shown in FIG. 14C.

FIG. 14E shows a view of the hydraulic (or pneumatic) cylinder 1445 coupled to the accumulator 1447 via hydraulic (or pneumatic) lines 1447A and 1447B. In various embodiments, the accumulator 1447 is configured to store hydraulic fluid (or gas under pressure) and facilitate the movement of the flexible wipers 1441 into an open position during a loss of hydraulic power and/or electrical power to the cleaning system 1400. For example, the accumulator 1447 is configured to engage and facilitate the movement of the flexible wipers 1441 into an open position during a loss of power to the hydraulic cylinder 1445. Additionally, the accumulator 1447 may be configured to facilitate the movement of the flexible wipers 1441 (via any suitable mechanism that couples the accumulator 1447 with the drive plate 1444) into an open position when the hydraulic cylinder 1445 fails.

Figure 14F:
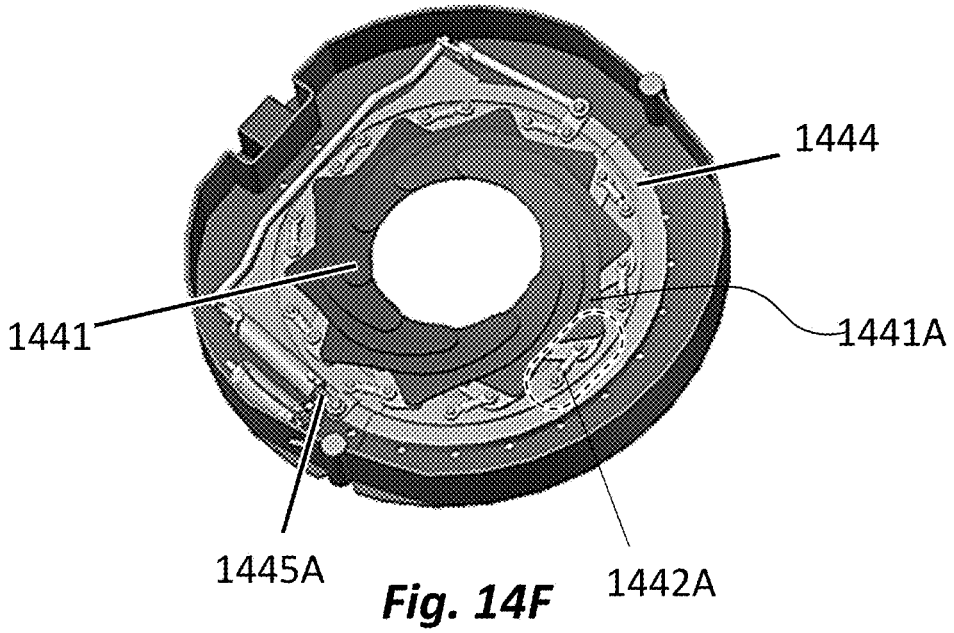
FIG. 14F is a top view of the cleaning system shown in FIG. 14C (with a portion of a housing removed) with flexible wipers in an open position.
Figure 14G:
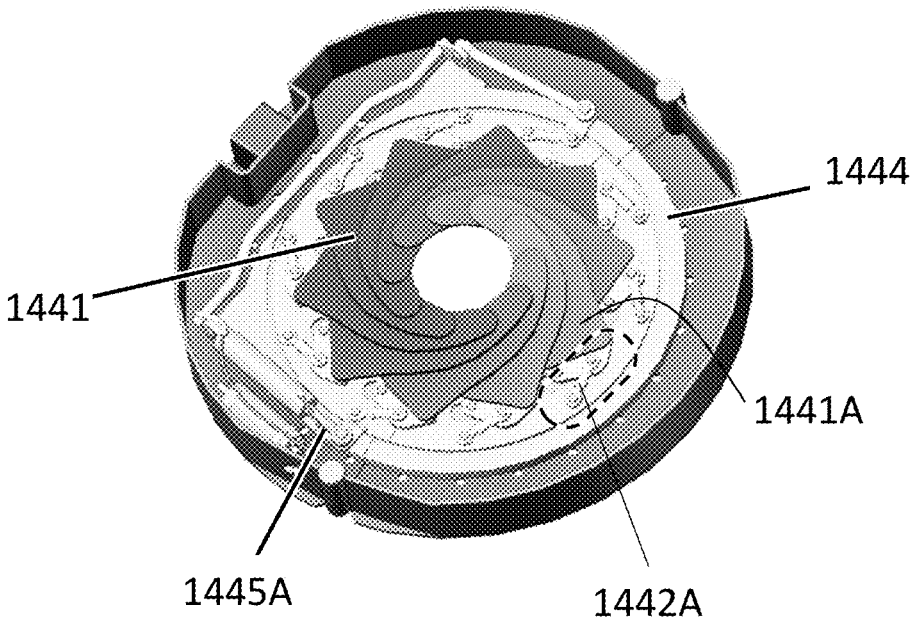
FIG. 14G is a top view of the cleaning system shown in FIG. 14C (with a portion of a housing removed) with flexible wipers in a partially closed position.

FIG. 14F is a top view of the cleaning system shown in FIG. 14C (with a portion of a housing removed) with the flexible wipers 1441 in an open position, while FIG. 14G is a top view of the cleaning system with the flexible wipers 1441 in a partially closed position. In the example configuration shown in FIG. 14F, the piston 1445A is in a substantially stowed configuration, and in the configuration shown in FIG. 14G, the piston 1445A is in an extended configuration, thereby resulting in the motion of the drive plate 1444.

Figure 14H:
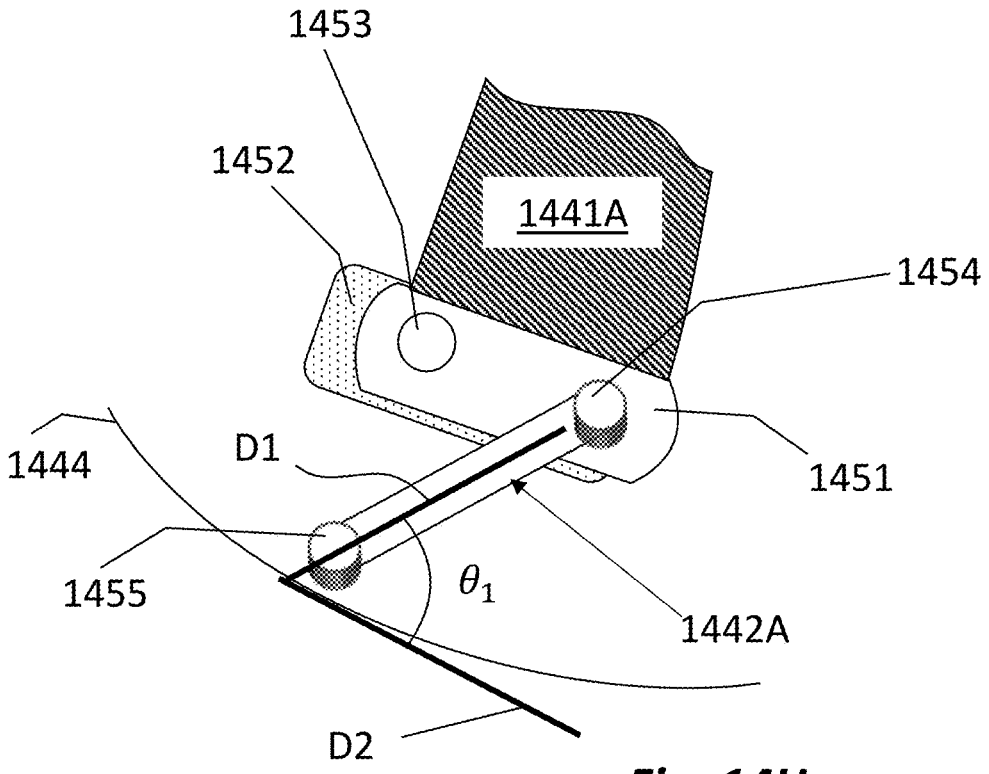
FIGS. 14H and 14I show close-up views of a supporting member configured to move a flexible wiper according to an embodiment.
Figure 14I:
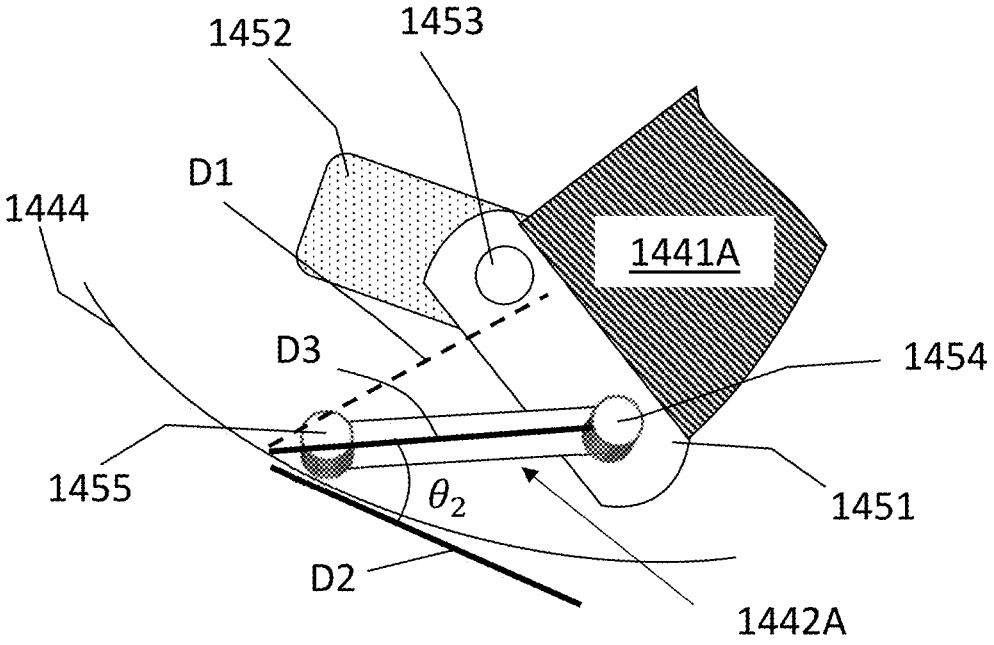

FIG. 14F shows a supporting member 1442A in a first position such that the flexible wiper 1441A is in an open configuration, and FIG. 14G shows the supporting member 1442A in a second position such that the flexible wiper 1441A is in a partially closed configuration. Further details of positions of the supporting member 1442A are shown in FIGS. 14H and 14I. For instance, when the flexible wiper 1441A is in an open configuration, the supporting member 1442A is oriented along a direction D1 which forms an angle $\theta_1$ to the direction D2 (as shown in FIG. 14H). In an example embodiment, the direction D2 is tangential to the drive plane 1444. FIG. 14I shows that when the flexible wiper 1441A is in a closed configuration, the supporting member 1442A is oriented along a direction D3 which forms an angle $\theta_2$ to the direction D2 (as shown in FIG. 14I). In an example implementation, angle $\theta_2$ is smaller than angle $\theta_1$. For example, angle $\theta_2$ may be about 90%, 80%, 70%, 60%, 50%, 40%, 30%, 20%, 10%, 5%, or 1% of angle $\theta_1$. As shown in FIGS. 14H and 14I, the flexible wiper 1441A includes a base element 1451 having a member 1453 configured to couple to a slot 1452 such that the member 1453 moves within the slot 1452 but is configured not to exit the slot 1452. Further, the support member 1442A is coupled to a connection member 1454 at one end and coupled to the drive plane 1444 via a coupling member 1455 at another end.

Figure 15:
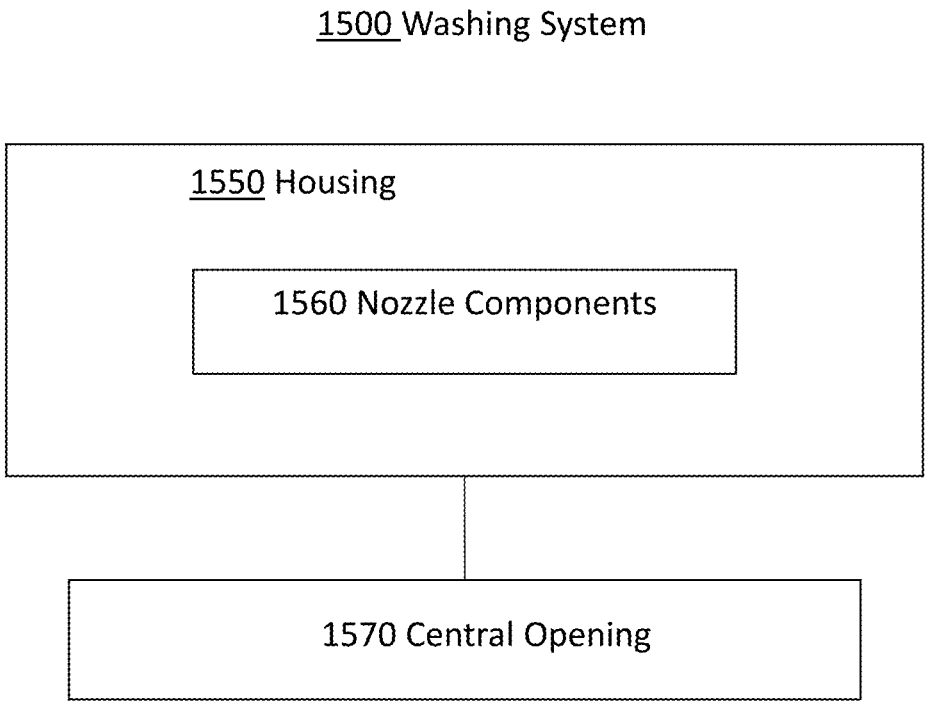
FIG. 15 is an example diagram of a washing system according to an embodiment.

Cleaning tubulars from mud, debris, fluid, metal shavings, and the like may also include washing the tubulars and/or wash flexible wipers. In one embodiment, the rotary multi-tool includes a washing system 1500, as shown in FIG. 15. The washing system 1500 includes a housing 1550 containing a plurality of nozzle components 1560. The nozzle components 1560 include nozzles, a fluid supply for nozzles, and any other components that may facilitate operation of the nozzles (e.g., valves, controllers, and the like). The nozzles are connected to a fluid supply system and are configured to eject a fluid (e.g., a water, air, and the like) to wash any remaining mud, metal shavings, debris, fluids, and the like off the tubular located within a central opening 1570 (or any other tool, wire, cable, and the like located within a central opening 1570), for example, after the flexible wipers described above have removed a significant portion of mud, metal shavings, debris, fluids, and the like from the tubular. In one implementation, the plurality of nozzles 1560 may be arranged around the central opening 1570.

Figure 16A:
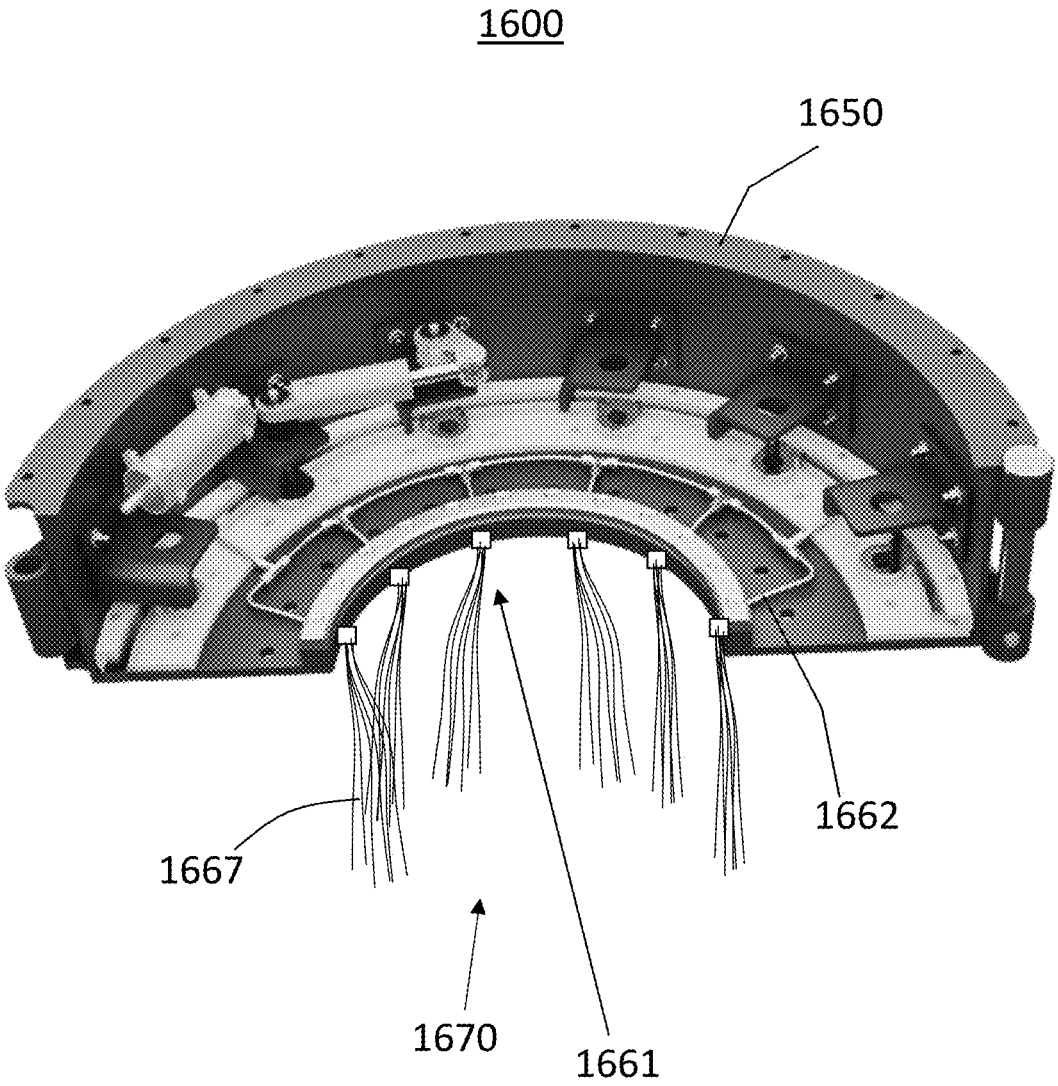
FIG. 16A and FIG. 16B are views of nozzle components of a washing system according to an embodiment.
Figure 16B:
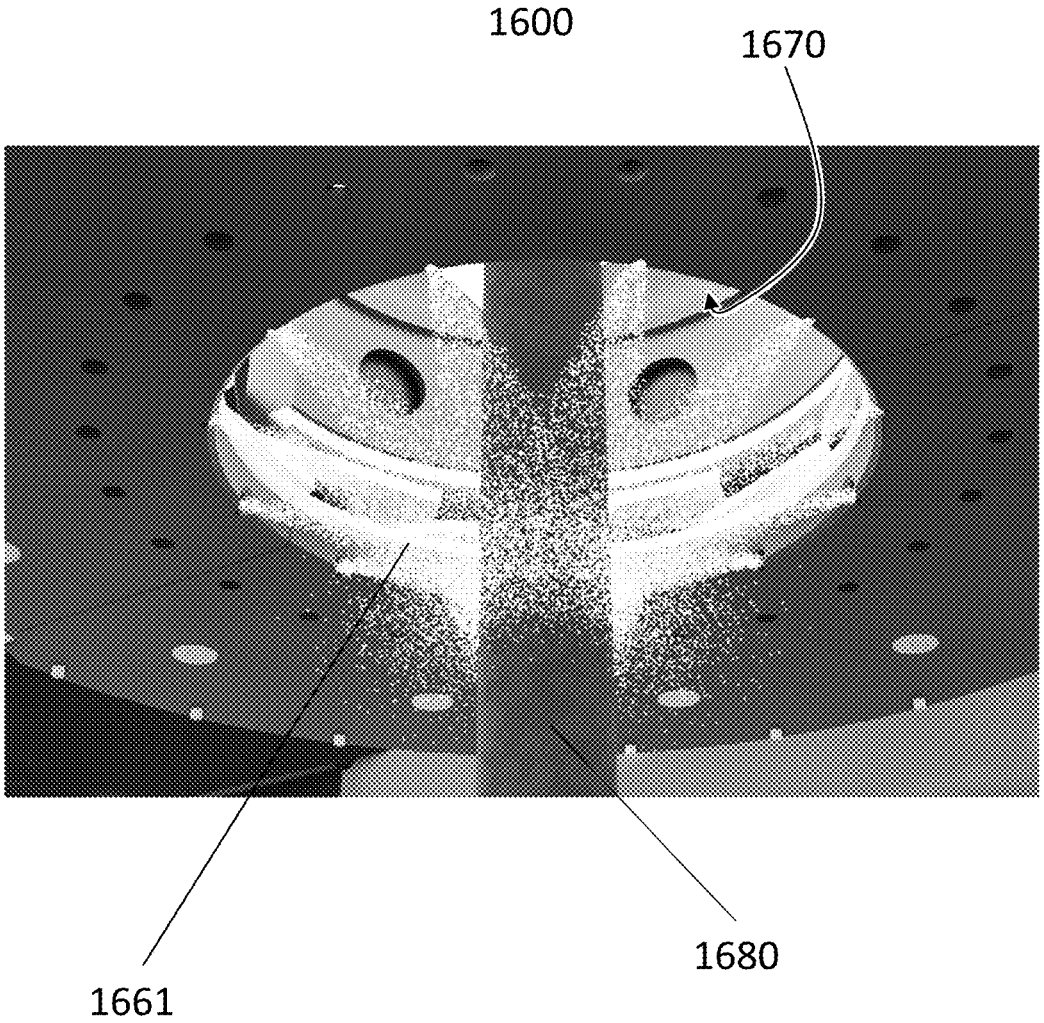

FIG. 16A shows an example embodiment of a washing system 1600 which may be similar to the washing system 1500. The washing system 1600 includes a housing 1650 (only a half of the housing 1650 shown) containing a fluid supply system 1662 (e.g., the fluid supply system may be a network of pipes carrying the fluid), and a plurality of nozzles 1661 configured to eject the fluid jets 1667. The plurality of nozzles 1661 may be positioned and oriented such that the ejected fluid is configured to wash a surface of a tubular, when the tubular is placed at a center of a central opening 1670 (please note that only a half of the central opening 1670 is shown in FIG. 16A, and the entirety of the central opening 1670 is shown in FIG. 16B).

In one implementation, the fluid flow characteristics of the fluid jets 1667 may be controlled (e.g., the velocity of the fluid jets 1667 may be controlled and/or the volume flow rate of the fluid jets 1667 may be controlled via a suitable controller. For instance, the nozzles 1661 may include suitable valves for controlling the fluid flow characteristics of one or more fluid jets 1667). The washing system 1600 may include any suitable number of the nozzles 1661. For instance, the washing system 1600 may include between four to eighteen nozzles. FIG. 16B shows fluid jets 1667 impinging on a tubular 1680, thereby cleaning the tubular 1680. In one configuration, the washing system 1600 may be part of an object falling prevention system. For example, the nozzle components of the washing system 1600 may be located within a housing of the object falling prevention system (or within a first housing half and a second housing half of the object falling prevention system when both of these housing halves are present, as described above). In another configuration, the washing system 1600 may be part of a cleaning system. For example, the nozzle components of the washing system 1600 may be located within a housing of the cleaning system (or within a first housing half and a second housing half of the cleaning system when both of these housing halves are present, as described above). In yet another configuration, there are two washing systems 1600, with the first washing system part of an object falling prevention system, and the second washing system part of a cleaning system.

Figure 17:
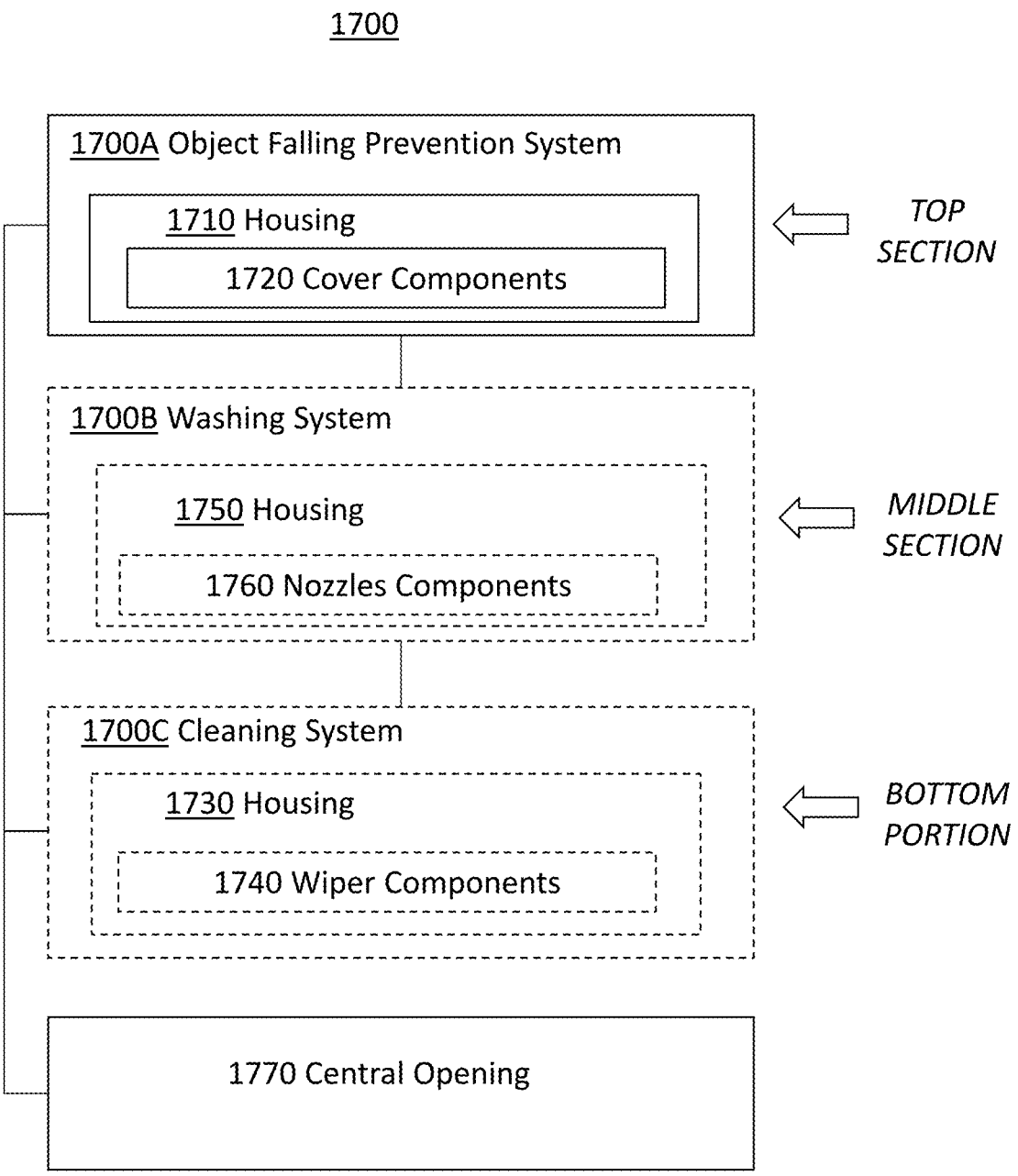
FIG. 17 is an example diagram of a combined system (i.e., a rotary multi-tool) that combines an object falling prevention with at least one of a cleaning system or a washing system according to an embodiment.

A rotary multi-tool may be formed by combining any one of the systems described herein. For example, the rotary multi-tool may be configured to combine an object falling prevention system with a cleaning system and/or a washing system as described above. FIG. 17 shows a combined system 1700 that combines various other systems described herein. The system 1700 includes an object falling prevention system 1700A that, in turn, includes a housing 1710 containing cover components 1720. The housing 1710 may be similar to the housing 110, and the cover components 1720 may be similar to the cover components 120. Further the combined system 1700 optionally includes a washing system 1700B that, in turn, includes housing 1750 containing nozzle components 1760. The housing 1750 may be similar to the housing 1650, and the plurality of nozzles 1760 may be similar to the plurality of nozzles 1661, as described above. Further, the combined system 1700 optionally includes a cleaning system 1700C that, in turn, includes housing 1730 containing wiper components 1740. The housing 1730 may be similar to the housing 1130, and the wiper components 1740 may be similar to the wiper components 1140, as described above.

In one implementation, the object falling prevention system 1700A may be within a top section of the combined system 1700, the cleaning system 1700C may be within a bottom section, and the washing system 1700B may be within a middle section of the combined system 1700 and sandwiched between the object falling prevention system 1700A and the cleaning system 1700C. Further, all the housings 1710, 1730, and 1750 are configured to be adjacent to a central opening 1770, as the combined system 1700 is designed such that the central opening 1770 runs through the middle of the combined system 1700. It should be appreciated that the embodiment of the system 1700 is only one way of combining systems 1700A-1700C. For example, in an alternative implementation, the washing system 1700B may be part of a bottom section of the combined system 1700, and the cleaning system 1700C may be sandwiched between the object falling prevention system 1700A and the washing system 1700B.

Figure 18:
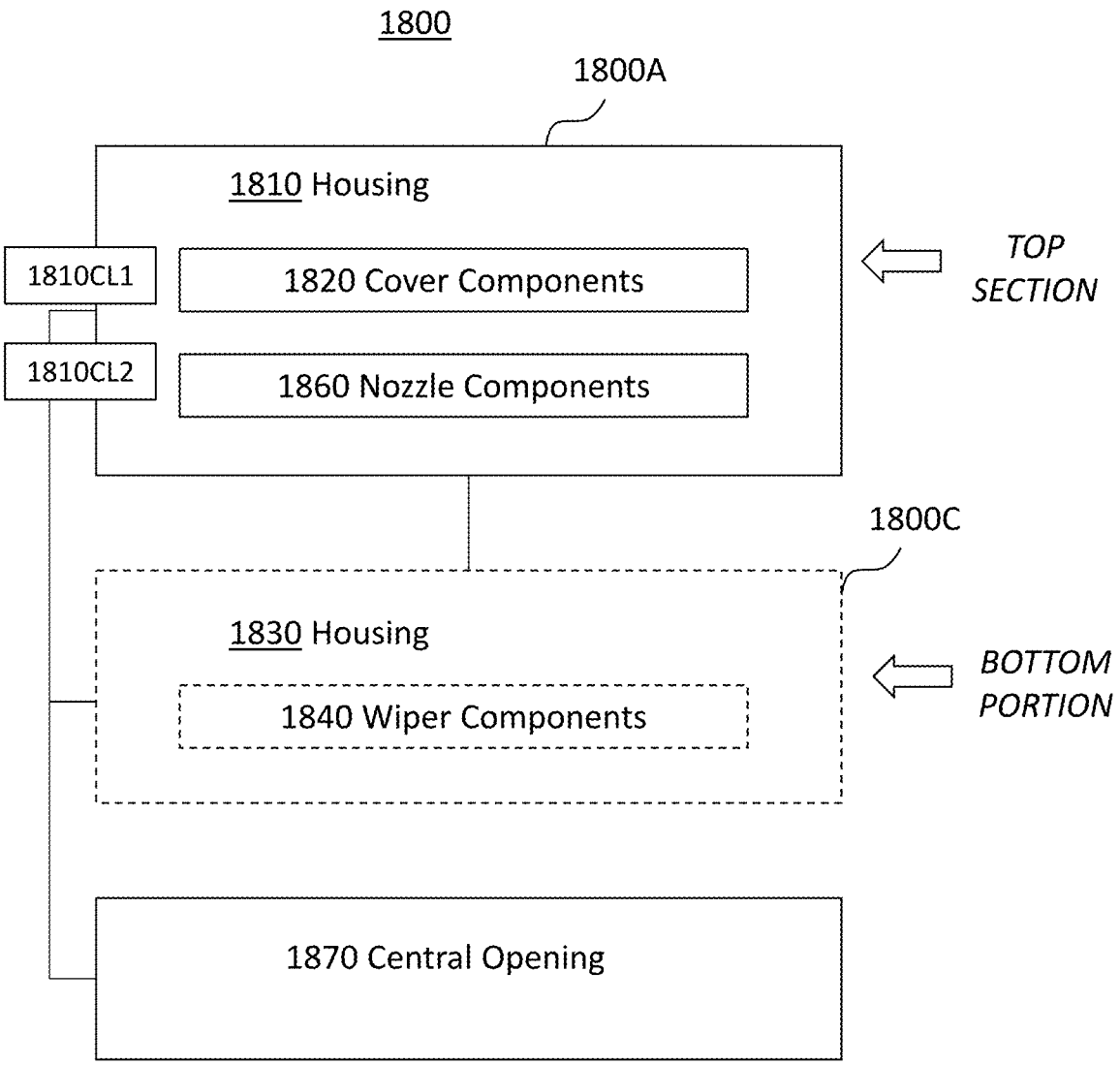
FIG. 18 is an example diagram of a combined system that includes an object falling prevention system and optionally a cleaning system, where the object falling prevention system includes cover components and nozzle components according to an embodiment.

FIG. 18 shows an example of a system 1800. The system 1800 may combine a system 1800A and a cleaning system 1800C. Alternatively, the system 1800 may only include the system 1800A. The cleaning system 1800C may be the same as or similar to the cleaning system 1700C, as shown in FIG. 17. For example, the cleaning system 1800C includes a housing 1830 and wiper components 1840 which may be similar to respective housing 1730 and the wiper components 1740.

The system 1800A may be a combination of an object falling prevention system and a washing system. For instance, system 1800A includes a housing 1810 which houses both cover components 1820 and nozzle components 1860. The cover components 1820 may be the same as or similar to the cover components 120, and the nozzle components 1860 may be the same as or similar to the nozzle components 1560. In one implementation, the system 1800A may be located within a top section of the combined system 1800, while the system 1800C is located within a bottom section of the combined system 1800. In one implementation, at least some of the cover components 1820 may be positioned above at least some of the nozzle components 1860 within the housing 1810. In some cases, the covers of the cover components 1820 are positioned at a first cross-sectional level 1810CL1 of the housing 1810 (e.g., the first cross-sectional level may be similar to the cross-sectional level 810CL, as shown in FIG. 8A) and the nozzles of the nozzle components 1860 are positioned at a second cross-sectional level 1810CL2 that is below the first cross-sectional level 1810CL1. Further, the housings 1810 and 1830 are configured to be adjacent to a central opening 1870, as the combined system 1800 is designed such that the central opening 1870 runs through the middle of the combined system 1800.

Figure 19:
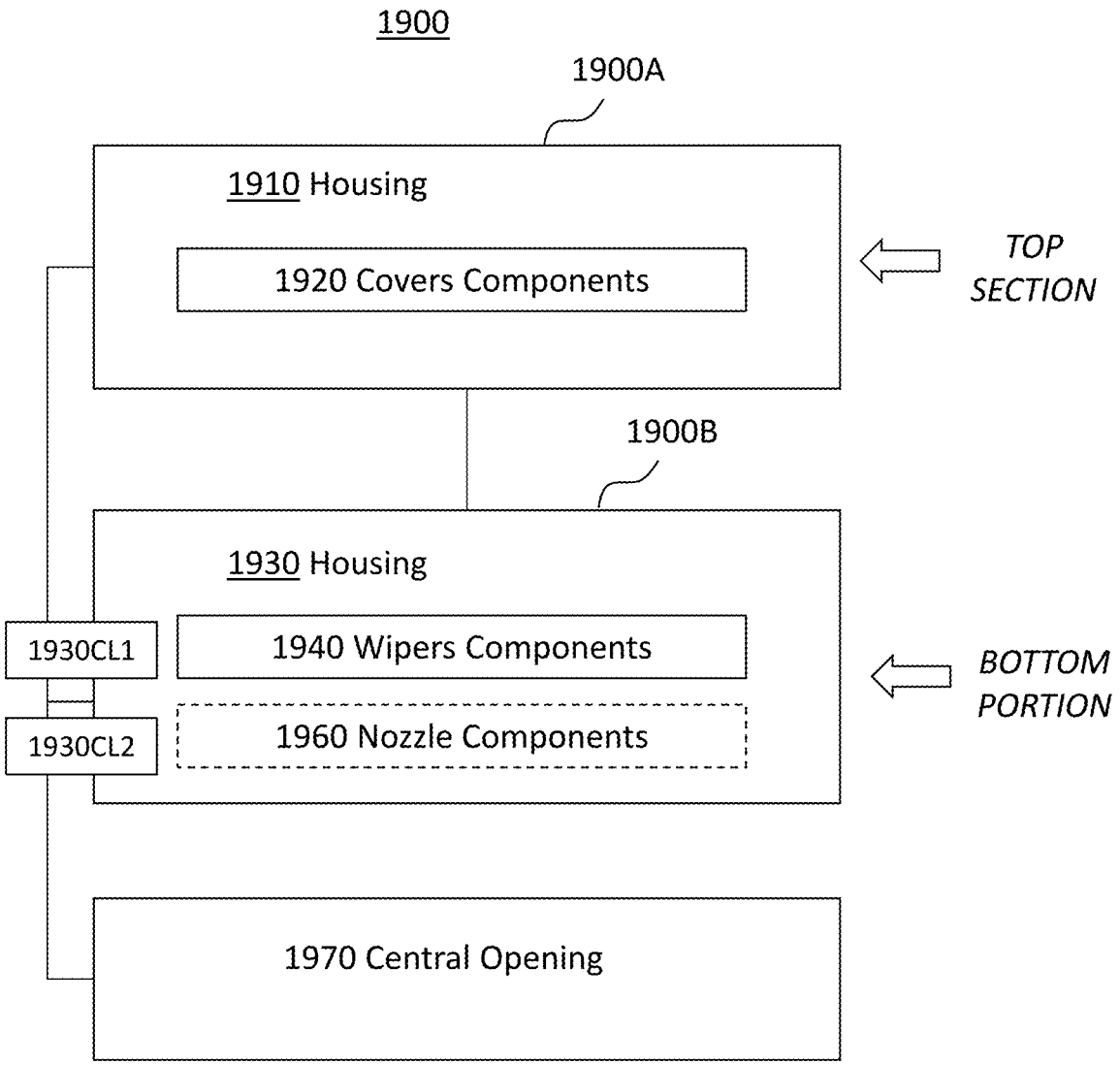
FIG. 19 is an example diagram of a combined system that includes an object falling prevention system and a cleaning system, where the cleaning system includes wiper components and optionally nozzle components according to an embodiment.

FIG. 19 shows an example combined system 1900. The combined system 1900 combines an object falling prevention system 1900A and a system 1900B. The object falling prevention system 1900A may be the same as or similar to the object falling prevention system 1700A, as shown in FIG. 17. For example, the object falling prevention system 1900A includes a housing 1910 and cover components 1920 which may be similar to the respective housing 1710 and the cover components 1720.

The system 1900B may be a combination of the cleaning system and optionally a washing system. For instance, the system 1900B includes a housing 1930 which may house both wiper components 1940 and nozzle components 1960. The wiper components 1940 may be the same as or similar to the wiper components 1140, and the nozzle components 1960 may be the same as or similar to the nozzle components 1560. In one implementation, the system 1900A may be located within a top section of the combined system 1900, while the system 1900B is located within a bottom section of the combined system 1900. In one implementation, at least some of the wiper components 1940 may be positioned below at least some of the nozzle components 1960 within the housing 1930. For example, the nozzles of the nozzle components 1920 may be positioned at a first cross-sectional level 1930CL1 of the housing 1930 and the flexible wipers of the wiper components 1940 are positioned at a second cross-sectional level 1930CL2 that is below the first cross-sectional level 1930CL1. Further, the housings 1910 and 1930 are configured to be adjacent to a central opening 1970, as the combined system 1900 is designed such that the central opening 1970 runs through the middle of the combined system 1900. It should be noted that in some cases, the nozzles may be positioned below the flexible wipers (e.g., the flexible wipers may be positioned at a first cross-sectional level, and the nozzles may be positioned at a second cross-sectional level below the first cross-sectional level).

Figure 20:
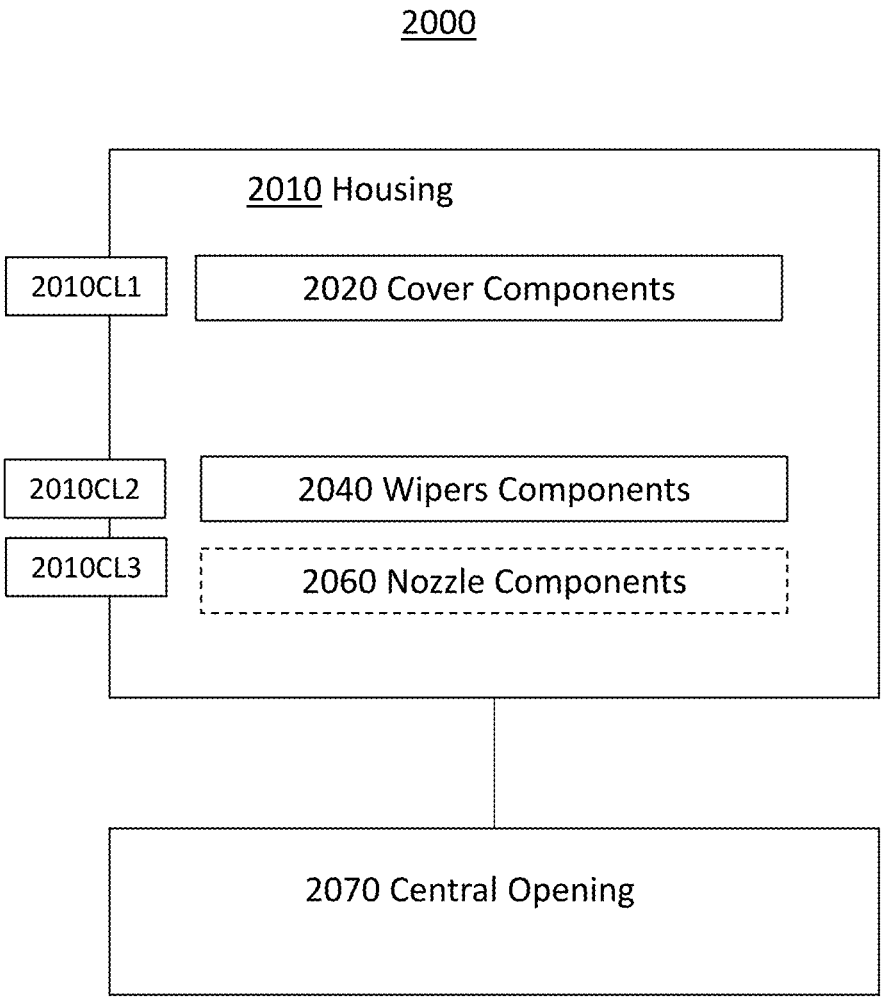
FIG. 20 is an example diagram of a combined system that includes a housing containing cover components, wiper components and optionally nozzle components according to an embodiment.

FIG. 20 shows an example combined system 2000. The combined system 2000 combines elements of an object falling prevention system, a cleaning system, and a washing system. For instance, system 2000 includes a housing 2010 which may house cover components 2020, wiper components 2040, and optionally nozzle components 2060. The cover components 2020 may be the same as or similar to the cover components 120, the wiper components 2040 may be the same as or similar to the wiper components 1140, and the nozzle components 2060 may be the same as or similar to the nozzle components 1560. In one implementation, at least some of the cover components 2020 may be positioned above at least some of the wiper components 2040, and at least some of the nozzle components 2060 may be sandwiched between the at least some of the cover components 2020 and at least some of the wiper components 2040. For example, the covers of the cover components 2020 may be positioned at a first cross-sectional level 2010CL1, the flexible wipers of the wiper components 2040 may be positioned at a second cross-sectional level 2010CL2 that is below the first cross-sectional level 2010CL1, and the nozzles of the nozzle components 2060 may be positioned at a third cross-sectional level 2010CL3 that is below the second cross-sectional level 2010CL2. Alternatively, in some implementations of system 2000, the third cross-sectional level 2010CL2 includes nozzles that may be sandwiched between the first cross-sectional level 2010CL1 and the second cross-sectional level 2010CL2.

Further, the housing 2010 is configured to be adjacent to a central opening 2070, as the combined system 2000 is designed such that the central opening 2070 runs through the middle of the combined system 2000.

Figure 21:
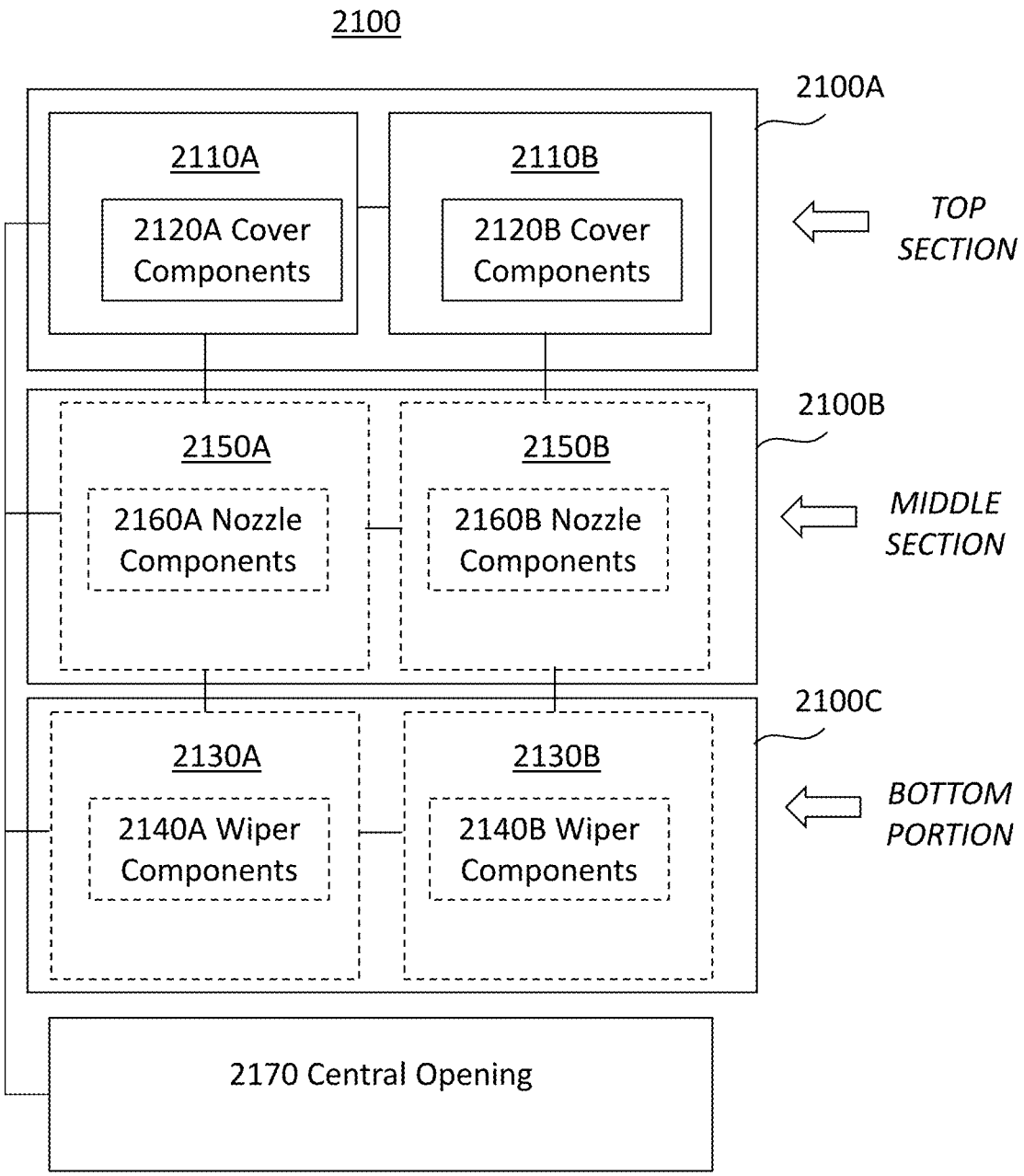
FIG. 21 is an example diagram of an object falling prevention system and optionally at least one of a cleaning system and/or a washing system combined, wherein respective housing for each one of these systems has a first half and a second half according to an embodiment.

FIG. 21 shows a combined system 2100 which may be similar to the system 1700 in that it combines an object falling prevention system 2100A, and optionally at least on a washing system 2100B, and/or a cleaning system 2100C. The object falling prevention system 2100A may be similar in form or in function to the object falling prevention system 900. For example, similar to the object falling prevention system 900, the object falling prevention system 2100A includes a first housing half 2110A, a second housing half 2110B connected to the first housing half 2110A, cover components 2120A located within the first housing half 2110A, and cover components 2120B located within the second housing half 2110B.

The washing system 2100B includes a first housing half 2150A, a second housing half 2150B, nozzle components 2160A located in the first housing half 2150A, and nozzle components 2160B located in the second housing half 2150B. Similar to the housing halves 2110A and 2110B, the housing halves 2150A and 2150B may be connected via suitable connection elements (e.g., hinges, bolts, pins, clamps, and the like). For instance, the first housing half 2150A may be a portion of a housing as shown in FIG. 16A.

The cleaning system 2100C includes a first housing half 2130A and a second housing half 2130B, wiper components 2140A located in the first housing half 2130A, and wiper components 2140B located in the second housing half 2120B. The housing halves 2130A and 2130B may be similar to or the same as housing halves 1330A and 1330B.

As shown in FIG. 21, the object falling prevention system 2100A may be placed within a top section of the combined system 2100, the cleaning system 2100C may be placed within a bottom section of the combined system 2100, and the washing system 2100B may be sandwiched between the object falling prevention system 2100A and the cleaning system 2100C. In various embodiments, when the housing 2110A is connected to the housing 2110B, when the housing 2130A is connected to the housing 2130B, and when the housing 2150A is connected to the housing 2150B, a central opening 2170 is formed adjacent to all of the connected housings. It should be noted that the embodiment of system 2100 is only one way of combining systems 2100A-2100C which include interconnected housings. Alternatively, a first housing half and a second housing half may collectively include all of the components (e.g., cover components, wiper components, and nozzle components) of a rotary multi-tool. The first housing half and the second housing half may be connected using any suitable approaches discussed herein (e.g., via hinges, pins, bolts, clamps, and the like).

Figure 22A:
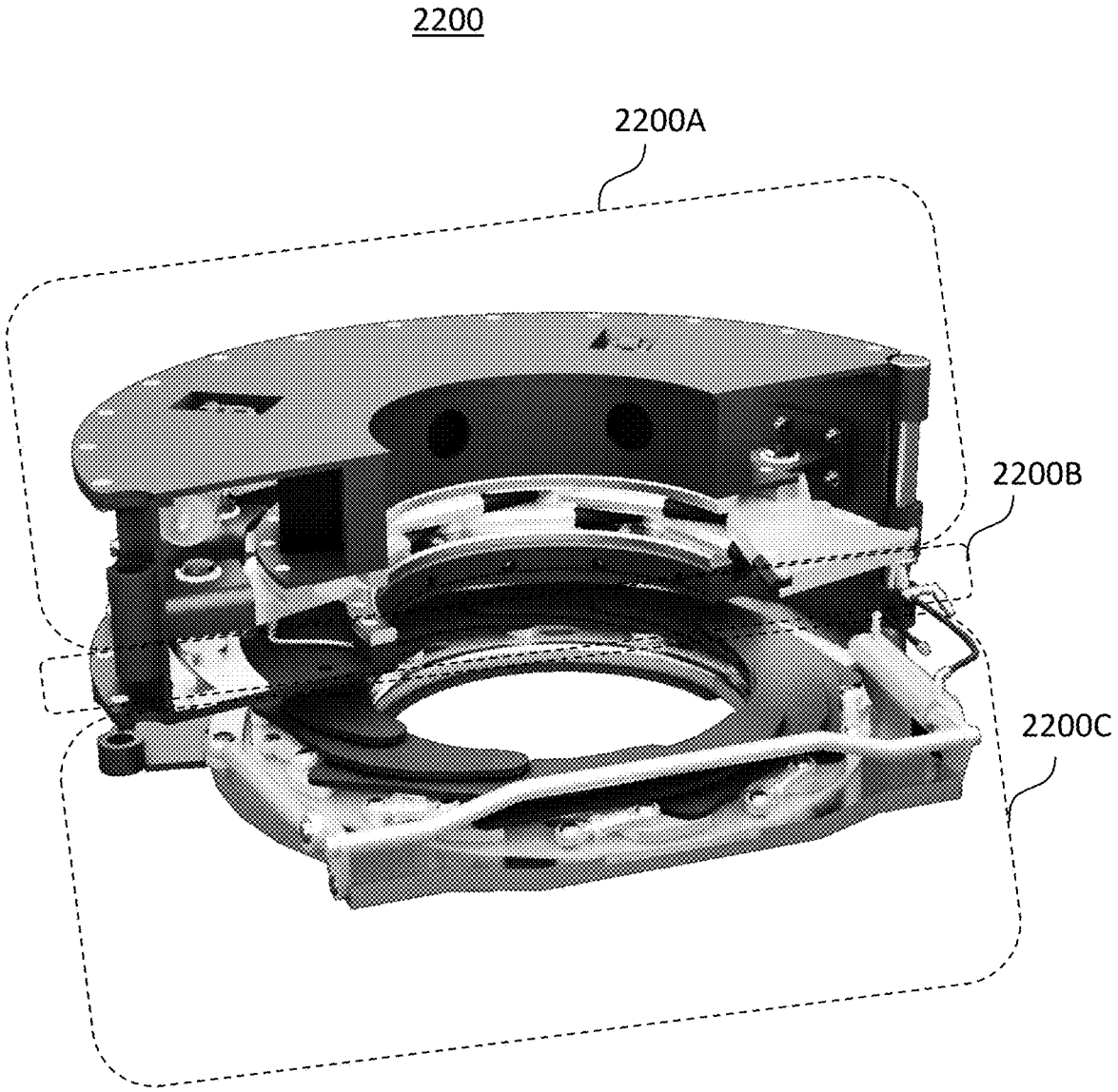
FIG. 22A is a view of an example system that combines an object falling prevention system, a cleaning system, and a washing system located between the object falling prevention system and the cleaning system according to an embodiment.

FIG. 22A shows an example system 2200 that is a combination of an object falling prevention system 2200A, a cleaning system 2200C, and a washing system 2200B located between the object falling prevention system 2200A and the cleaning system 2200C. Note, that only some of the components of the systems 2200A-2200C are shown in FIG. 22A for clarity, with the understanding that other components of these systems are present as well.

Figure 22B:
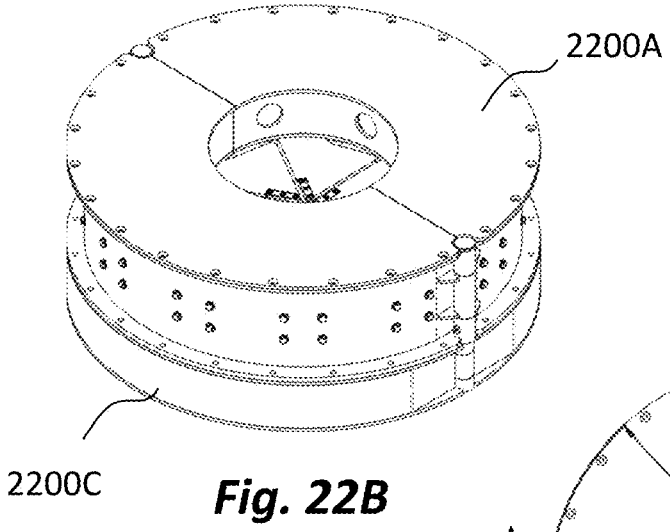
FIG. 22B is an isometric view of the example system shown in FIG. 22A.

FIG. 22B is an isometric view of the combined system 2200 shown in FIG. 22A. As shown, the combined system 2200 includes the object falling prevention system 2200A and the cleaning system 2200C. Further, a washing system may be incorporated into the object falling prevention system 2200A or the cleaning system 2200C.

Figure 22C:
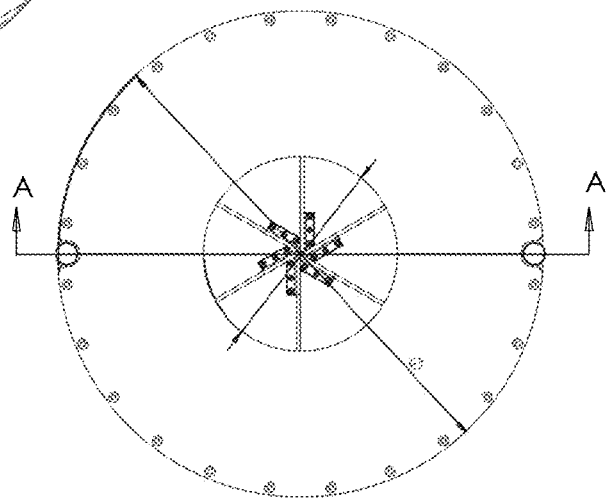
FIG. 22C is a top view of the example system shown in FIG. 22A.
Figure 22D:
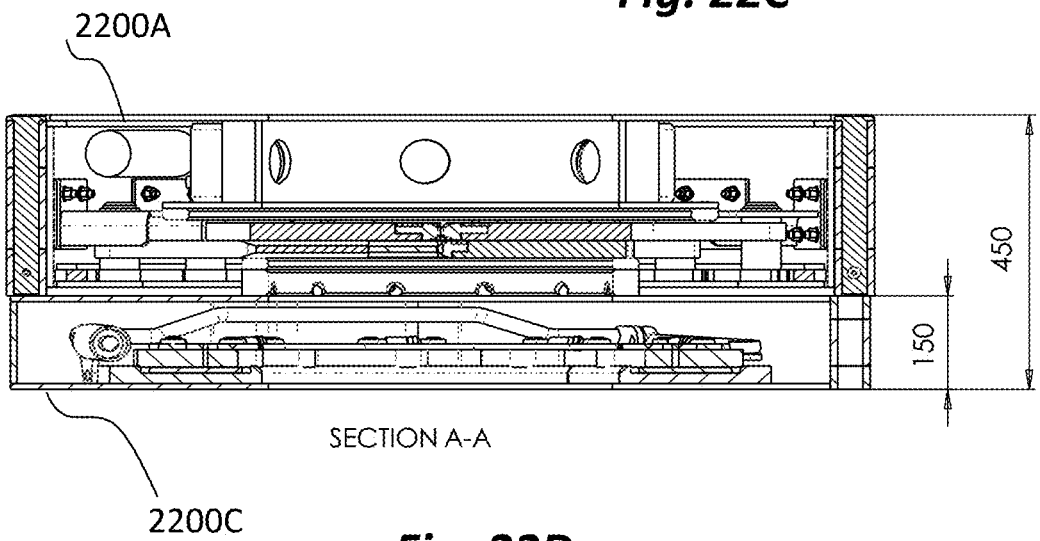
FIG. 22D is a cross-sectional view of the example system shown in FIG. 22A.

A top view of the combined system 2200 is shown in FIG. 22C, where the covers are in a closed position. FIG. 22D is a cross-sectional view of the combined system 2200 along a cross-sectional plane A-A (as shown in FIG. 22C). In one implementation, the object falling prevention system 2200A may have a vertical dimension (height) of about 300 mm, while the cleaning system 2200C may have a vertical dimension (height) of about 150 mm. In some cases, the height the object falling prevention system 2200A may be about 200-2000 mm including all the values and ranges in between. Also, the height of the cleaning system 2200 may be 100 mm-2000 mm with all the values and ranges in between.

Figure 22E:
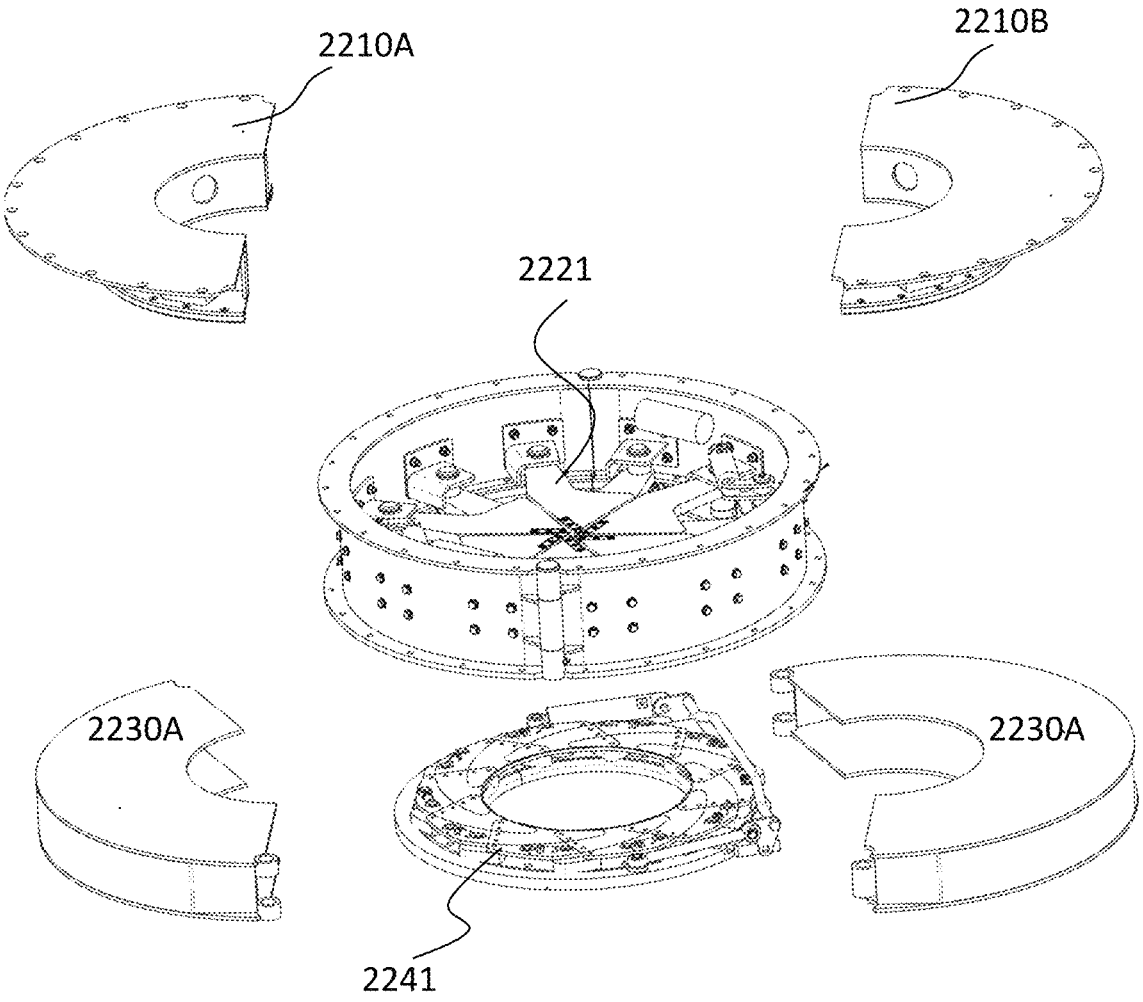
FIG. 22E is an exploded view of the example system shown in FIG. 22A.

FIG. 22E is an exploded view of the system 2200 shown in FIG. 22A, which includes parts 2210A and 2210B of a housing for the object falling prevention system 2200A, parts 2230A and 2230B of a housing for the cleaning system 2200C, covers 2221 and flexible wipers 2241.

In various implementations, the systems 1700-2200 are configured to be sufficiently durable such that a top portion (herein the top portion is also referred to as the top plate) is resistant to a damage when an object weighting 330 pounds, or more is dropped from a height of six feet. Also, the systems 1700-2200 may be explosion proof (herein explosion proof is also referred to as EX rated). Further, the systems 1700-2200 may have dimensions such that they fit well within the conventional well center openings. In an example embodiment, the systems 1700-2200 may have an outside diameter of about 40 inches to 70 inches. In an example embodiment, the systems 1700-2200 may have an outside diameter of about 59 inches. In some cases, the outside diameter for the systems 1700-2200 may be 51-52 inches. Further, the systems 1700-2200 may be designed to weigh between 1000-2000 kg and have a relatively small height in order to fit between a diverter and a rig floor. For example, the systems 1700-2200 may have a height of about 15-18 inches. The systems 1700-2200 may be configured to let tubulars with outer diameter of as much as 20 inches to pass through a center opening. Examples of tubulars include, but are not limited to, drill pipes, tubings, and casings. Further, the systems 1700-2200 may be capable of working with the control mud level (CML) system in place including the mud curtain or mud funnel.

Various embodiments of systems disclosed herein include components (e.g., cover components, wiper components, and/or nozzle components) that need to be controlled. For example, actuators for the covers need to be controlled to execute desired motions of covers; actuators for the flexible wipers need to be controlled to execute desired motions of the flexible wipers; and various valves need to be controlled to control fluid jets ejected from the nozzles. Additionally, in some cases, the tripping in and tripping out speed of tubulars may need to be controlled. All these controlling operations may be achieved via one or more suitable controllers.

Figure 23A:
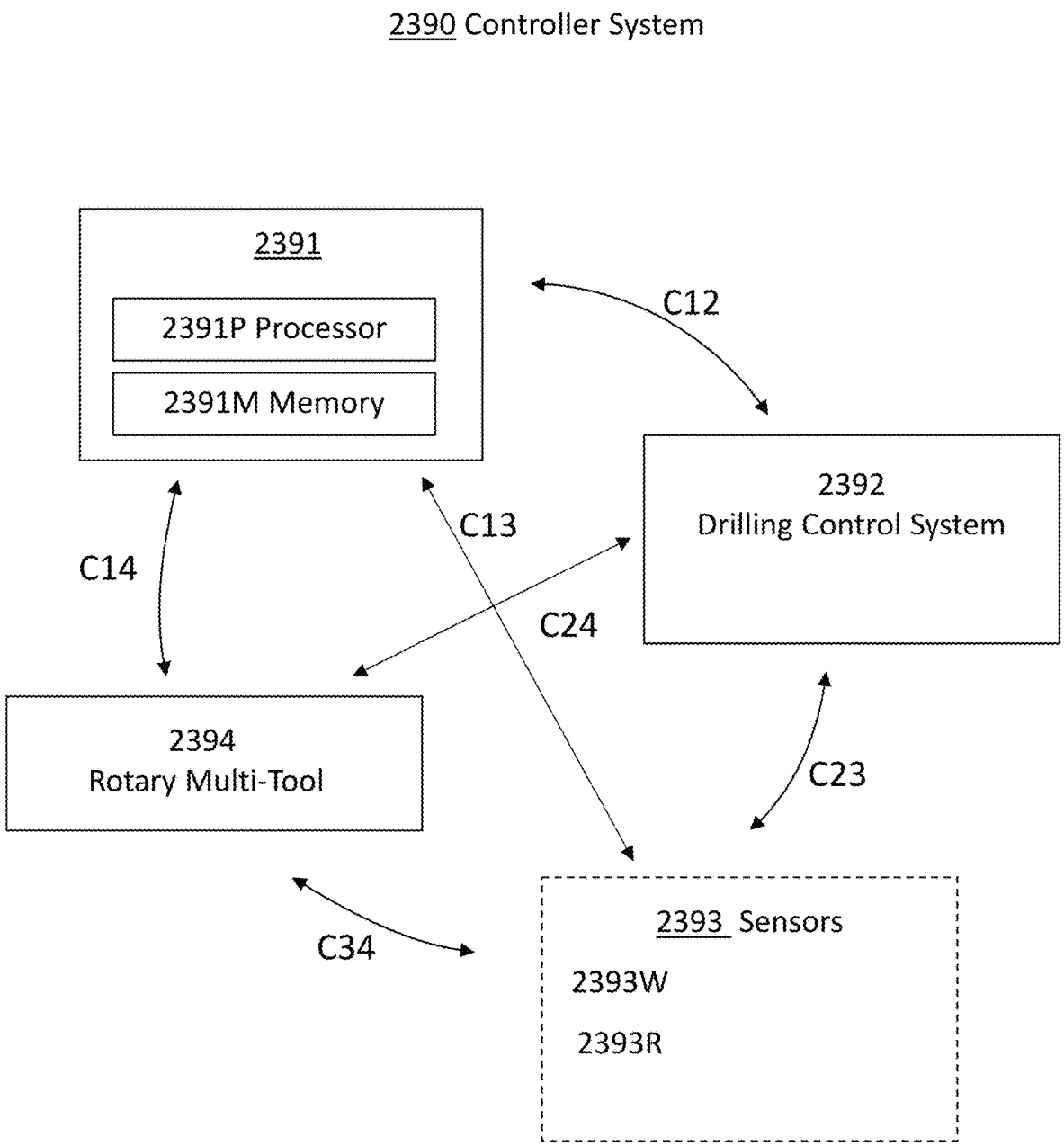
FIG. 23A shows an example controller system for controlling operations of a rotary multi-tool according to an embodiment.

An example controller system 2390 is shown in FIG. 23A. The controller system 2390 includes a controller 2391 which may be implemented as a computing system having a processor 2391P and a memory device 2391M. The processor 2391P may be any suitable processor for executing programming instructions, and the memory device 2391M may be any suitable device for storing data and the programming instructions for the processor 2391P. Further, while not shown in FIG. 23A, the controller 2391 includes a suitable device for communicating signals (in a wired and/or wireless manner) with a drilling control system 2392, optional sensors 2393, and a rotary multi-tool 2394, via respective signal and data network connections C12, C13, and C14. The rotary multi-tool 2394 includes an object falling prevention system (e.g., the object falling prevention system may be similar to the object falling prevention system 100), and optionally, one of a cleaning system (e.g., the cleaning system may be similar to the cleaning system 1100) and/or a washing system (e.g., the washing system may be similar to the washing system 1500).

The controller system 2390 further includes the drilling control system 2392 configured to control tripping in and tripping out of various tubulars (as well placement of various tools within the well, including cables, wires, and the like). In one implementation, the drilling control system 2392 may not directly control the operations of the rotary multi-tool 2394, but instead sends data to the controller 2391, which in turn controls various operations of the rotary multi-tool 2394. The drilling control system 2392 may communicate to the controller 2391 the type of tubular that is being tripped in or tripped out, the speed with which the tubular is being tripped in and tripped out, the length of the tubular that remains to be tripped in or tripped out, the length of the tubular that has already been tripped in or tripped out, information about tubular joints, such as locations of the tubular joints along the tubular (tubular joints have larger diameters than other tubular segments, and information about locations of the tubular joints may be needed to correctly operate at least covers of the rotary multi-tool), a degree of contamination of a section of the tubular in proximity to the rotary multi-tool 2394, and the like. Similar to the processor 2391, the drilling control system 2392 includes a suitable device for communicating signals (in a wired and/or wireless manner) with the processor 2391, the sensors 2393, and the rotary multi-tool 2394, via respective signal and data network connections C12, C23, and C24.

The controller system 2390 further optionally includes sensors 2393. The sensors 2393 may include a first group of sensors 2393W that may be installed at a well center opening, below the well center opening, or anywhere on a drill floor (or at any suitable location of a rig). The sensors 2393W may provide feedback to the processor 2391P via the connection C13 or to the drilling control system 2392 via the connection C23 regarding the tripping operations of the tubular (similar to other devices of the controller system 2390, sensors 2393 include a suitable device for communicating signals (in a wired and/or wireless manner) with the controller 2391, the rotary multi-tool 2394, and/or the drilling control system 2392). In some cases, the sensors 2393 may be configured to communicate signals with the rotary multi-tool 2394 via a connection C34.

The sensors 2393W may provide the feedback on the tripping speed of the tubular, the locations of the tubular joints, the diameter of the tubular that is being tripped in or tripped out, whether the tubular is located at the well center opening, whether the tubular is in a vertical position (or has a tilt relative to the drill floor), and the like. Sensors 2393W may include any suitable sensors such as optical sensors, audio sensors (e.g., ultrasound sensors), electrical sensors and the like.

Additionally, or alternatively, sensors 2393 may include a second group of sensors 2393R that may be part of the rotary multi-tool. For example, sensors 2393R may provide feedback on operations of various components of the rotary multi-tool. Such feedback may, for example, include position of covers of the rotary multi-tool, position of flexible wipers, parameters for the valves (e.g., whether valves are open, closed, or partially open) associated with a washing system of the rotary multi-tool, state of actuators for the covers (e.g., pressure within a hydraulic/pneumatic cylinder configured to move the covers), state of actuators for the flexible wipers (e.g., pressure within a hydraulic/pneumatic cylinder configured to move the flexible wipers), temperature of various components of the rotary multi-tool, and the like).

Further, the sensors 2393R may also provide information about the tubular section located within a central opening of the rotary multi-tool or information about the tubular section that is approaching the central opening of the rotary multi-tool as the tubular is tripping in or tripping out. For example, the sensors 2393R may determine a diameter of the tubular section within the central opening or a diameter of the tubular section approaching the central opening. Further, sensors 2393R may determine the level of contamination of the tubular section within the central opening or the level of contamination of the tubular section approaching the central opening.

The feedback from sensors 2393R and 2393W may be received by the controller 2391, and the controller 2391 may be configured to adjust operational parameters (e.g., based on the feedback from sensors 2392R or 2393W) of the rotary multi-tool 2394. For example, the controller 2391 may send signals to place the covers in an open-cover position, in a closed-cover position or in a partially-closed-cover position. Any other suitable adjustments may also be made for the operation of the rotary multi-tool 2394 based on the feedback from the sensors 2393. For instance, the controller 2391 may operate nozzles of the rotary multi-tool 2394 or may operate the flexible wipers of the rotary multi-tool 2394 independently of the operations of the covers of the rotary multi-tool 2394. In some cases, the controller 2391 may adjust the flow rate of the fluid jets emitted by the nozzles (e.g., the flow rate may be adjusted based on the level of contamination of a tubular located at a well center). Additionally, the controller 2391 may indicate that the pressure supplied to hydraulic/pneumatic cylinders for actuating covers and/or flexible wipers needs to be adjusted.

In some cases, the controller 2391 may be configured to communicate to the drilling control system 2392 that some of the operations performed by the equipment controlled by the drilling control system 2392 may need to be adjusted (or changed). These adjustments or changes may be due to information received from the sensors 2393R or 2393W. For example, if sensors 2393R report a failure of one or more components of the rotary multi-tool 2394, the controller 2391 may be configured to communicate to the drilling control system 2392 that a tripping in or tripping out operation needs to be stopped (e.g., a tubular located at the well center needs to stop moving). Any other adjustments or changes may be requested by the controller 2391 and communicated to the drilling control system 2392. For example, the controller 2391 may communicate that the speed at which the tripping in or tripping out is performed needs to be changed (e.g., increase or decrease).

In various embodiments, default operations may be performed when there is a failure in the operations of the rotary multi-tool 2394. For example, the hydraulic or pneumatic cylinders operating the covers, or the flexible wipers of the rotary multi-tool are configured to "fail open," such that if there is a pressure loss to the hydraulic cylinders, the covers and/or the flexible wipers automatically move into an open-cover or open-wiper position.

The controller system 2390 further includes the rotary multi-tool 2394 configured to communicate with the drilling control system 2392 via the connection C24 and with the controller 2391 via the connection C14. Similar to other devices of the controller system 2390, the rotary multi-tool 2394 includes a suitable device for communicating signals (in a wired and/or wireless manner) with the controller 2391, and/or the drilling control system 2392. In one implementation, the rotary multi-tool 2394 is configured to send confirmation to the drilling control system that the covers are either in an open-cover position, closed-cover position, or partially-closed-cover position (herein the partially-closed-cover position is also the same as partially-open-cover position). In various embodiments, the controller 2394 and/or the drilling control system 2392 are configured to monitor the position and orientation of various drilling equipment in order to prevent tubulars from attempting to enter a central opening of the rotary multi-tool 2394 while the covers of the rotary multi-tool 2394 are in a closed-cover position.

Figure 23B:
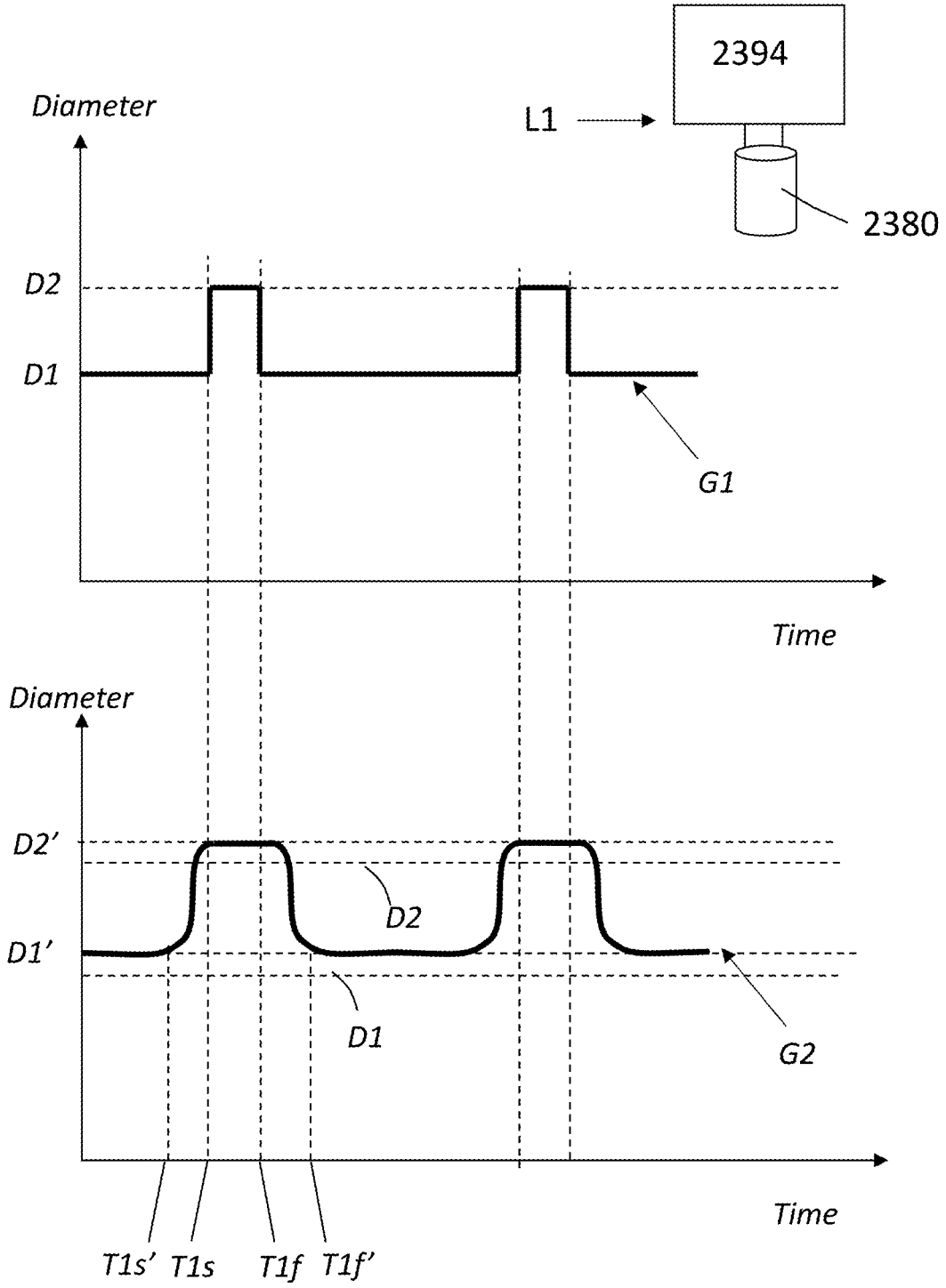
FIG. 23B is a set of example graphs associated with control operations of a controller system according to an embodiment.

FIG. 23B shows example graphs G1 and G2 illustrating one implementation of the controller 2391 for controlling the opening and/or closing of covers of a rotary multi-tool. The graph G1 shows the diameter value of a tubular 2380 observed at a location L1 of covers of the rotary multi-tool 2394 as a function of time. The diameter of the tubular 2380 at the location L1 may change over time as the tubular 2380 is tripping in or tripping out. As shown by the graph G1, the diameter of the tubular 2380 at the location L1 periodically changes as a function of time as the joints of the tubular 2380 pass through the location L1. In various embodiment, the controller 2391 is configured to extend or retract the covers to change the diameter of the uncovered opening (the diameter of the uncovered opening is indicated by graph G2) as the tubular 2380 is tripping in or out. As shown in FIG. 23B, the diameter of the uncovered opening at a time T1*s*' is D1' and is slightly larger than the diameter D1 of the tubular 2380 as observed at the time T1*s*'. Between the time T1*s*' and T1, the diameter of the uncovered opening is configured to increase continuously between D1' and D2', where D2' is slightly larger than D2—the diameter of the tubular 2380 at the time T1 and at the location L1. Having D2' slightly larger than D2 at the time T1 ensures that a joint of the tubular 2380 passes through the uncovered opening of the rotary multi-tool 2394. Further, after time T1*f*, the diameter of the tubular 2380 is reduced to a value D1 at the location L1, and the controller 2391 is configured to further extend the covers to decrease continuously the diameter of the uncovered opening from the value of D2' to the value of D1' (which is slightly larger than the value D1).

In various embodiments, the controller 2391 may receive a signal from the drilling control system 2392 indicating a time (herein such time is referred to as a cover opening time) when the diameter for the uncovered opening needs to be increased, e.g., right before a joint of the tubular is passing through the uncovered opening. Also, the controller 2391 may receive a signal from the drilling control system 2392 indicating a time (herein such time is referred to as a cover closing time) when the diameter for the uncovered opening needs to be decreased. The drilling control system 2392 may determine these opening times and closing times based on the information on the speed of the tubular 2380, the locations of the joints of the tubular 2380 along the length of the tubular 2380, and the length of the tubular 2380 that has been being tripped in or tripped out (e.g., a portion of a length of the tubular 2380 that remains above the covers of the rotary multi-tool 2394 as the tubular 2380 is being tripped in or tripped out). In some cases, the distance between the location of a joint that is proximate to the rotary multi-tool 2394 and is moving towards the rotary multi-tool, and the location of the covers of the rotary multi-tool 2394 (location L1) may be used to determine the times for partially-closed-cover positions of the covers of the rotary multi-tool 2394. Additionally, or alternatively, one or more sensors may provide feedback to the controller 2391 on various aspects of the motion of the tubular 2380, and the controller 2391 may use the processor 2391P to determine the cover opening and/or cover closing times based on the feedback data.

Figure 24:
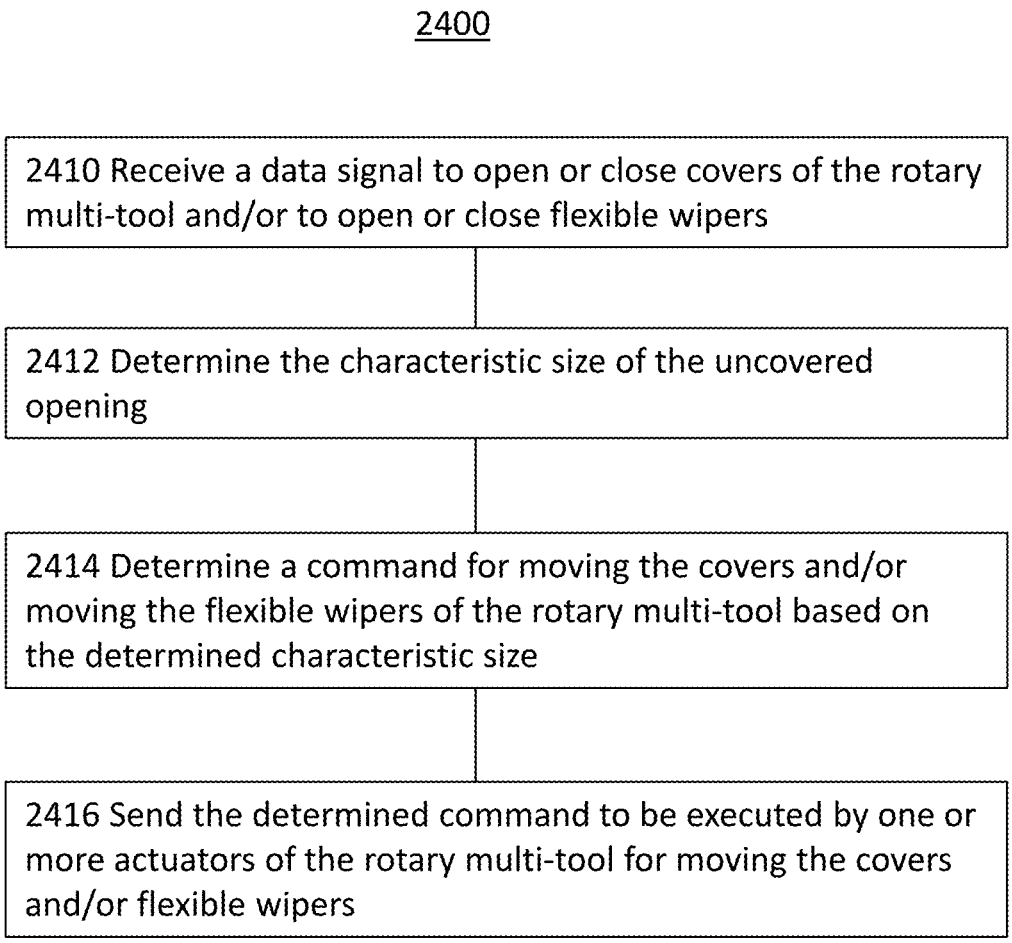
FIG. 24 is an example process of controlling movement of covers and/or flexible wipers according to an embodiment.

FIG. 24 shows an example process 2400 for moving covers and/or flexible wipers of the rotary multi-tool. At step 2410, a controller receives a data signal indicating whether the covers and/or the flexible wipes need to be open or closed. The data signal may be received from a drilling control system based on the tripping information for a tubular available for the drilling control system. Additionally, or alternatively, the data signal may be transmitted by one or more sensors associated with the controller and/or the rotary multi-tool. At step 2412, the controller determines the characteristic size of the uncovered opening, and at step 2414, the controller determines a command for moving the covers and/or moving the flexible wipers of the rotary multi-tool based on the determined characteristic size. Finally, at step 2416, the controller sends the determined command to be executed by one or more actuators of the rotary multi-tool for moving the covers and/or flexible wipers.

In various embodiments, the operations of various components of the rotary multi-tool include opening and closing of covers, turning the wiping of a tubular on or off, turning the washing of the tubular on or off, reporting status of the rotary multi-tool to an interlock system, and sending various other signals related to the operation of the rotary multi-tool to a control system.

Opening and closing of the covers may include various commands and messages that can be communicated between the drilling control system and the rotary multi-tool. Such commands and messages may include: (a) an open command from the drilling control system (DCS) to the rotary multi-tool, (b) a message notifying the DCS that the open command has been received by the rotary multi-tool, (c) a message indicating an open status of the rotary multi-tool, (d) a close command from the DCS to the rotary multi-tool, (e) a message notifying the DCS that the close command has been received by the rotary multi-tool, and (f) a message indicating a closed status of the rotary multi-tool.

Turning the wiping of a tubular on or off may include various commands and messages that can be communicated between the DCS and the rotary multi-tool. Such commands and messages may include: (a) a "wiping on" command from the DCS to the rotary multi-tool indicating that wiping needs to be turned on, (b) a message notifying the DCS that the "wiping on" command has been received by the rotary multi-tool, (c) a message indicating a "wiping on" status of the rotary multi-tool, (d) a "wiping off" command from the DCS to the rotary multi-tool indicating that wiping needs to be turned off, (e) a message notifying the DCS that the "wiping off" command has been received by the rotary multi-tool, and (f) a message indicating a "wiping off" status of the rotary multi-tool.

Turning the washing of a tubular on or off may include various commands and messages that can be communicated between the DCS and the rotary multi-tool. Such commands and messages may include: (a) a "washing on" command from the DCS to the rotary multi-tool indicating that washing needs to be turned on, (b) a message notifying the DCS that the "washing on" command has been received by the rotary multi-tool, (c) a message indicating a "washing on" status of the rotary multi-tool, (d) a "washing off" command from the DCS to the rotary multi-tool indicating that washing needs to be turned off, (e) a message notifying the DCS that the "washing off" command has been received by the rotary multi-tool, and (f) a message indicating a "washing off" status of the rotary multi-tool.

The reporting status of the rotary multi-tool to an interlock system (the interlock system may be any suitable system for controlling various systems and components of a drilling rig that grip, lift, release, and support a tubular during a casing running or tripping operations) may include various commands and messages that can be communicated between the DCS and the rotary multi-tool. Such commands and messages may include: (a) an open status message received by DCS) from the rotary multi-tool, (b) a closed status message received by DCS from the rotary multi-tool, (c) a message indicating that the sensor determining the open status of the rotary multi-tool is operational, and (d) a message indicating that the sensor determining the closed status of the rotary multi-tool is operational.

Further, other messages between the DCS and the rotary multi-tool may include information about operational parameters of the rotary multi-tool (e.g., parameters indicating correct operations of the rotary multi-tool), status of various sensors of the rotary multi-tool (e.g., if the sensors are all operational), status of various program logic controllers (PLCs), or any other issues, diagnostic signals, alarms, and the like that may be received from the rotary multi-tool or may be provided to the rotary multi-tool.

In various embodiments, the rotary multi-tool may be engaged in various ways to support the drilling activities. In some cases, the rotary multi-tool may not be deployed during a formation of a top hole. When rotating a tubular (e.g., when rotating the drilling pipe), the covers of the rotary multi-tool may be in an open-cover position. When tripping the tubular, the covers may be in a partially-closed-cover position. During a completion operation, the covers may be in a partially-closed cover position. During a maintenance of the rotary multi-tool, the covers may be fully closed. Further, when wiping the tubular is required, the flexible wipers of the rotary multi-tool are engaged (e.g., the flexible wipers are in a closed-wiper position or partially-closed-wiper position). Alternatively, when wiping is not needed, the flexible wipers of the rotary multi-tool are disengaged (e.g., the flexible wipers are in an open-wiper position). Further, when washing the tubular is required, the nozzles of the rotary multi-tool are engaged (e.g., the nozzles are configured to eject fluid jets towards a surface of the tubular). Alternatively, when washing is not needed, the nozzles of the rotary multi-tool are not engaged (e.g., no fluid jets are emitted by the nozzles).

Consistent with one or more of the embodiments disclosed herein, the present disclosure also provides a method of covering an opening of a wellbore and removing mud, fluid, and/or debris from a tubular tripping out of the wellbore, the method comprising: (a) moving a plurality of covers disposed around the tubular to a partially-closed-cover position or a closed-cover position, thereby covering at least a portion of the opening; and (b) moving a plurality of flexible wipers disposed around the tubular to be in contact with the tubular, thereby removing the mud, fluid, and/or debris from the tubular when the tubular is tripping out. Optionally, the method further comprises ejecting, onto the tubular, fluid jets from a plurality of nozzles disposed around the tubular, thereby cleaning the tubular.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of the present technology may be implemented using hardware, firmware, software or a combination thereof. When implemented in firmware and/or software, the firmware and/or software code can be executed on any suitable processor or collection of logic components, whether provided in a single device or distributed among multiple devices.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising"

can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The terms "substantially," "approximately," and "about" used throughout this Specification and the claims generally mean plus or minus 10% of the value stated, e.g., about 100 would include 90 to 110.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A device for covering an opening of a wellbore, the device comprising:

a housing having a central opening, the housing configured to be secured within a well center opening;

a plurality of covers arranged around the central opening, the plurality of covers configured to: (a) move to an open-cover position, a partially-closed-cover position, or a closed-cover position; and (b) cover at least a portion of the central opening when the plurality of covers is in the partially-closed-cover position or the closed-cover position;

at least one actuator configured to extend and retract the plurality of covers; and a controller configured to send signals to the at least one actuator to extend the plurality of covers and to retract the plurality of covers;

wherein the controller is further configured to use motion data and diameter data of a tubular to determine the partially-closed-cover position for a cover opening time, the partially-closed-cover position being based on the motion data and diameter data of the tubular, and the controller sends signals to extend and retract the plurality of covers to the partially-closed-cover position for the cover opening time.

2. The device of claim 1, wherein:

in the open-cover position, the plurality of covers is retracted, thereby unblocking the central opening;

in the partially-closed-cover position the plurality of covers is partially extended, thereby partially covering the central opening; and in the closed-cover position, the plurality of covers is extended, thereby covering the central opening.

3. The device of claim 1, wherein:

the closed-cover position covers at least 10% more of the central opening than the open-cover position.

4. The device of claim 1, wherein in the partially-closed-cover position or the closed-cover position, the plurality of covers is configured to close around a tubular.

5. The device of claim 4, wherein:

in the partially-closed-cover position, an area of the central opening not covered by the plurality of covers is about 1% to 10% larger than a cross-sectional area of the tubular.

6. The device of claim 4, wherein an edge of each cover configured to be in proximity to the tubular includes a polymer.

7. The device of claim 1, wherein the plurality of covers includes between 4 and 30 covers.

8. The device of claim 1, wherein each one of the plurality of covers includes a metal.

9. The device of claim 1, wherein:

the at least one actuator comprises a cylinder, the cylinder being at least one of a hydraulic cylinder or a pneumatic cylinder;

the device further comprises a sensor configured to provide feedback to the controller, the feedback including a pressure within the cylinder; and the controller is further configured to receive the feedback and to place the covers in the partially-closed-cover position based on the pressure within the cylinder.

10. The device of claim 1, wherein:

the at least one actuator comprises a hydraulic cylinder or a pneumatic cylinder; and when the at least one actuator comprises the hydraulic cylinder, a failure in hydraulic supply causes the at least one actuator to move the plurality of covers to an open-cover position; or when the at least one actuator comprises the pneumatic cylinder, a failure in pneumatic supply causes the at least one actuator to move the plurality of covers to an open-cover position.

11. The device of claim 1, wherein the at least one actuator is coupled to a driver plate via a driver shaft.

12. The device of claim 1, further comprising a plurality of actuators, wherein each one of the plurality of actuators is configured to extend or retract a corresponding cover of the plurality of covers.

13. The device of claim 1, wherein the central opening has a cylindrical shape with a circular cross section, and wherein a diameter of the circular cross section is larger than nineteen inches.

14. The device of claim 13, wherein in the partially-closed-cover position, the plurality of covers is configured to surround an uncovered opening located at a center of the central opening, the uncovered opening having a cylindrical shape with a circular cross section.

15. The device of claim 14, wherein a diameter of the circular cross section of the uncovered opening ranges between zero and a diameter of the central opening.

16. The device of claim 1, wherein the housing and the central opening have a cylindrical shape, and wherein the central opening is located at a center of the housing.

17. The device of claim 1, wherein the plurality of covers is disposed at a cross-sectional level within the housing.

18. The device of claim 1, wherein the plurality of covers is disposed at a cross-sectional level within the housing; and wherein the device further comprises a plurality of nozzles disposed below the cross-sectional level of the plurality of covers and arranged around the central opening, the plurality of nozzles configured to eject a fluid.

19. The device of claim 18, wherein the plurality of nozzles is positioned and oriented such that the ejected fluid is configured to wash a surface of a tubular, when the tubular is placed at a center of the central opening.

20. The device of claim 1, wherein the at least one actuator is coupled to a driver plate via gear elements.

21. A device for covering an opening of a wellbore, the device comprising:

a housing having a central opening, the housing configured to be secured within a well center opening;

a plurality of covers arranged around the central opening, the plurality of covers configured to: (a) move to an open-cover position, a partially-closed-cover position, or a closed-cover position; and (b) cover at least a portion of the central opening when the plurality of covers is in the partially-closed-cover position or the closed-cover position;

at least one actuator configured to extend and retract the plurality of covers; and a controller configured to send signals to the at least one actuator to etend or retract the plurality of covers;

wherein the controller is further configured to use motion data and diameter data of a tubular to determine the partially-closed-cover position; and wherein the motion data includes a velocity of the tubular.

22. A device for covering an opening of a wellbore, the device comprising:

a housing having a central opening, the housing configured to be secured within a well center opening;

a plurality of covers arranged around the central opening, the plurality of covers configured to: (a) move to an open-cover position, a partially-closed-cover position, or a closed-cover position; and (b) cover at least a portion of the central opening when the plurality of covers is in the partially-closed-cover position or the closed-cover position;

at least one actuator configured to extend and retract the plurality of covers; and a controller configured to send signals to the at least one actuator to extend or retract the plurality of covers;

wherein the controller is further configured to use motion data and diameter data of a tubular to determine the partially-closed-cover position; and wherein the housing is secured in place within the well center opening via a plurality of spring elements, thereby allowing the central opening to move laterally.

23. A device for covering an opening of a wellbore, the device comprising:

a housing having a central opening, the housing configured to be secured within a well center opening;

a plurality of covers arranged around the central opening, the plurality of covers configured to: (a) move to an open-cover position, a partially-closed-cover position, or a closed-cover position; and (b) cover at least a portion of the central opening when the plurality of covers is in the partially-closed-cover position or the closed-cover position;

at least one actuator configured to extend and retract the plurality of covers; and a controller configured to send signals to the at least one actuator to extend or retract the plurality of covers;

wherein the controller is further configured to use motion data and diameter data of a tubular to determine the partially-closed-cover positon; and wherein the device further comprises a radio frequency identification (RFID) reader configured to detect one or more RFID tags on a tubular, the RFID reader providing information for use by the controller in extending and retracting the plurality of covers.

* * * * *